US007871065B2

(12) United States Patent
Fukasawa et al.

(10) Patent No.: US 7,871,065 B2
(45) Date of Patent: Jan. 18, 2011

(54) SHEET FEEDING DEVICE AND POST-PROCESSING APPARATUS AND IMAGE FORMING SYSTEM COMPRISING THE SAME

(75) Inventors: Eiji Fukasawa, Yamanashi (JP); Ichitaro Kubota, Koufu (JP); Kenichi Matsuno, Koufu (JP); Satoshi Iwama, Minamialps (JP)

(73) Assignee: Nisca Corporation, Minamikoma-Gun, Yamanashi (JP)

( * ) Notice: Subject to any disclaimer, the term of this patent is extended or adjusted under 35 U.S.C. 154(b) by 393 days.

(21) Appl. No.: 12/010,954

(22) Filed: Jan. 31, 2008

(65) Prior Publication Data

US 2008/0182740 A1 Jul. 31, 2008

(30) Foreign Application Priority Data

| | | |
|---|---|---|
| Jan. 31, 2007 | (JP) | 2007-022037 |
| Mar. 29, 2007 | (JP) | 2007-089280 |
| Mar. 29, 2007 | (JP) | 2007-089283 |
| Mar. 29, 2007 | (JP) | 2007-089284 |
| May 30, 2007 | (JP) | 2007-144037 |

(51) Int. Cl.
*B65H 37/04* (2006.01)

(52) U.S. Cl. ..... 270/37; 270/32; 270/45; 270/58.07; 270/58.08

(58) Field of Classification Search ..... 270/20.1, 270/32, 37, 45, 51, 58.07, 58.08; 493/424, 493/427, 434, 442
See application file for complete search history.

(56) References Cited

U.S. PATENT DOCUMENTS

| | | | | |
|---|---|---|---|---|
| 6,568,668 | B1 * | 5/2003 | Wakabayashi et al. | 270/58.11 |
| 7,726,638 | B2 * | 6/2010 | Itagaki | 270/32 |

FOREIGN PATENT DOCUMENTS

| | | |
|---|---|---|
| JP | H10-167562 | 6/1998 |
| JP | 2000-327209 | 11/2000 |
| JP | 2001-002317 | 1/2001 |
| JP | 2001-302089 | 10/2001 |
| JP | 2002-145516 | 5/2002 |

* cited by examiner

*Primary Examiner*—Leslie A Nicholson, III
(74) *Attorney, Agent, or Firm*—Manabu Kanesaka

(57) ABSTRACT

A sheet folding device has a releasable clutch between a roll driving device and a pair of folding rolls for folding a sheet bunch so that when a folding blade inserts the sheet bunch to a nip position on the pair of folding rolls, the first and second folding rolls rotate following the inserted sheets. The sheet folding device includes a guide for holding the sheet bunch at a predetermined fold position. The first and second folding rolls arranged at the fold position are in pressure contact with each other. The folding blade inserts the sheet bunch supported on the guide to the nip position on the first and second folding rolls. The roll driving device rotationally drives the first and second folding rolls. The first and second folding rolls and the roll driving device are coupled together via the releasable clutch.

15 Claims, 46 Drawing Sheets

Image formation in stapling finish mode

Image formation in sheet bunch folding finisih mode

SHEET FEEDING DEVICE AND POST-PROCESSING APPARATUS AND IMAGE FORMING SYSTEM COMPRISING THE SAME

BACKGROUND OF THE INVENTION AND RELATED ART STATEMENT

The present invention relates to a sheet folding device that folds sheets carried out from an image forming apparatus such as a printer and a post-processing apparatus comprising the sheet folding device. More particularly, the present invention relates to improvements in a folding mechanism that folds a bunch of sheets together using a pair of folding rolls.

A device folding one or more overlapping sheets (bunch) together at a predetermined folding line is commonly known as a sheet folding device. Such a folding device is not only used as a single-function (standalone) device but also incorporated into, for example, a post-processing apparatus for an image forming apparatus as a sheet folding unit. For example, the sheet folding device is used to perform bookbinding by setting and stapling sheets with images formed thereon by an image forming apparatus such as a copier and folding the resultant sheet bunch at a half or one-third position into a booklet.

Among sheet folding mechanisms, a mechanism commonly adopted owing to the relatively simple structure thereof is the mechanism which folds the sheets by inserting the sheets between a pair of rolls that are in pressure contact with each other so that a fold position on the sheets first reaches the rolls.

For example, Patent Document 1 [Japanese Patent Laid-Open No. 2001-2317] discloses a device that sets sheets, from an image forming apparatus, into a bunch and then staples the sheet bunch at a central part thereof using staple means located on a sheet setting tray. Further, Patent document 1 discloses inserting the saddle-stitched sheet bunch between the paired rolls using a folding blade (folding plate) and folding the sheet bunch at a fold line position when the sheet bunch is delivered by the rolls. Further, Patent document 1 also states that the conventional art fails to take into account the specific relationship between the approach speed of the folding blade and the rotating peripheral speed of the rolls, resulting in breakage during sheet folding and thus discloses that a reduced rotating peripheral speed is set for the folding rolls relative to the speed of the folding blade in order to solve this problem.

Further, according to Patent document 1, a mechanism is disclosed in which sheet holding means for holding a sheet bunch has a pair of folding rolls arranged at a central fold line position thereof. Further, the Patent document 1 also discloses a folding blade which (folding plate) angles and inserts the sheet bunch between roll nips and the rolls then folding the sheet bunch. The folding rolls are wider than the sheets and are constructed to have a roll shape (cylindrical shape) so as to evenly urge the entire sheet bunch in a sheet width direction. However, when the cylindrical rolls that are in pressure contact with each other, fold the sheets (one or more sheets) together, the sheets are more likely to be rucked which is a disadvantage.

Further, Patent Document 2 [Japanese Patent Laid-Open No. 2000-327209] describes that when a sheet bunch is stapled and folded at a fold line position, a ruck may be developed which extends rearward from a staple end surface (fold line edge). That is, when sandwiched between the cylindrical folding rolls, the sheet bunch stapled at the fold line may be corrugated at a trailing end thereof, with a ruck being developed. Patent Document 2 thus proposes that the folding rolls be partly cut into crescentic shapes so as to heavily urge the fold line portion by the peripheral surfaces thereof, while avoiding sandwiching an area behind the fold line between the folding rolls. Further, Patent Document 2 also discloses a cam structure that releases the pressure contact of the folding rolls.

Patent Document 3 [Japanese Patent Laid-Open No. 10-167562] discloses a folding mechanism having folding rolls, which are in pressure contact with each other and which are arranged above sheets, The sheets are carried out from an image forming apparatus and set and collected into a bunch. The folding mechanism also includes a folding blade feeding the sheet bunch from an opposite side of the collecting section to between roll nips. The folding rolls are arranged so as to substantially contact a surface of the sheet bunch collected in the collecting section. Simultaneously with the driving rotation of the pair of rolls, the folding blade bends the sheet bunch at the fold position and inserts the sheet bunch between the roll nips. Patent Document 3, further discloses sheet guides larger than the diameter of the rolls provided around the outer peripheries of the rolls to prevent the sheet bunch from being subjected to a ruck or the like when the sheet bunch is delivered to the nip position.

Similarly, Patent Document 4 [Japanese Patent Laid-Open No. 2002-145516] discloses a folding mechanism having folding rolls offset from sheets collected into a bunch, by a predetermined distance, and a folding blade that feeds the sheet bunch to between roll nips. Thus, the conventional documents commonly disclose a mechanism which has a pair of folding rolls that are in pressure contact with each other to fold a sheet bunch into a booklet and in which the sheet bunch is fed so as to be folded at a fold line position by the folding blade and is nipped and folded between the folding rolls.

Patent Document 5 [Japanese Patent Laid-Open No. 2001-302089] proposes a mechanism that balances a load acting on a leading end of sheets with a load acting on a trailing end of the sheets in order to prevent the sheets from being misaligned when a folding blade inserts the sheets between the nips of folding rolls. The misalignment may occur when the collected sheets are curled or when the loads of a conveying roller and the like act biasedly on the sheets.

In any of the above-described conventional techniques, the sheet guide, which holds the sheets at the fold position, collects the sheets on a substantially flat plane. The folded sheet bunch is discharged straight to the exterior of the device in a direction in which the sheet bunch is inserted by the blade.

The following problems and disadvantages are involved in sheet folding devices using the above-described conventional techniques and post-processing apparatuses and image forming systems comprising the sheet folding devices.

First, when the folding blade inserts the bunched sheets to between the rolls that are in pressure contact with each other, the following problem occurs. As pointed out in Patent Document 1, when the peripheral speed of the roll pair is higher than the moving speed of the folding blade, an outer sheet contacting the roll pair is fed between the paired rolls faster than an inner sheet contacting the folding blade. Consequently, while the sheet bunch is being stapled, a trouble such as a ruck or damage may occur on the outer sheet. Furthermore, even if the roll speed is the same as the blade speed, the pressure contact force between the rolls, the frictional force among the sheets, and the like may vary. Further, an external shock may make the conveying force of the roll pair and the conveying force of the folding blade unequal, both of which are exerted on the sheets. This may result in a ruck or damage as described above.

Furthermore, when the moving speed of the folding blade is set higher than the peripheral speed of the rolls as described in Patent Document 1, a difference in speed may occur between the roll pair and the sheet bunch inserted between the rolls by the folding blade, particularly between the roll pair and the outer sheet. Therefore, a slip between the roll pair and the sheet surface may occur. The slip may cause the applied image ink to be rubbed, leading to a blurred image. Patent document 1 fails to prevent the image rubbing which adds to the disadvantage. In particular, if for example, an image is formed on a cover sheet positioned outside the sheet bunch, the problem significantly affects finish quality.

The above-mentioned problem associated with sheet folding frequently occurs when the folding roll diameter is reduced to miniaturize the device. It is also known that the increased number of sheets in the sheet bunch increases the frequency with which a folding defect such as a ruck or damage occurs. For example, when a sheet bunch, with a large number of sheets, is fed to between the rolls while being folded along the fold line by the folding blade, the outer sheet (cover sheet or the like), first contacting the roll pair, is caught between the rolls before and separately from the other sheets. This causes the above-described problem.

Therefore, it is important to identify that the problem such as a ruck, damage, or image rubbing which is associated with folding of the sheet bunch is attributed to the difference in speed between the folding rolls and the folding blade. Thus, it is an object of the present invention to obviate the above-mentioned problems by inserting the bunched sheets to the nip position on the folding rolls at the moving speed of the folding blade, and after the sheets reach the nip position, feeding the sheets at the peripheral speed of the roll pair.

Second, when the sheets consecutively carried out from the image forming apparatus are set, collected, and folded into a booklet as described above, the sheets are collected on a flat surface, and the folding rolls are arranged in contact with the top surface of the sheets as described in Patent Document 3. Furthermore, in Patent Document 4, the sheets are supported at the fold position by the sheet guides, composed of substantially flat planes. In this condition, to insert the sheets between the roll nips, the folding blade projects the sheet bunch so as to bend the sheet bunch at the fold line.

Thus, with the conventional folding devices, the sheet bunch is supported on the guides, composed of substantially flat surfaces. The flat sheet bunch is thus inserted between the nips of the folding rolls while being bent by the folding blade. Thus, when the folding rolls are arranged in contact with and in proximity to the surface of the sheet bunch as described in Patent Document 1, the upper layer sheet is first delivered by the folding rolls when the folding blade projects the sheet bunch. This may result in a void between the stacked sheets. The presence of the void between the sheets at the fold position may make the leading ends (fore edges) of the sheets loose, degrading folding quality. Furthermore, a friction mark of the folding rolls may be left on the front layer sheet, for example, leaving an abrasion mark on an image forming surface.

Thus, in Patent Document 3, the folding rolls are arranged downstream of and offset from the sheet bunch fold position by a certain distance. The sheet bunch is bent into an angular form using the folding blade and the sheet guides, and nipped and folded between the folding rolls. However, the adoption of this mechanism poses a new problem described below.

In the conventional art, the folding rolls are arranged in contact with the sheet bunch placed flat, and the folding blade inserts the sheet bunch to the nip position along the outer peripheries of the rolls. In contrast, the folding rolls offset from the sheet bunch by a certain distance may disadvantageously result in a ruck on the sheets or misalignment of the fold line position when the sheet bunch is bent by the folding blade before being nipped between the rolls. That is, the sheet bunch placed flat may contain a sheet curled in a direction opposite to that in which the sheet bunch is to be bent. When pushed at the fold position by the folding blade, the sheet curved in the direction opposite to the sheet bunch bending direction and sandwiched between flat sheets may be rucked in the central part thereof or the fold position may deviate from the correct one. When the sheets set at the fold position include those curved in the inserting direction and those curved in the opposite direction, the sheets may be rucked or the fold position may be misaligned when the sheets are folded together.

The rucked sheets or the misalignment of the sheet leading ends after the folding may occur if a void is present between the collected sheets or if the direction in which the curled sheet is curled is opposite to the bending direction. A possible solution to this problem is to tightly support the sheet bunch so as to avoid creating a void between the sheets when the sheet bunch is held at the fold position and to prevent the curled sheet from being bent in the opposite direction when the folding blade bends the sheet bunch.

Third, with the sheet folding mechanism in which the folding blade inserts the sheets (sheet bunch) between the nips of the pair of folding rolls that are in pressure contact with each other so that the fold line position first reaches the nips as described above, the sheets may be rucked. In this rucking condition, when folded at the fold line position by the folding rolls, the sheets (sheet bunch) may be rucked at the trailing end thereof. To prevent this, the conventional art, for example, the structure in Patent Document 1, precisely sets the diameter and axial parallelism of the folding rolls. Thus, disadvantageously, this structure is difficult to manufacture and requires advanced techniques for maintenance during use. Furthermore, it appears that the structure in Patent Document 2, although, might prevent possible rucking resulting from stapling of the sheets at the fold line position, cannot prevent possible rucking occurring as described below.

When the sheets (sheet bunch) are sandwiched between and folded together by the pair of folding rolls and a mechanism is adopted which adjusts the sandwiching force of the rolls exerted on the fold line on the sheets and on an area located behind the fold line, a timing at which the rolls pressurizes the sheets and a timing at which the folding blade inserts the sheets may vary with the operation. If the timings deviate from each other and the sheet pressurizing timing is delayed, the sheets cannot be reliably folded together at the fold line. Furthermore, if a timing at which the sandwiching of the sheets is released is delayed, the sheets may be rucked in an area thereof behind the fold line.

In the structure as described in Patent Document 2, the folding rolls are shaped like crescents or composed of cams rotating around a driving shaft so that a part of the peripheral surface of each of the rolls pressurizes the sheets, while a different part of the peripheral surface avoids pressurizing the sheets. Thus, to fold longer sheets together, the rotation angle of the folding rolls must be accurately controlled in accordance with a sheet insertion condition (timing). On the other hand, when the sheets are inserted to the nip position by the folding blade, the timing of actuation of the folding blade and a timing at which the sheets reach the nip position vary with the operation depending on a load imposed on the sheets being bent and deformed at the fold line. For example, the timings are advanced when one thin sheet is folded and are delayed when a large number of thick sheets are folded.

It is thus difficult to control the rotation angle of the folding rolls and the operation of the folding blade in accordance with fixed timings regardless of the thickness of the sheet or the sheet bunch. Consequently, the sheets are unavoidably rucked in the area thereof behind the fold line. In particular, if the diameter of the folding rolls is reduced to miniaturize the device or sheets of various sizes or thicknesses are used, rucking occurs frequently as described above.

It is therefore necessary to release the pressurizing force in conjunction with the timing of movement of the folding blade inserting the sheets between the nips of the folding rolls, the sheets can be folded at the exact fold line position, with the pressurization of the area of the sheets behind the fold line avoided, regardless of the sheet size or thickness or the sheet bunch thickness.

Fourth, when the sheet bunch with the stacked sheets is sandwiched between and folded together by the paired rollers that are in pressure contact with each other, the sheet bunch nipped between the paired rollers is conventionally carried out in a linear direction orthogonal to the nip direction. This is because the folding rolls are normally shaped like rounds or cylinders longer than the width of the sheets, so that rucking or the like may occur unless the folded sheet bunch is carried out to a tray located outside the device, along a straight path orthogonal to the nip direction.

When the folded sheet bunch is carried out from the folding rolls to the exterior of the device along the straight, linear path orthogonal to the nip direction as described in, for example, Patent Document 1, spatial limitations are imposed on the layout of the device. For example, the device configuration disclosed in Patent Document 1 requires paper guides holding the sheets in front of and behind the folding rolls. Thus, to curve the sheets fed in a horizontal direction by the image forming apparatus, in a vertical direction to collect the sheets in upright bunch form and to fold and carry out the sheet bunch by the folding rolls, a sheet discharging tray must be located on the path orthogonal to the roll pair. This is because the sheet bunch folded into a booklet is not readily curved or deformed, so that the sheet discharging tray cannot be located away from the folding rolls, for example, above or below the folding rolls.

Thus, an attempt is also made to use sheet discharging rollers and guides to forcibly curve the sheet bunch from the folding rolls during a carry-out operation. However, the front layer sheet in the sheet bunch may be rucked. Furthermore, during the carry-out operation, the leading end of the sheet bunch is curved and deformed while rubbing against surfaces of the guides. This increases a conveying load for an elastic sheet bunch such as a bunch of cardboards, resulting in a jam or an increase in the size of the device or in manufacturing costs owing to the need for a driving motor of a higher capacity than required or the like.

The above-described problems can be solved by controlling the rotation of the pair of folding rolls so that the sheet bunch is curved, in the device configuration in which the folded sheet bunch is carried out to the sheet discharging tray through the sheet discharging guides curved upward or downward with respect to the direction in which the sheet bunch is inserted by the blade.

Fifth, to collect the sheets into a bunch at the fold position and to fold the sheet bunch by the folding rolls, a mechanism is conventionally used which brings an edge (leading or trailing end) of the sheets into abutment with a regulating member and which folds the sheets together using a knife-like blade (folding plate). If this folding mechanism is used for sheets of different lengths, the collected sheets need to be moved to a predetermined fold position. For example, the sheets may be misaligned when moved along the sheet guides in the order of the staple position and the fold position.

In particular, if the sheets are set and collected in a substantially horizontal posture or a substantially vertical upright posture, the sheets may be misaligned when the sheet bunch is moved to the predetermined staple or fold position according to the sheet size. The movement of the sheets is conventionally performed by the conveying roller for horizontal support or by a leading end regulating member for vertical support. In this case, with the roller, a variation in frictional force between the sheets may misalign the leading ends of the sheets. With the leading end regulating member, curled sheets may misalign the leading ends of the sheets.

It is therefore an object of the present invention to provide a sheet folding device that prevents a sheet bunch from being misaligned, rucked, or damaged when inserted and folded together between paired rolls, thus providing excellent finish quality.

A further object of the present invention is to provide a post-processing apparatus and an image forming system which can collect sheets sequentially carried out from an image forming apparatus, into a bunch and then fold the sheet bunch at a predetermined fold line.

The present invention achieves not only the above-described objects but also objects described below. The above-described problems are expected to be solved by tightly supporting a sheet bunch held at a fold position so as to avoid creating a void between the sheets, and when the folding blade bends the sheet bunch, preventing the curled sheets from being bent in the opposite direction. This is because the sheets may be rucked when a void is present between the sheets and because rucking or misalignment of the leading ends of the folded sheets may occur if a direction in which curled sheets are curled is opposite to a bending direction. One of the objects is thus to provide a sheet folding device that, when the sheets are folded, prevents the possible rucking and the possible misalignment of the leading edges of the folded sheets and an image forming system that, when curled sheets carried out from an image forming apparatus or the like are set, collected, and folded, prevents the possible rucking and the possible misalignment of the leading edges of the folded sheets.

Yet another object of the present invention is to provide an inexpensive sheet folding device of a simple structure which, when sheets are folded by a pair of folding rolls, prevents the sheets from being rucked and also prevents a friction mark of the folding rolls from being left on the sheets.

Another object is to provide a sheet folding device that allows the sheet bunch folded by the folding rolls to be smoothly carried out to a sheet discharging tray located above or below the folding rolls in the device without damaging the sheet bunch, thus providing a compact device layout using a reduced amount of space.

Another object is to provide a compact, inexpensive image forming system that sets and collects sheets carried out from the image forming apparatus, into a bunch and then folds the sheet bunch into a booklet.

Another object is to provide a sheet folding device which, when the sheets collected into a bunch are moved to the predetermined fold position for setting, prevents the possible misalignment of sheet edges and which, when the sheet bunch is folded together at the fold position, prevents the possible misalignment of a fold line.

Further objects and advantages of the invention will be apparent from the following description of the invention.

SUMMARY OF THE INVENTION

To accomplish the above-described objects, a sheet folding device according to the present invention has a releasable clutch means between roll driving means and a pair of folding rolls, folding the sheet bunch so that when a folding blade inserts a sheet bunch to a nip position on the pair of folding rolls, the first and second folding rolls rotate in conjunction with the inserted sheets. The sheet folding device thus includes guide means for holding the sheet bunch at a predetermined fold position, the first and second folding rolls arranged at the fold position in pressure contact with each other, the folding blade inserting the sheet bunch supported on the guide means to the nip position on the first and second folding rolls, the roll driving means for rotationally driving the first and second folding rolls, blade driving means for moving the folding blade from a standby position to the nip position on the folding rolls, and driving control means for controlling the roll driving means and the blade driving means. The first and second folding rolls and the roll driving means are coupled together via the releasable clutch means. The driving control means is configured to control the clutch means so that when the folding blade inserts the sheet bunch to the nip position on the first and second folding rolls, the first and second folding rolls rotate in conjunction with the inserted sheets.

The driving control means is configured to control the clutch means so as to drivingly rotate the first and second folding rolls in a folding direction with the folding blade resting at the nip position after rotating the first and second folding rolls in conjunction with the sheets inserted by the folding blade.

The first and second folding rolls are in pressure contact with each other under a predetermined pressure, a coefficient of friction between the first and second folding rolls and the sheets is greater than that of friction between the sheets, and a coefficient of friction between the folding blade and the sheets is smaller than that of friction between the sheets.

The roll driving means includes a driving motor and a one-way rotation clutch transmitting a rotating force of the driving motor to the first and second folding rolls. The driving control means is configured to stop the driving motor when the folding blade is moved from the standby position to the nip position.

The roll driving means includes a roll driving motor and transmission means having one-way rotation clutch transmitting a rotating force of the roll driving motor to the first and second folding rolls. The blade driving means includes a blade driving motor and transmission means for transforming a rotating force of the blade driving motor into a reciprocating linear motion and then transmitting the reciprocating linear motion to the folding blade. The driving control means is configured to control the roll driving motor and the blade driving motor so that when the folding blade is moved from the standby position to the nip position, the roll driving motor is rotated so as to rotate the first and second folding rolls at a peripheral speed higher than a moving speed of the folding blade. Therefore, the first and second folding rolls rotate in conjunction with the sheet bunch moved by the folding blade on the basis of a difference between the moving speed of the folding blade and the peripheral speed of the folding rolls and the folding blade then comes to rest, whereas the folding rolls rotate to transfer the sheet bunch in the folding direction.

The folding rolls are offset and arranged away from the guide means so as to form a gap between the guide means and the folding rolls, and the guide means has a curved guide section supporting the sheet bunch and an outlet guide section connected to the curved guide section to guide the sheet bunch to the folding rolls. The curved guide section includes a curved guide plate supporting the sheet bunch so that the sheet bunch rolls back toward the folding roll means. The outlet guide section includes a pair of opposite guide plates inclined so as to fold the sheet bunch inserted to the nip position on the folding rolls by the folding blade.

A sheet carry-in path is connected to the guide means so that a sheet from the image forming apparatus is carried in along the sheet carry-in path. The guide plates of the guide means are configured to roll back the sheet carried into the sheet carry-in path so that a sheet surface with an image previously formed thereon is located inside.

The folding rolls are coupled to the roll driving means via the releasable clutch means. The clutch means is configured to rotate the folding rolls in conjunction with the inserted sheets when the folding blade inserts the sheet bunch to the nip position.

At least one of the paired folding rolls has shift means for reducing or releasing a pressure contact force of the folding rolls. The shift means is configured to adjustably increase or reduce the pressure contact force of the paired folding rolls in conjunction with the folding blade moving from the standby position to the nip position. Interlocking between the shift means and the folding blade means is configured so that when the folding blade means inserts the sheets between nips of the paired folding rolls, the sheets are brought into pressure contact with the folding rolls by a predetermined pressure contact force to form a fold line and so that to carry out the sheets with the fold line formed thereon from the paired folding rolls, the pressure contact force is reduced or released to carry out the sheets downstream.

At least one of the paired folding rolls includes a movable roll the position of which can be moved away from the other folding roll. The folding blade means has a cam shift means moving in conjunction with movement from the standby position to the nip position. The movable roll is configured to reduce or release the pressure contact force in conjunction with a sheet inserting operation of the folding blade using the cam shift means.

A carry-out roller is provided downstream of the paired folding rolls to carry out the folded sheets. The movable roll is borne by a bracket located so as to be swingable around a rotating shaft of the carry-out roller. The bracket is configured to be swung by the cam shift means to release or reduce the pressure contact force of the movable roll.

The sheet folding device further includes stack means for accommodating the sheet bunch from the folding rolls and carry-out guide means for guiding the sheet bunch from the folding rolls to the stack means. The stack means is located above or below the folding blade means in a sheet bunch transferring direction. The carry-out guide means constitutes a path curved upward or downward so as to guide the sheet bunch from the folding roll means to the stack means. The driving control means is configured so that when the sheet bunch folded by the folding roll means is carried out to the carry-out guide means, the first and second folding roll means, constituting the folding roll means, feed the sheets by different amounts.

The driving control means is configured to rotationally drive the folding roll located inside in a curving direction of the carry-out guide means, at a lower peripheral speed than the folding roll located outside in the curving direction.

The sheet folding device further includes a sheet guide holding the sheet bunch at the fold position, sheet end regulating means for regulating a leading end of the sheets supported on the sheet guide, the folding roll means located at the fold position, and the folding blade means for inserting the sheet bunch supported on the sheet guide, to the folding roll means. The sheet end regulating means includes grip means for gripping a first edge of the sheets supported on the sheet guide and shift means for moving a position of the grip means along the sheet guide.

The sheet guide has pressurizing means for urging a second edge of the sheets with the first edge gripped by the grip means. The pressurizing means is configured to impose a load on the second edge of the sheets which balances with a load imposed on the first edge of the sheets by the grip means when the folding blade means inserts the sheets into the folding roll means.

To accomplish the above-described objects, the present invention provides a post-processing apparatus setting sheets carried out from an image forming apparatus and executing post-processing on the sheets. The post-processing apparatus includes sheet collecting means for setting the sequentially fed sheets into a bunch, a predetermined fold position set on or downstream of the sheet collecting means, and a sheet folding device located at the fold position to fold the sheet bunch collected by the sheet collecting means, the sheet folding device including guide means for holding the sheet bunch at the predetermined fold position, a first folding roll and a second folding roll arranged at the fold position in pressure contact with each other, a folding blade inserting the sheet bunch supported on the guide means to a nip position on the first and second folding rolls, roll driving means for rotationally driving the first ands second folding rolls, blade driving means for moving the folding blade from a standby position to the nip position on the folding rolls, and driving control means for controlling the roll driving means and the blade driving means. The first and second folding rolls and the roll driving means are coupled together via releasable clutch means, the driving control means being configured to control the clutch means so that when the folding blade inserts the sheet bunch to the nip position on the first and second folding rolls, the first and second folding rolls rotate in conjunction with the inserted sheets.

Further, staple means for stapling the sheet bunch before the sheet bunch reaches the fold position is located on or downstream of the sheet collecting means.

The post-processing apparatus further includes a sheet carry-in path along which a sheet from a carry-in port is conveyed downstream, a switchback conveying path branching off from the sheet carry-in path and along which the sheet is conveyed to the sheet collecting means, second sheet collecting means located at a position different from that of the sheet collecting means, for setting sequentially fed sheets into a bunch, saddle switching staple means located on or downstream of the sheet collecting means, for stapling the sheet bunch at a center thereof before the sheet bunch reaches the fold position, and end surface staple means for stapling the sheet bunch collected on the second sheet collecting means, at an edge thereof.

Moreover, to accomplish the above-described objects, the present invention provides an image forming system including an image forming apparatus sequentially forming images on sheets and a post-processing apparatus executing post-processing such as a stapling process, a stamping process, and a punching process on the sheets from the image forming apparatus. The post-processing apparatus includes a sheet carry-in path along which a sheet from a carry-in port is conveyed downstream, a switchback conveying path branching off from the sheet carry-in path and along which the sheet is switched back and conveyed, sheet collecting means for setting sheets sequentially fed along the switchback conveying path, into a bunch, a predetermined fold position set on or downstream of the sheet collecting means, and a sheet folding device located at the fold position to fold the sheet bunch collected by the sheet collecting means. The sheet folding device including guide means for holding the sheet bunch at the predetermined fold position, a first folding roll and a second folding roll arranged at the fold position in pressure contact with each other, a folding blade inserting the sheet bunch supported on the guide means to a nip position on the first and second folding rolls, roll driving means for rotationally driving the first and second folding rolls, blade driving means for moving the folding blade from a standby position to the nip position on the folding rolls, and driving control means for controlling the roll driving means and the blade driving means, the first and second folding rolls and the roll driving means being coupled together via releasable clutch means, the driving control means being configured to control the clutch means so that when the folding blade inserts the sheet bunch to the nip position on the first and second folding rolls, the first and second folding rolls rotate in conjunction with the inserted sheets.

BRIEF DESCRIPTION OF THE DRAWINGS

FIG. 6(*b*) is a plan view of the folding roll means as viewed in a sheet width direction;

FIG. 6(*c*) is a diagram in section explaining the sheet folding device of FIG. 4;

FIG. 7(*b*) is a diagram illustrating a driving mechanism for a folding blade;

FIG. 7(*c*) is a diagram illustrating the structure of a one-way clutch;

FIG. 7(*d*) is a diagram illustrating the driving mechanism for the folding blade;

FIG. 8(*b*) is a diagram showing an initial state of the sheet bunch folding operation, to describe the sheet bunch folding operation of the apparatus in FIG. 2;

FIG. 8(*c*) is a diagram showing a state in which the sheet bunch is inserted to a nip position, to describe the sheet bunch folding operation of the apparatus in FIG. 2;

FIG. 8(*d*) is a diagram showing a carry-out state in which the sheet bunch is folded by the folding roll means, to describe the sheet bunch folding operation of the apparatus in FIG. 2;

FIG. 10(*b*) is a diagram showing an initial state of the sheet bunch folding operation, to describe the sheet bunch folding operation of the apparatus in FIG. 2;

FIG. 10(*c*) is a diagram showing a state in which the sheet bunch is inserted to the nip position, to describe the sheet bunch folding operation of the apparatus in FIG. 2;

FIG. 10(*d*) is a diagram showing a carry-out state in which the sheet bunch is folded by the folding roll means, to describe the sheet bunch folding operation of the apparatus in FIG. 2;

FIG. 10(*e*) is a diagram showing a state in which after the sheet bunch folding operation is completed, the folding blade retracts, to describe the sheet bunch folding operation of the apparatus in FIG. 2;

FIG. 11(*b*) is a diagram showing that a trailing end of the sheet bunch is being carried out, to describe the operational state in which in the apparatus in FIG. 2, and the sheet bunch is being carried out from the folding rolls to the carry-out guide;

FIG. 11(*c*) is a diagram explaining the operating state of the sheet bunch transferring from the folding rolls to the carry-out guide in FIG. 2 in a state that a rear end of the sheet bunch is being transferred;

FIG. 12(*b*) is a diagram showing an initial state of the folding operation;

FIG. 12(*c*) is a diagram showing that folded sheets are being discharged;

FIG. 14(*b*) is diagram illustrating an operating state of the sheet leading end regulating means in the device in FIG. 4 and showing that the succeeding sheet reaches the collecting guide;

FIG. 14(*c*) is diagram illustrating an operating state of the sheet leading end regulating means in the device in FIG. 4 and showing that the sheet bunch collected on the collecting guide is placed at a staple position;

FIG. 14(*d*) is diagram illustrating an operating state of the sheet leading end regulating means in the device in FIG. 4 and showing that the sheet bunch collected on the collecting guide is placed at the fold position;

FIG. 15(*b*) is a diagram illustrating the configuration of the sheet carry-in guide and pressurizing means in the apparatus in FIG. 2 and showing a sheet carry-in state;

FIG. 16(*b*) is a diagram illustrating the configuration of the sheet carry-in guide and pressurizing means in FIG. 2, showing a sheet carrying-in condition;

FIG. 18(*b*) is a diagram illustrating the sheet post-processing operation performed by the apparatus in FIG. 2 and showing that the sheets are being carried into the collecting guide;

FIG. 18(*c*) is a diagram illustrating the sheet post-processing operation performed by the apparatus in FIG. 2 and showing that the sheets have been collected on the collecting guide;

FIG. 18(*d*) is a diagram illustrating the sheet post-processing operation performed by the apparatus in FIG. 2 and showing that the sheet bunch is being moved to and set at the staple position;

FIG. 18(*e*) is a diagram illustrating the sheet post-processing operation performed by the apparatus in FIG. 2 and showing a stapling operation of stapling the sheet bunch;

FIG. 18(*f*) is a diagram illustrating the sheet post-processing operation performed by the apparatus in FIG. 2 and showing that the stapled sheet bunch is being moved to the fold position;

FIG. 18(*g*) is a diagram illustrating the sheet post-processing operation performed by the apparatus in FIG. 2 and showing an initial state of a folding process; and FIG. 18(*h*) is a diagram illustrating the sheet post-processing operation performed by the apparatus in FIG. 2 and showing that the sheet bunch is leaving the pressurizing means.

DETAILED DESCRIPTION OF PREFERRED EMBODIMENT

Figure 1:
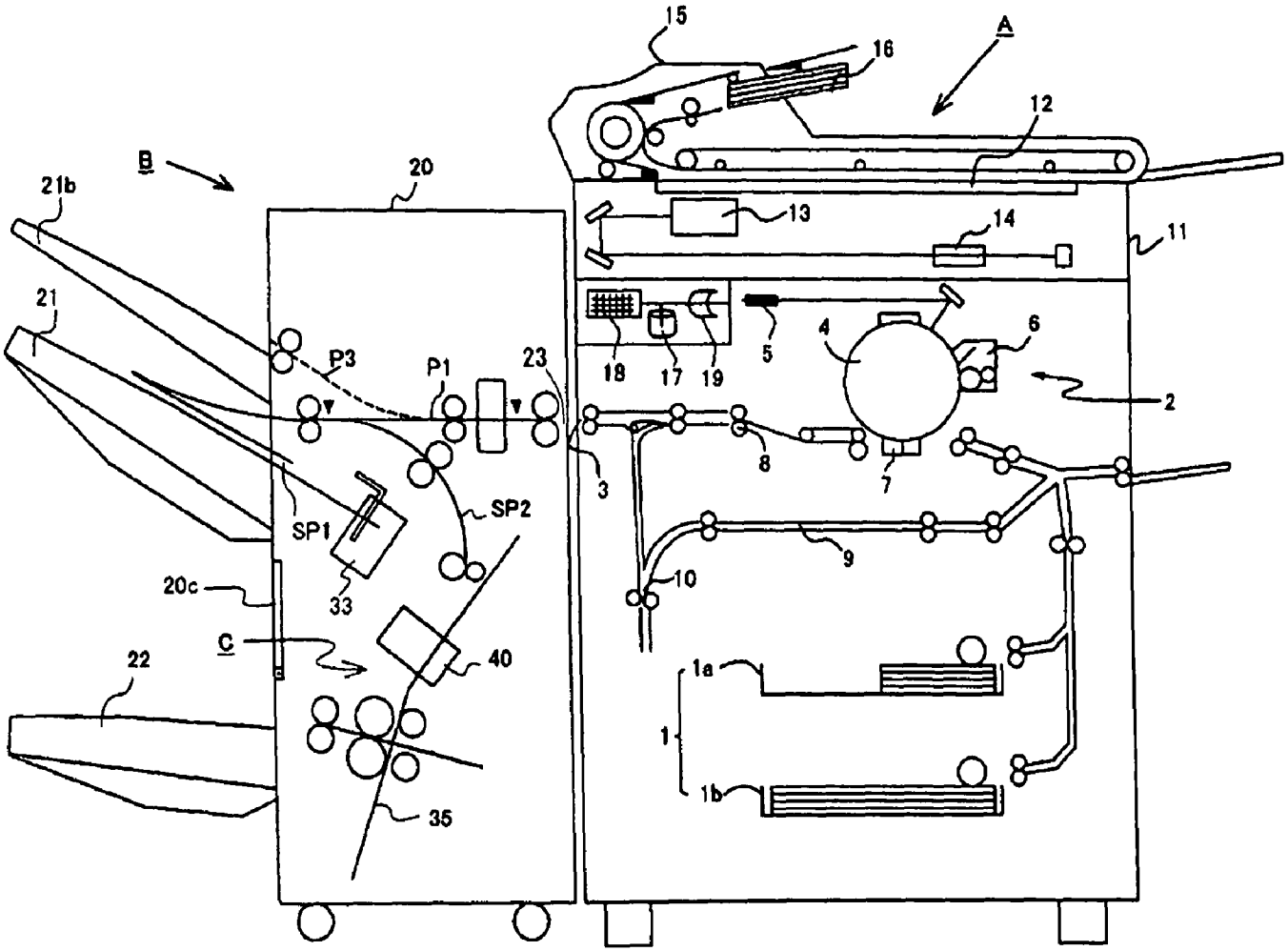
FIG. 1 is a diagram generally illustrating an image forming system according to the present invention.
Figure 2:
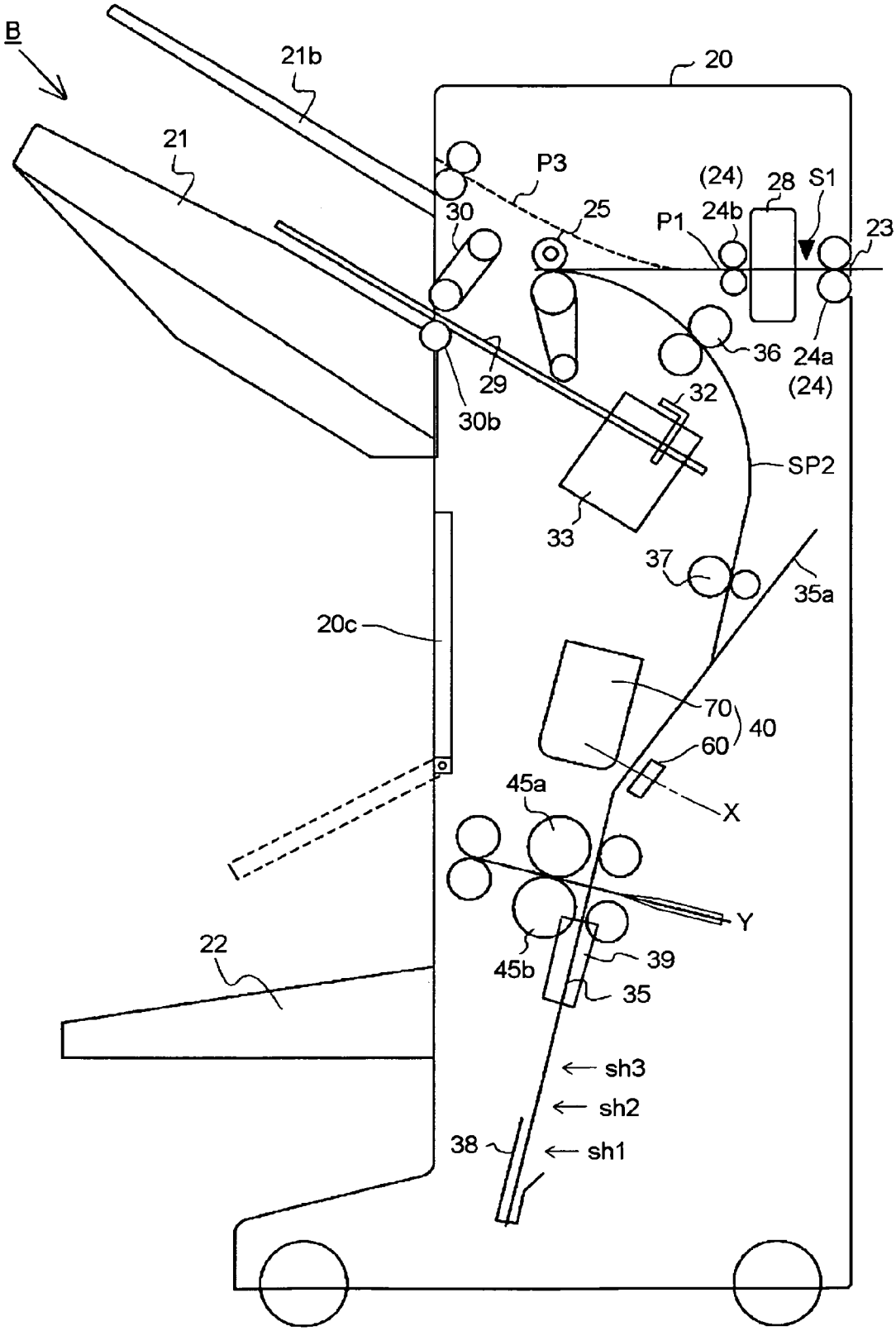
FIG. 2 is a diagram generally illustrating a post-processing apparatus comprising a sheet folding device according to the present invention.
Figure 3:
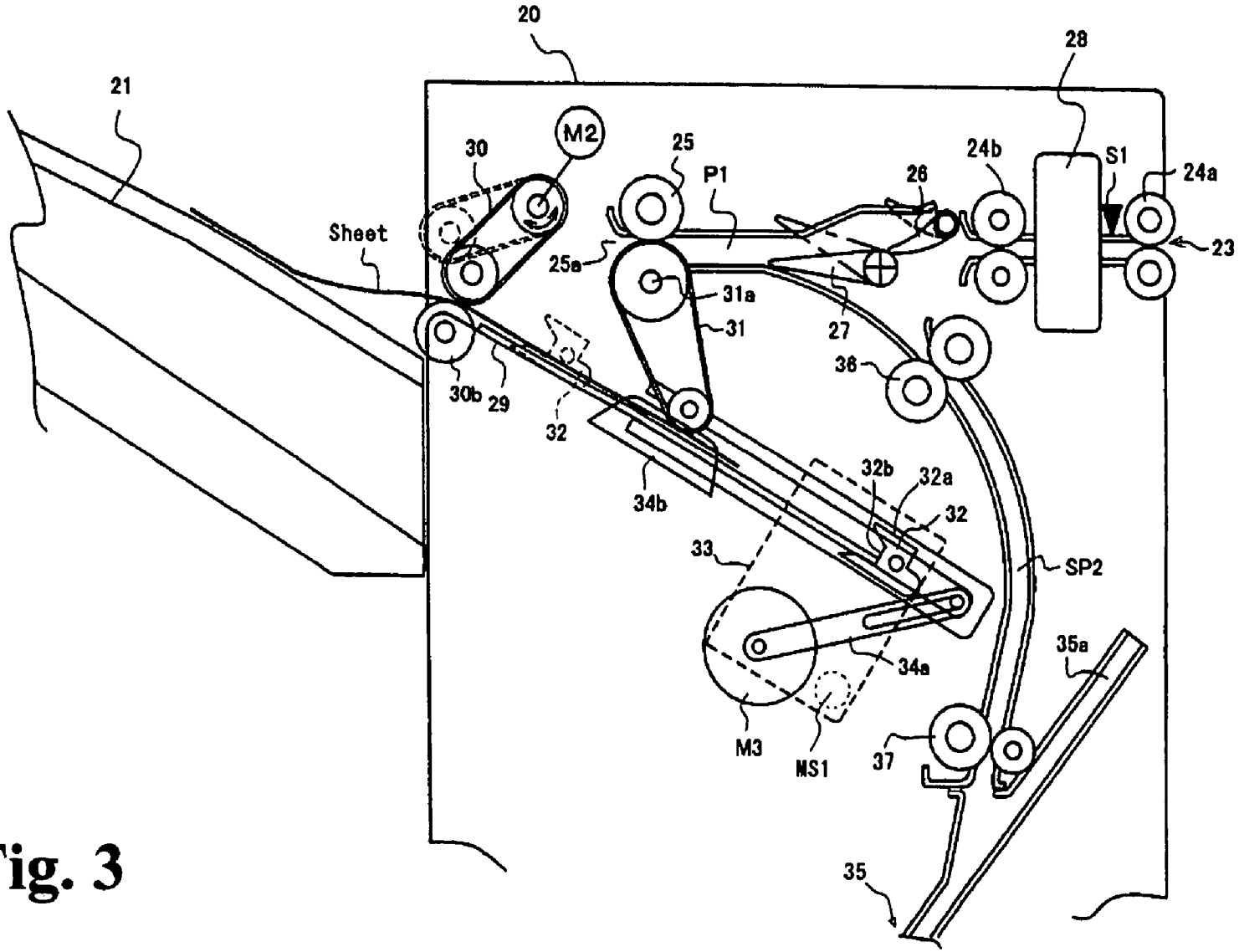
FIG. 3 is a detailed diagram showing a part of the post-processing apparatus in FIG. 2.

The present invention will be described below in detail on the basis of an illustrated preferred embodiment. FIG. 1 shows the general configuration of an image forming system according to the present invention. FIG. 2 is a diagram illustrating the general configuration of a post-processing apparatus. FIG. 3 is a diagram illustrating the detailed configuration of a sheet folding device. The image forming system shown in FIG. 1 is composed of an image forming apparatus A and a post-processing apparatus B. A sheet folding device C is incorporated into the post-processing apparatus B as a unit.

In the image forming apparatus A, shown in FIG. 1, a sheet feeding section 1 feeds a sheet to an image forming section 2. The image forming section 2 prints the sheet, which is then carried out through a body sheet discharging port 3. The sheet feeding section 1 has sheets of plural sizes housed in sheet feeding cassettes 1*a* and 1*b* and separately feeds specified sheets one by one to the image forming section 2.

The image forming section 2 has, for example, an electrostatic drum 4, as well as a print head (laser light emitter) 5, a developing unit 6, a transfer charger 7, and a fixer 8 which are arranged around the periphery of the static drum 4. The laser light emitter 5 forms an electrostatic latent image on the electrostatic drum 4, and the developing unit 6 sticks toner to the latent image. The transfer charger 7 transfers the image to the sheet, and the fixer 8 heats and fixes the image to the sheet. Sheets with images thus formed thereon are sequentially carried out through the body sheet discharging port 3. A circulating path 9 for double side printing along which a sheet from the fixer 8 having an image formed on a front surface thereof is turned upside down via a body switchback path 10 and then fed to the image forming section 2 again, which prints a back surface of the sheet. The sheet with images printed on the opposite surfaces thereof is turned upside down on the body switchback path 10 and carried out through the body sheet discharging port 3.

An image reading device 11 has a scan unit 13 that scans a document sheet set on a platen 12 and a photoelectric converting element (not shown) that electrically reads an image from the sheet. The image data is subjected to a digital process by the image processing section. The resultant image data is transferred to a data storage section 14 and sends an image signal to the laser light emitter 5. A document feeding device 15 is a feeder device that feeds document sheets accommodated in a stacker 16 to the platen 12.

Figure 9:
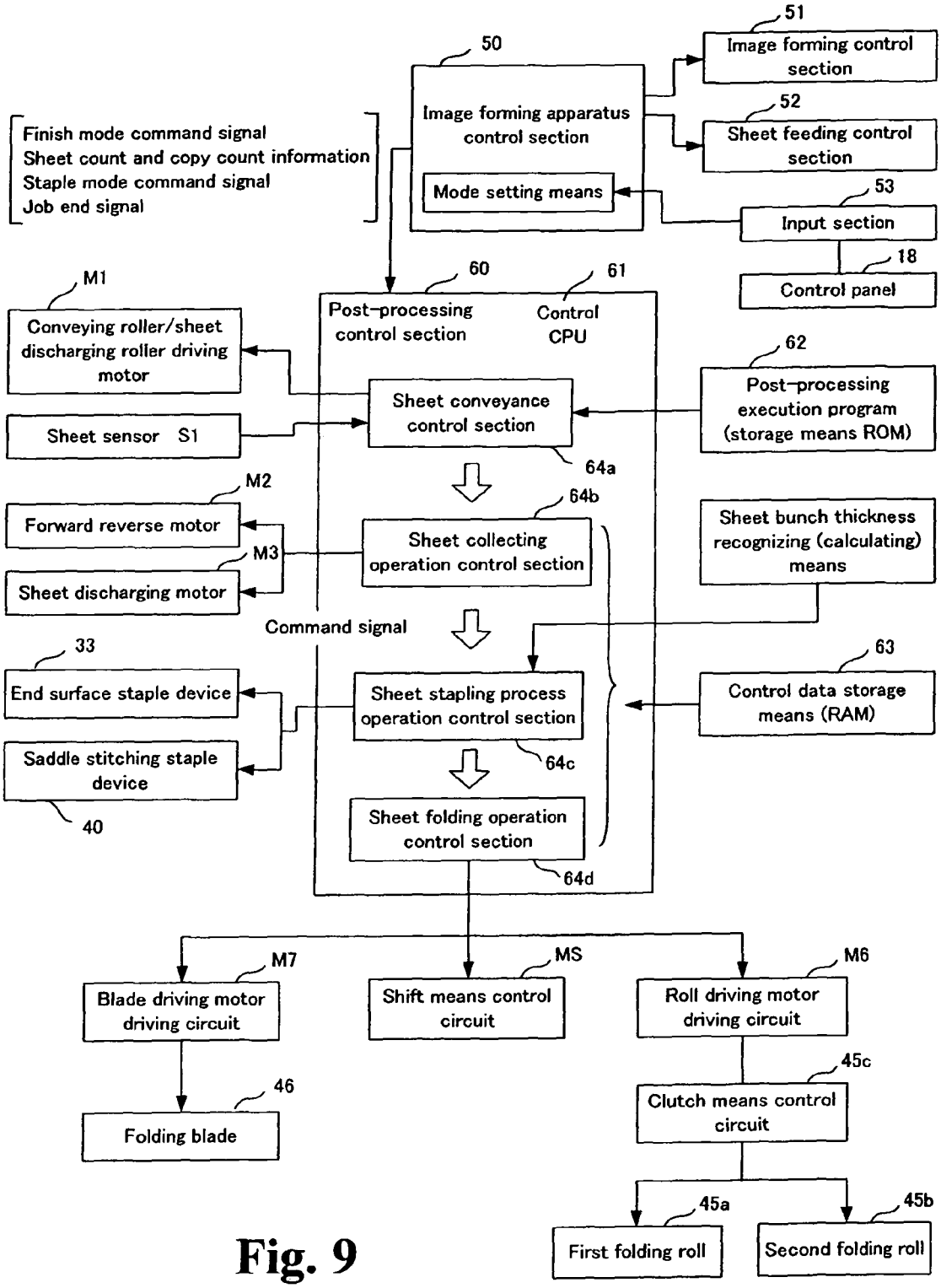
FIG. 9 is a diagram illustrating a control arrangement in the system in FIG. 1.
Figure 10A:
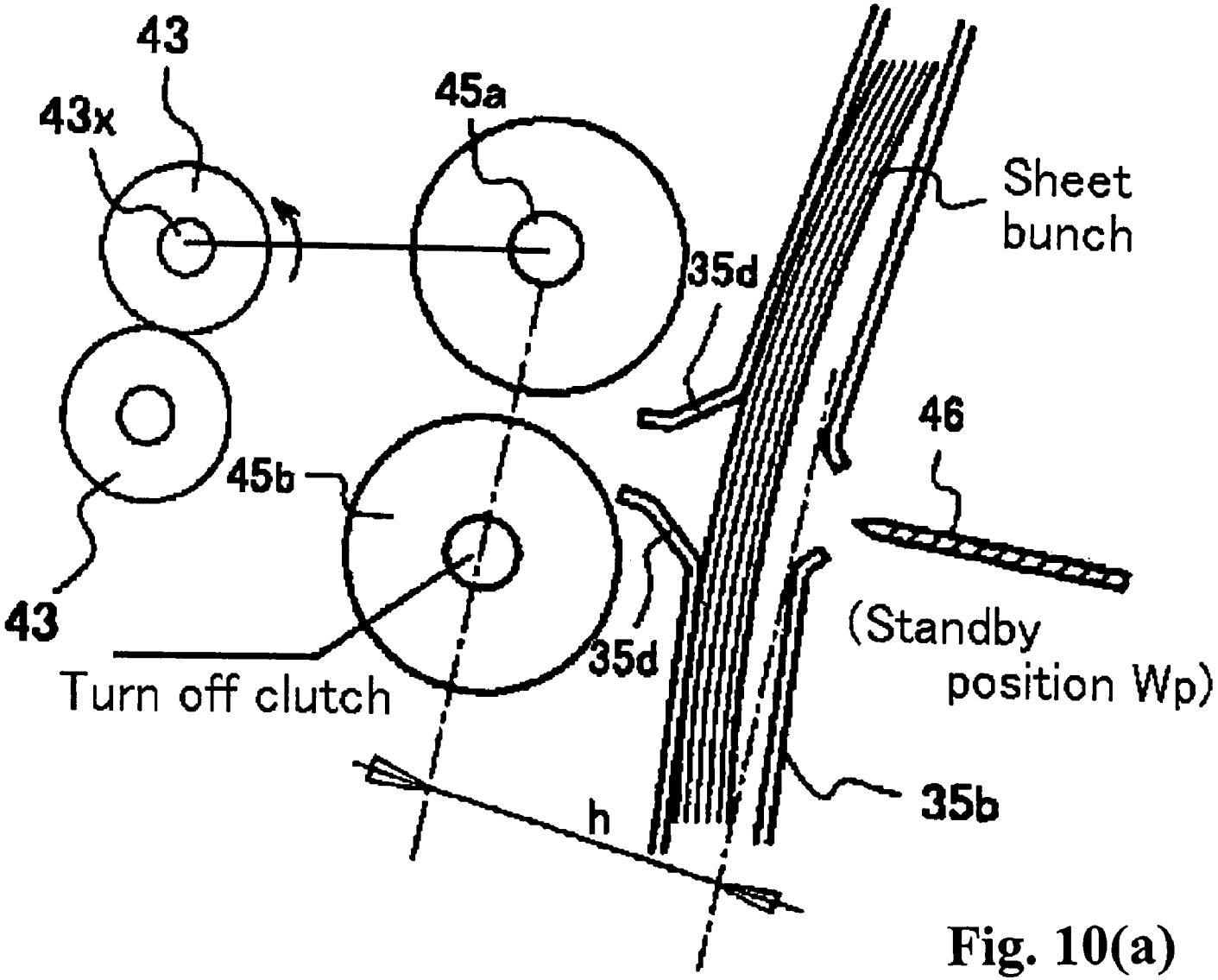
FIG. 10(*a*) is a diagram showing a state in which the sheet bunch is placed and set at the fold position, to describe the sheet bunch folding operation of the apparatus in FIG. 2.
Figure 10B:
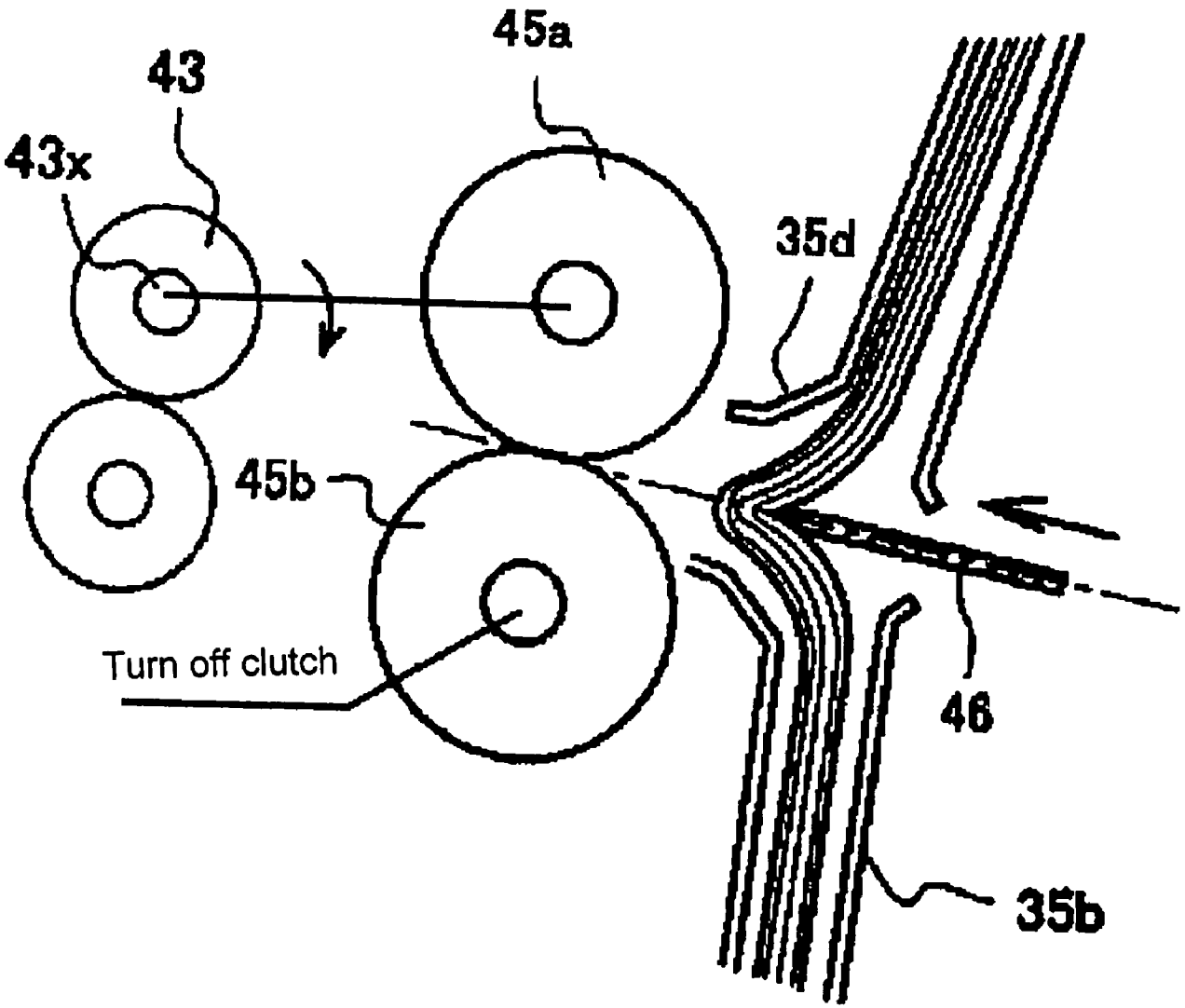
Figure 10C:
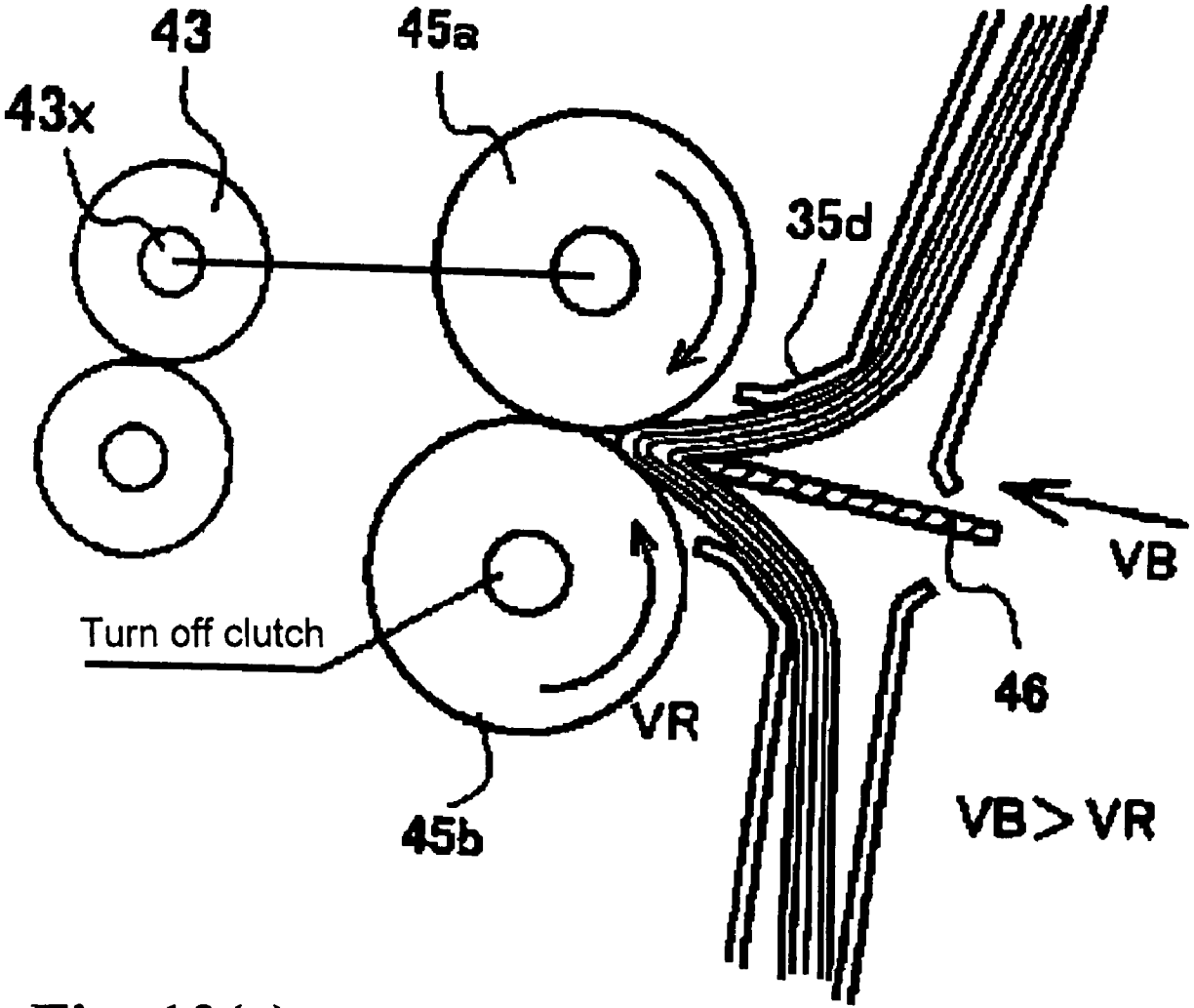
Figure 10D:
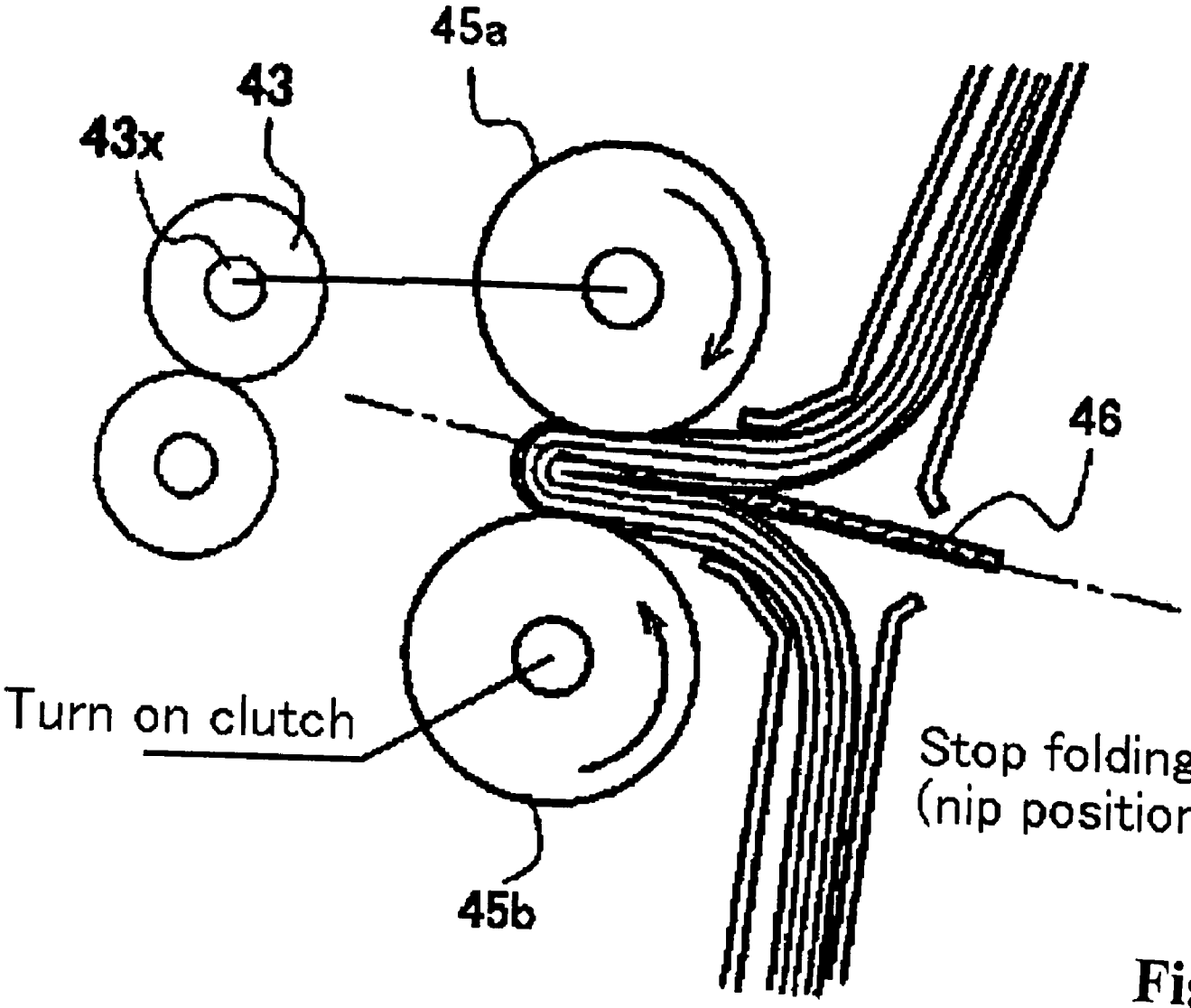
Figure 10E:
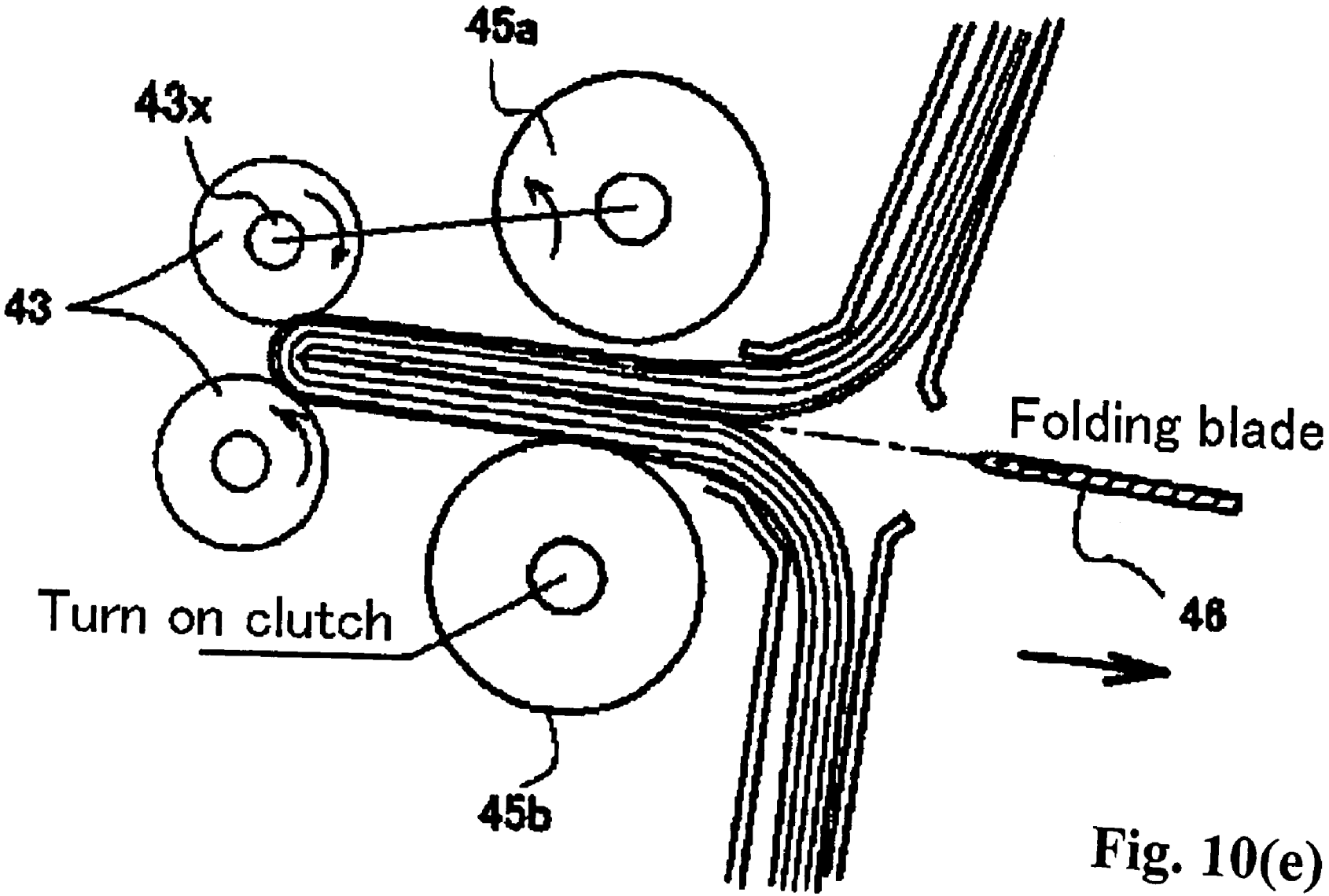

The image forming apparatus A configured as described above has a control section (controller) shown in FIG. 9. Image formation conditions are set via a control panel 18, for example, printout conditions such as a sheet size specification, a color or black-and-white printing specification, a print copy count specification, single- or double-side printing specification, and enlarged or reduced printing specification. On the other hand, in the image forming apparatus A, image data read by the scan unit 13 or transferred through an external network is stored in a data storage section 17. The image data from the data storage section is transferred to a buffer memory 19, which sequentially transfers data signals to the laser light emitter 5.

Simultaneously with the image formation conditions, post-processing conditions are input and specified via the control panel 18. For example, a "printout mode", a "stapling mode", and a "sheet bunch folding mode" are specified as the post-processing conditions. The image forming apparatus A forms an image on the sheet in accordance with the image formation conditions and the post-processing conditions. This image forming aspect will be described with reference to FIG. 5. When the "single-side printing" is set as an image formation condition and the "printout mode" or the "stapling mode" is set as a post-processing condition, the image forming section 2 forms a predetermined on a specified sheet. The sheet is turned upside down on the body switchback path 10 and then carried out through the body sheet discharging port 3.

Thus, the image forming apparatus A sequentially forms images on a series of sheets from the first to nth pages. The post-processing apparatus B receives the sheets carried out in a face down posture, starting with the first page. In the "printout mode", the sheets are sequentially loaded and housed on a first sheet discharging tray 21 located in the post-processing apparatus B. In the "stapling mode", the sheets are loaded and housed on a first collecting section (first sheet collecting means; this also applies to the description below) located in the post-processing apparatus B. The sheets collected on the tray are stapled by end surface staple means 33 in response to a job end signal and then housed in the first sheet discharging tray 21.

Figure 5:
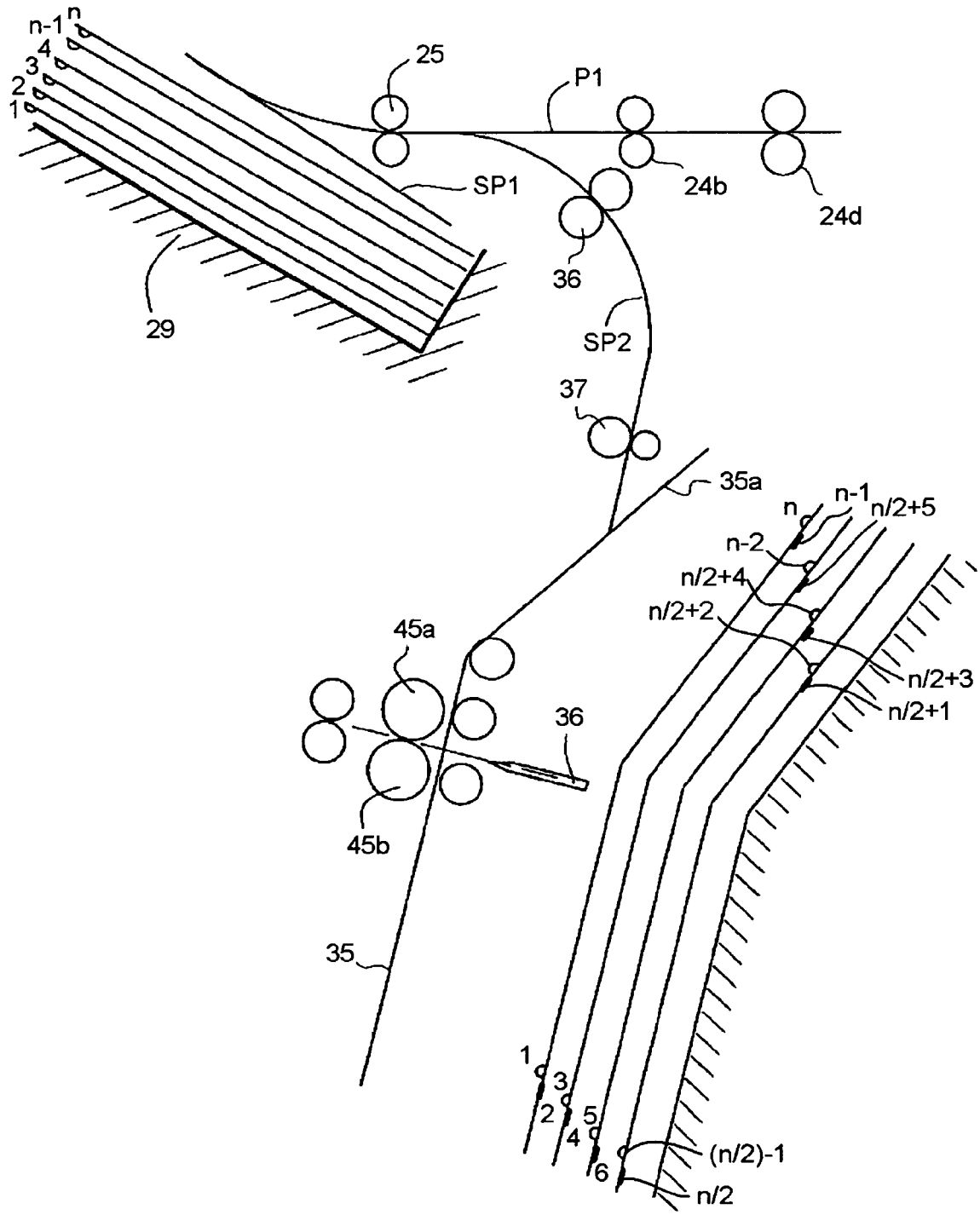
FIG. 5 is a diagram showing the order of image formation by the apparatus in FIG. 1.

When the double-side printing and 2in1 printing are specified as image formation conditions and the "sheet folding mode" is set for post-processing, if the final page is the nth page, the image forming apparatus A forms an image for the $(n/2)^{th}$ page and an image for the $(n/2+1)^{th}$ page on a front surface of the first sheet and forms an image for the $(n/2-1)^{th}$ page and an image for the $(n/2+2)^{th}$ page on a back surface of the sheet, as shown in FIG. 5. The image forming apparatus A then carries out the sheet through the sheet discharging port 3. Then, the post-processing apparatus B houses the sheet on a second collecting section (second sheet collecting means; this also applies to the description below) 35 via a sheet carry-in path P1. Then, the image forming apparatus A forms an image for the $(n/2-2)^{th}$ page and an image for the $(n/2+3)^{th}$ page on a front surface of the next sheet and forms an image for the $(n/2-3)^{th}$ page and an image for the $(n/2+4)^{th}$ page on a back surface of the sheet. The image forming apparatus A then carries out the sheet through the sheet discharging port 3. The post-processing apparatus B then stacks the sheet on the first sheet for collection. Thus, the image forming apparatus A forms images in the order suitable for the structure of the collecting tray. For the page order, when image data is transferred from the data storage section 17 to the buffer memory 19, a printing order is calculated and used to control the print head (laser light emitter) 5.

The post-processing apparatus B, coupled to the image forming apparatus A, described above, receives the sheet with an image formed thereon from the body sheet discharging port 3 in the image forming apparatus A, through a carry-in port 23. The post-processing apparatus B then accommodates the sheet on the first sheet discharging tray 21 (the above-described "printout mode"), and sets the sheets from the body sheet discharging port 3 into a bunch and staples and houses the sheets on the first sheet discharging tray 21 (the above-described "stapling mode"), or sets the sheets from the body sheet discharging port 3 into a bunch, folds the sheet bunch into a booklet, and houses the sheet bunch on a second sheet discharging tray 22 (the above-described "sheet bunch folding mode").

Thus, as shown in FIG. 2, the post-processing apparatus B has a casing 20 comprising the first sheet discharging tray 21 and the second sheet discharging tray 22, and the sheet carry-in path P1 having the carry-in port 23, connected to the body sheet discharging port 3. The sheet carry-in path P1 is composed of a linear path formed in the casing 20 so as to extend in a substantially horizontal direction. Thus, a first switchback conveying path SP1 and a second switchback conveying path SP2 branch off from the sheet carry-in path P1 so that sheets are transferred in a reverse direction along the first switchback conveying path SP1 and the second switchback conveying path SP2. The first switchback conveying path SP1 and the second switchback conveying path SP2 branch off from the sheet carry-in path P1 so that the first switchback conveying path SP1 is located downstream, whereas the second switchback conveying path SP2 is located upstream. The two conveying paths are located away from and opposite to each other.

As shown in FIG. 2, the outer cover (casing) 20 has an opening and closing cover 20*c* shown in FIG. 21 and forming an opening for maintenance of saddle stitching staple means 40 described below. The end surface staple means 33 is located on a first collecting section 29, and the saddle stitching staple means 40 is located on the collecting guide 35. In the staple means, the end surface staple means 33 is located above and the saddle stitching staple means 40 is located below, relative to each other, so that the staple means 33 and 40 are positioned adjacent to each other in a vertical direction as shown in the figure.

As described above, the opening and closing cover is located at the intermediate position between the first sheet discharging tray 21 and the second sheet discharging tray 22, which are arranged in the vertical direction, so that the saddle stitching staple means 40, stapling the sheet traveling to the lower second sheet discharging tray 22, can be maintained through the opening and closing cover. This allows the saddle stitching staple means 40 to be easily maintained through the opening and closing cover 20*c*. In this case, a work area is provided by removing the sheets loaded on the lower second sheet discharging tray 22. Thus, the relevant structure is simple and a maintenance operation can be easily performed.

Furthermore, the upper one of the two vertically arranged sheet discharging trays, the first sheet discharging tray 21, is configured to be able to elevate and lower in the vertical direction, and the opening and closing cover is located within an elevating and lowering trajectory of the first stack tray so that the saddle stitching staple means 40 for the sheet traveling to the second sheet discharging tray 22 can be maintained through the opening and closing tray. Thus, during the maintenance operation, the work area can be provided by moving the first stack tray above or below the opening and closing cover. The maintenance operation can then be safely and easily performed. This allows a small-sized, compact apparatus to be constructed.

The opening and closing cover 20*c* can be easily opened and closed by using a "needle empty" signal or an "inappropriate operation" signal from the saddle stitching staple means 40 to retract the first sheet discharging tray 21 above or below the opening and closing cover 20*c*.

In this path configuration, a carry-in roller 24 having carry-in rollers 24*a* and 24*b* and a sheet discharging roller 25 are arranged on the sheet carry-in path P1. The rollers are coupled to a forward reversible drive motor M1 (not shown). The sheet carry-in path P1 has a path switching piece 27 (as shown in FIG. 3) located on the switchback conveying path SP2 to guide sheets and coupled to actuating means such as a solenoid. The sheet carry-in path P1 also has a post-processing unit 28 which is located between the carry-in roller 24*a* succeeding the carry-in port 23 and the carry-in roller 24*b* lying behind the post-processing unit 28 to execute post-processing by using a sheet sensor S1 to detect the trailing end of a sheet from the carry-in port 23. The post-processing unit 28 is, for example, stamp means for executing a stamping process using a detection signal from the sheet sensor S1 or a punch means for executing a punching process using the detection signal from the sheet sensor S1. The illustrated post-processing unit 28 is located at the carry-in port 23 upstream of the paired front and back carry-in rollers 24*a* and 24*b* so as to be able to be removed from and installed back in the casing 20 depending on the apparatus specifications.

The sheet carry-in path P1 has a sheet locking member (buffer guide) 26 (as shown in FIG. 3) located upstream of a branching path (at the position of the path switching piece 27) from the second switchback conveying path SP2 to temporarily hold the sheet traveling to the second switchback conveying path SP2, shown in detail in FIG. 10 described below. The configuration and operation of the sheet locking member 26 will be described below.

The first switchback conveying path SP1, located downstream of the sheet carry-in path P1 (closer to a trailing end of the apparatus) as described above, is configured as follows. As shown in FIG. 3, the sheet carry-in path P1 has the sheet discharging roller 25 and a sheet discharging port 25*a* at an outlet end thereof, as well as the first collecting section 29 located below the sheet discharging port 25*a* via a step. The first collecting section 29 is composed of a tray (hereinafter referred to as the "collecting tray 29") on which sheets from the sheet discharging port 25*a* are loaded and supported. A forward reverse roller 30 is located above the collecting tray 29 so as to be able to elevate and lower between a position where the forward reverse roller 30 comes into contact with the sheets on the roller and a standby position (shown by a dotted line in FIG. 3) where the forward reverse roller 30 is separated from the sheets. A forward reverse motor M2 is coupled to the forward reverse roller 30 and controlled so as to rotate clockwise in the figure when the sheet reaches the collecting tray 29 and to rotate counterclockwise after the trailing end of the sheet reaches the tray. Accordingly, the first switchback conveying path SP1 is constructed on the collecting tray 29. A caterpillar belt 31 is supported by shafts so as to be able to roll freely so that a one end pulley side of the caterpillar belt 31 is in pressure contact with the sheet discharging roller 25, while a leading end pulley side of the caterpillar belt 31, hanging from a pulley shaft 31*a*, reaches the collecting tray 29. A driven roller 30*b* engages the forward reverse roller 30 and is provided on the collecting tray 29.

Further, the first sheet discharging tray 21 is located downstream of the switchback conveying path SP1 to support the leading end of sheets guided to the first switchback conveying path SP1 and the second switchback conveying path SP2.

With the above-described configuration, the sheet from the sheet discharging port 25*a* reaches the collecting tray 29 and is transferred toward the first sheet discharging tray 21 by the forward reverse roller 30. Once the trailing end of the sheet from the sheet discharging port 25*a* reaches the collecting tray 29, the forward reverse roller 30 is reversely rotated (counterclockwise in the figure) to transfer the sheet on the collecting tray 29 in a direction opposite to a sheet discharging direction. At this time, the caterpillar belt 31 cooperates with the forward reverse roller 30 in switching back and transferring the trailing end of the sheet along the collecting tray 29.

A trailing end regulating member 32 and the end surface staple means 33 is located at a trailing end of the collecting tray 29. The trailing end regulating member 32 regulates the position of the sheet trailing end. The illustrated staple means 33 is composed of an end surface stapler and staples the sheet bunch collected on the tray at one or more positions. The trailing end regulating member 32 is also used to provide a function of carrying out the stapled sheet bunch to the first sheet discharging tray 21, located downstream of the collecting tray 29. The trailing end regulating member 32 is configured to be able to reciprocate in the sheet discharging direction along the collecting tray 29. A carry-out mechanism of the illustrated trailing end regulating member 32 comprises a grip pawl 32*a* that grips the sheet bunch and a trailing end regulating surface 32*b* against which the sheet trailing end abuts for regulation. The carry-out mechanism is configured to be movable in the lateral direction of the figure along a guide rail provided on an apparatus frame. A driving arm 34*a* reciprocating the trailing end regulating member 32 and coupled to a sheet discharging motor M3 is provided.

The collecting tray 29 has a side aligning plate 34*b* with which the sheets collected on the tray align in the width direction. The side aligning plate 34*b* is composed of a lateral (the front to back of the device in FIG. 3) pair of aligning plates configured to approach and leave the sheet center. The side aligning plate 34*b* is coupled to an aligning motor.

In the "stapling mode", along the first switchback conveying path SP1 configured as described above, the sheets from the sheet discharging port 25*a* are set on the collecting tray 29. The sheet bunch is then stapled at one or more positions at the trailing edge thereof by the end surface staple means 33. In the "printout mode", a sheet from the sheet discharging port 25*a*, the sheet fed along the collecting tray 29 is passed between the forward reverse roller 30 and the driven roller 30*b* and carried out to the first sheet discharging tray 21. Thus, the illustrated apparatus is characterized in that the sheet to be stapled is bridged between the collecting tray 29 and the first sheet discharging tray 21 to allow the apparatus to be compactly configured.

Figure 4:
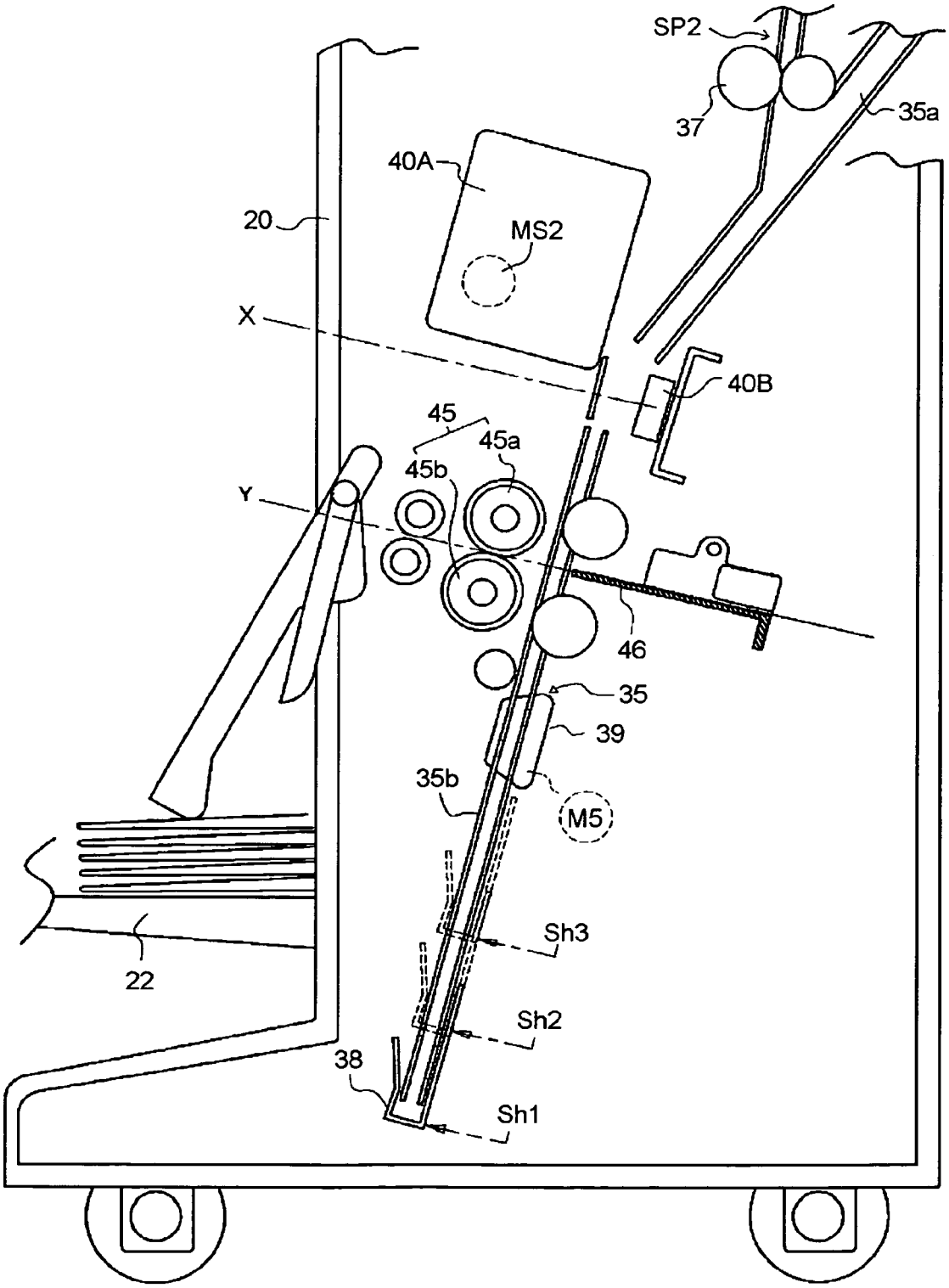
FIG. 4 is a detailed diagram of the sheet folding device incorporated into the post-processing apparatus in FIG. 2.

Now, description will be given of the configuration of the second switchback conveying path SP2, branching off from the sheet carry-in path P1, as shown in FIGS. 3 and 4. As shown in FIGS. 3 and 4, the second switchback conveying path SP2 is located in a substantially vertical direction with respect to the apparatus casing 20. A conveying roller 36 is located at an inlet of the second switchback conveying path SP2. A conveying roller 37 is located at an outlet of the second switchback conveying path SP2. The second collecting section 35, which sets the sheets fed along the conveying path SP2, is provided downstream of the second switchback conveying path SP2. As shown in FIG. 4, the second collecting section 35 is composed of a conveying guide (collecting guide) that transfers the sheets (the second collecting section 35 is hereinafter referred to as the "collecting guide 35"). The saddle stitching staple means 40 (40*a* and 40*b*) and folding roll means 45 are arranged on the collecting guide 35. The configuration of these components will be sequentially described below.

As shown in FIG. 3, the conveying roller 36, located at the inlet of the second switchback conveying path SP2, is configured to be rotatable forward and backward, respectively. A sheet carried into the first switchback conveying path SP1, located downstream, is temporarily held (temporarily reside) on the second switchback conveying path SP2. The reason for the temporary holding is as follows. The preceding sheets are collected on the collecting tray 29 and are then stapled in response to the job end signal. The sheet fed to the sheet carry-in path P1 while the sheet bunch is being carried out to the first sheet discharging tray 21 is temporarily held on the second switchback conveying path SP2. Then, after the processing of the preceding sheets is finished, the standing-by sheet is conveyed from the first switchback conveying path SP1 onto the collecting tray 29. The effects of this operation will be described below.

As shown in FIG. 4, the collecting guide 35 is formed of a guide member that guides the sheet being conveyed. The collecting guide 35 is configured so that the sheets are loaded and housed thereon. The illustrated collecting guide 35 is connected to the second switchback conveying path SP2 and located in a central part of the apparatus casing 20 in the substantially vertical direction. This allows the apparatus to be compactly configured. The collecting guide 35 is shaped to have an appropriate size to house maximum sized sheets. In particular, the illustrated collecting guide 35 is curved or bent so as to project toward the area in which the saddle stitching staple means 40 and folding roll means 45, described below, are arranged.

A switchback approaching path 35*a* is connected to a conveying direction trailing end of the collecting guide 35. The switchback approaching path 35*a* overlaps the outlet end of the second switchback conveying path SP2. This is to allow the trailing end of the carried-in (succeeding) sheet fed from the conveying roller 37 on the second switchback conveying path SP2 to overlap the trailing end of the loaded (preceding) sheets supported on the collecting guide 35 to ensure the page order of the collected sheets. A leading end regulating member 38 regulating the sheet leading end is located downstream of the collecting guide 35. The leading end regulating member 38 is supported by a guide rail so as to be movable along the collecting guide 35. The leading end regulating member 38 is moved between positions Sh1 and Sh2 and Sh3, shown in the figure, by shift means MS.

When the leading end regulating member 38 is placed at the illustrated position Sh3, the trailing end of the sheet (sheet bunch) supported on the collecting guide 35 enters the switchback approaching path 35*a*. In this condition, the succeeding sheet fed through the second switchback conveying path SP2 is reliably stacked on the collected sheets. When the leading end regulating member 38 is placed at the illustrated position Sh2, the center of the sheets (sheet bunch) supported on the collecting guide 35 is placed at a staple position X on the saddle stitching staple means 40, described below. Likewise, when the leading end regulating member 38 is placed at the illustrated position Sh1, the sheet bunch is stapled and the center of the sheet bunch supported on the collecting guide 35 is placed at a fold position Y on the folding roll means 45. Thus, the illustrated positions Sh1, Sh2, and Sh3 are set at the optimum positions depending on the sheet size (conveying-direction length).

A sheet side edge aligning member 39 is located on a downstream side of the collecting guide 35 in the sheet conveying direction. The sheet side edge aligning member 39 aligns, with a reference, the width-direction position of the sheets carried into the collecting guide 35 and supported on the leading end regulated member 38. That is, with the leading end regulating member 38 placed at the position Sh3 and the whole sheets supported on the collecting guide 35, side edges of the sheets are aligned with the sheet side edge aligning member 39. Since the illustrated apparatus aligns the sheets using the sheet center as a reference, the sheet side edge aligning member 39 is composed of a lateral pair of aligning plates, the aligning plates are arranged at an equal distance from the sheet center as a reference to align the sheet bunch supported on the collecting guide 35. Thus, an aligning motor M5 is coupled to the sheet side edge aligning member 39.

The staple position X and the fold position Y are set on an upstream side and a downstream side, respectively, along the collecting guide 35. The saddle stitching staple means 40 is located at the staple position X. The saddle stitching staple means is composed of a driver unit 40A and an anvil unit 40B which are separately arranged opposite to each other and across the collecting guide 35. A needle cartridge is installed on the driver unit 40A and contains needles coupled together like a band. A driver member moves upward and downward between a top dead center and a bottom dead center to allow a former member to fold the needle at the leading end into a U shape. The needle is then stuck into the sheet bunch. The driver unit 40A thus comprises a drive motor MS2, a driving arm that moves the driver member upward and downward, and a driving cam that drives the arm.

A folding groove is formed in the anvil unit 40B such that the tip of the staple needle stuck into the sheet bunch is folded in the folding groove. In the saddle stitching staple means 40 configured as described above, the driver unit 40A and the anvil unit 40B are separately arranged opposite to each other so that the sheet bunch can pass between the units 40A and 40B. This enables the sheet bunch to be stapled at the center or any other desired position.

Figure 6A:
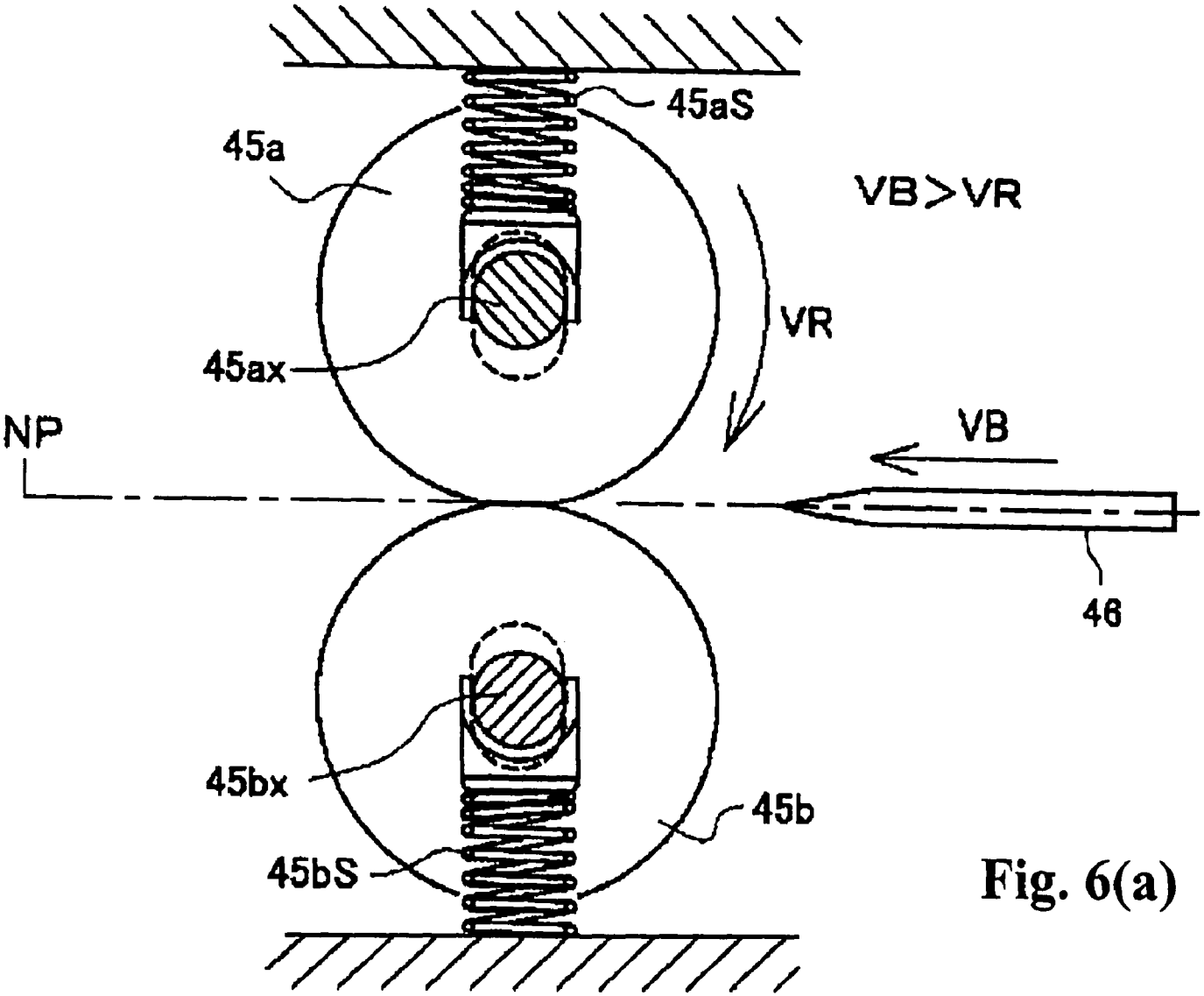
FIG. 6(*a*) shows the sectional structure of the folding roll means.
Figure 6B:
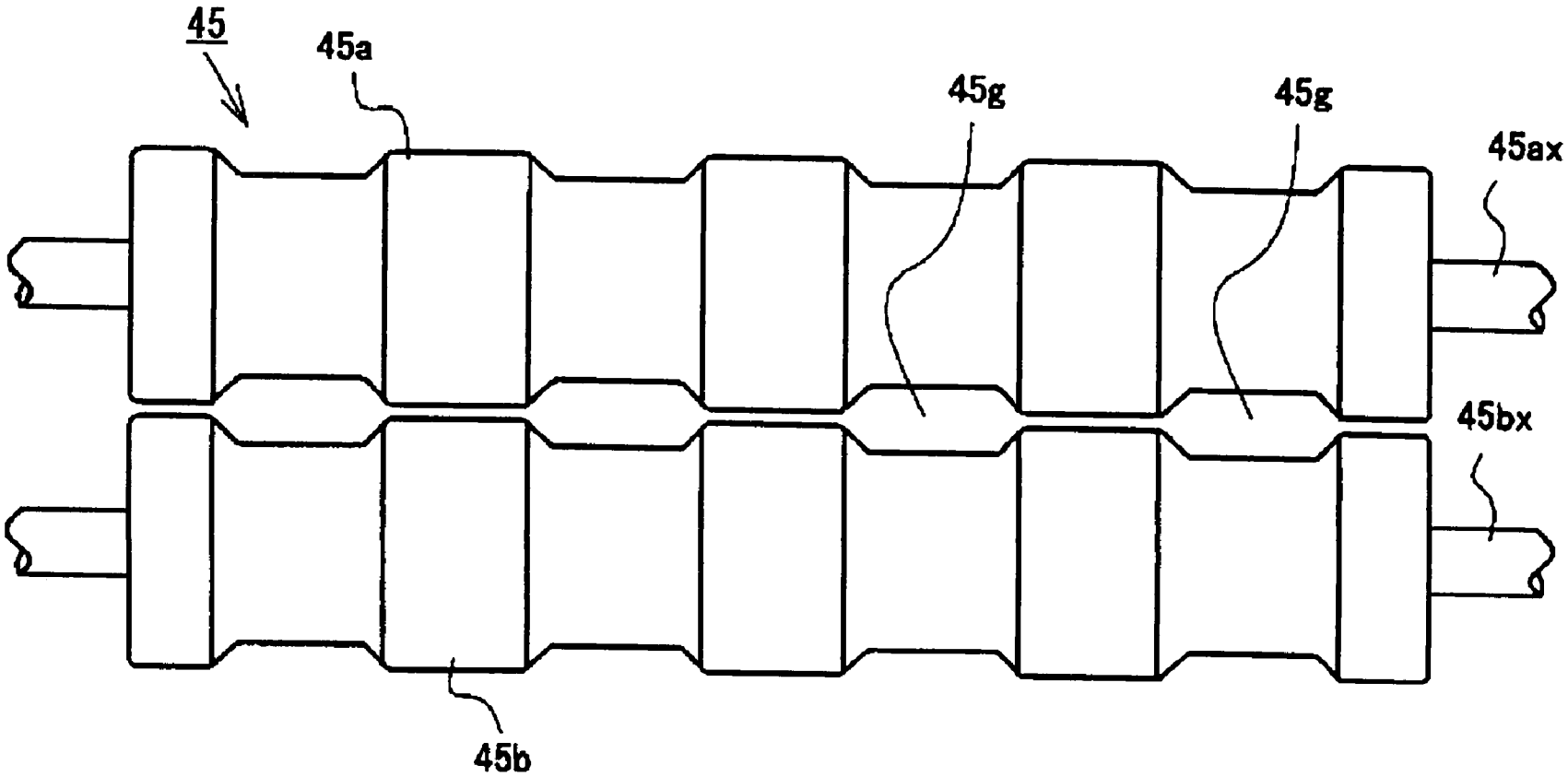
Figure 6C:
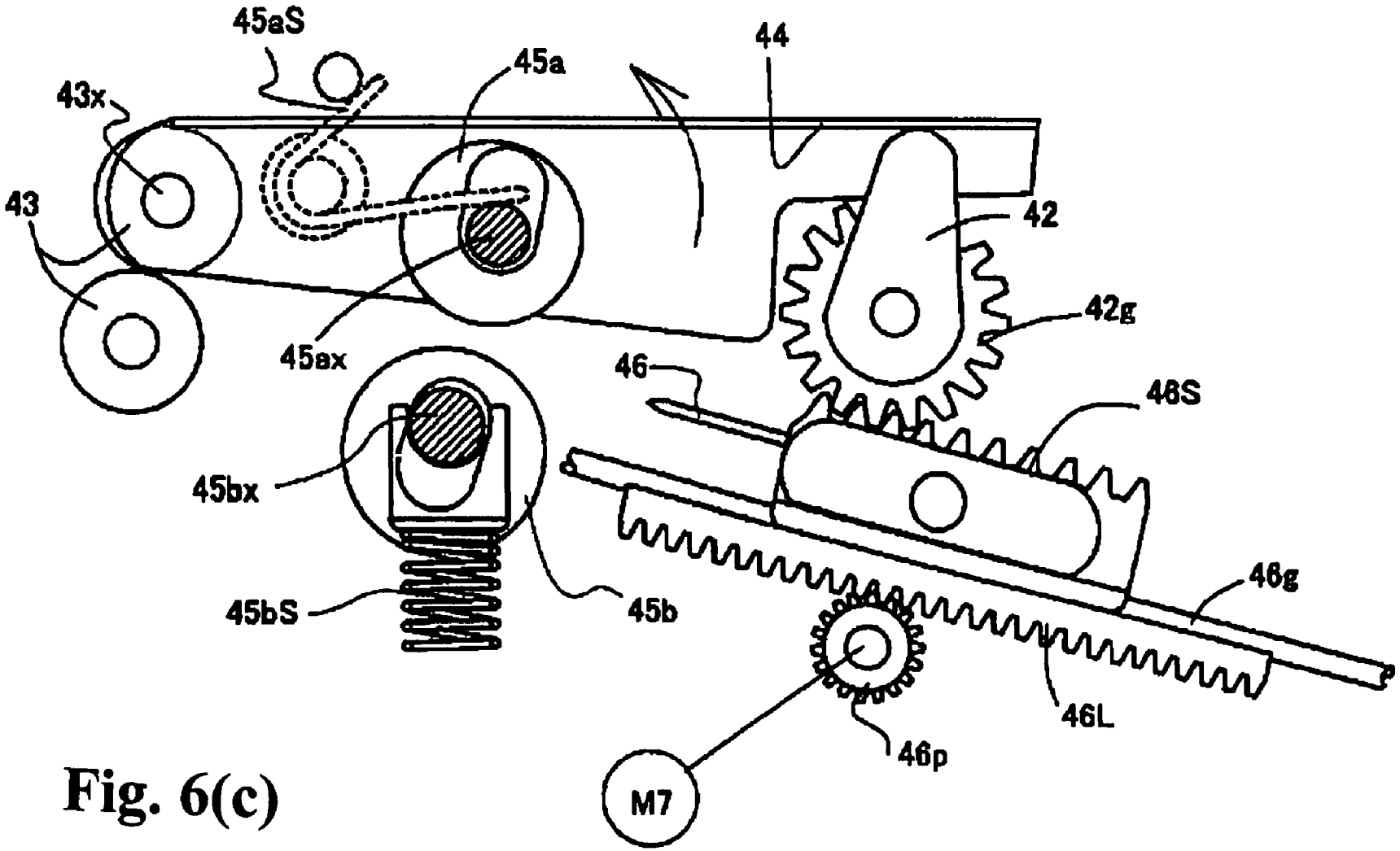
Figure 7A:
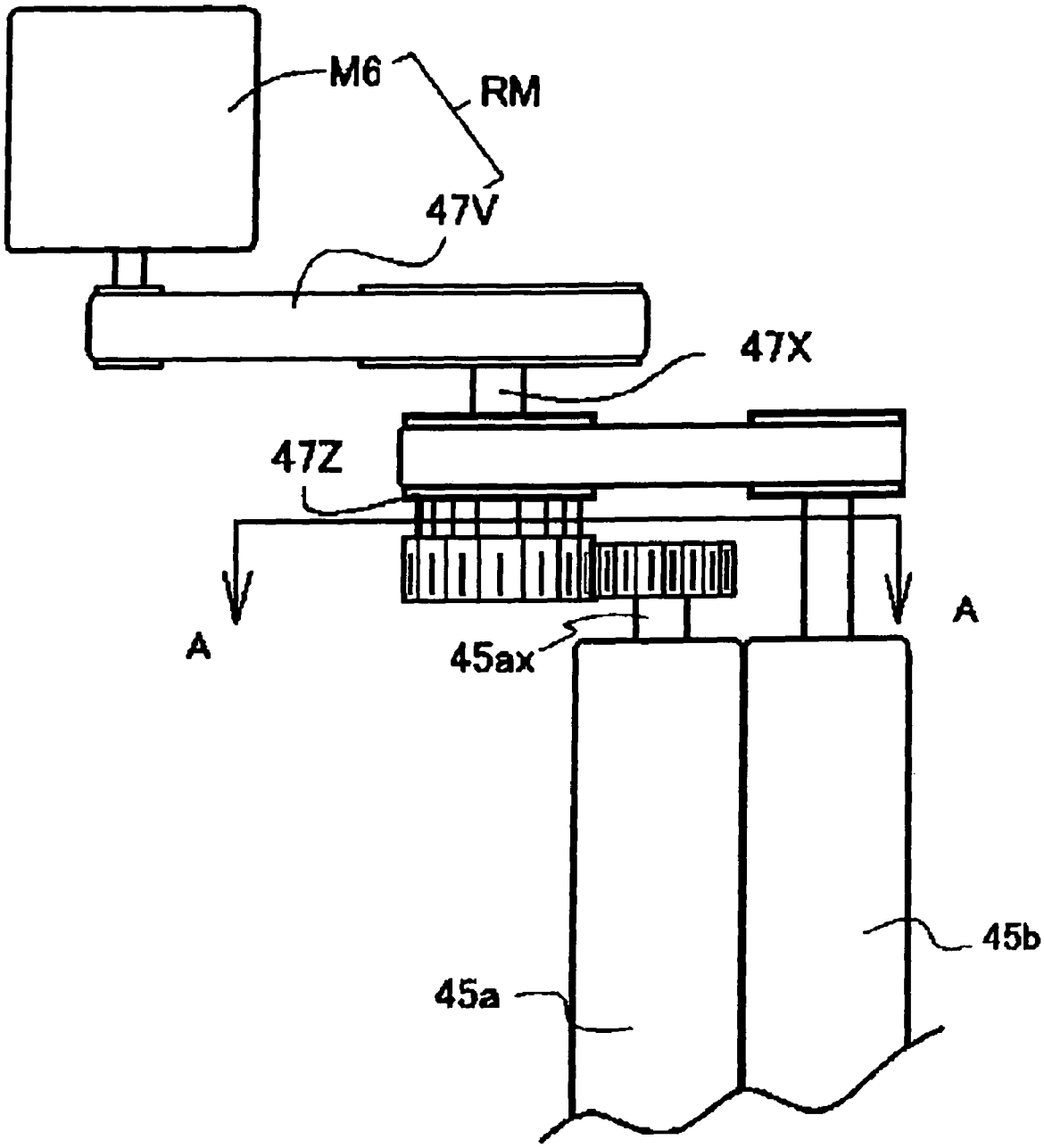
FIG. 7(*a*) is a diagram illustrating a driving mechanism for the folding roll means.
Figure 7B:
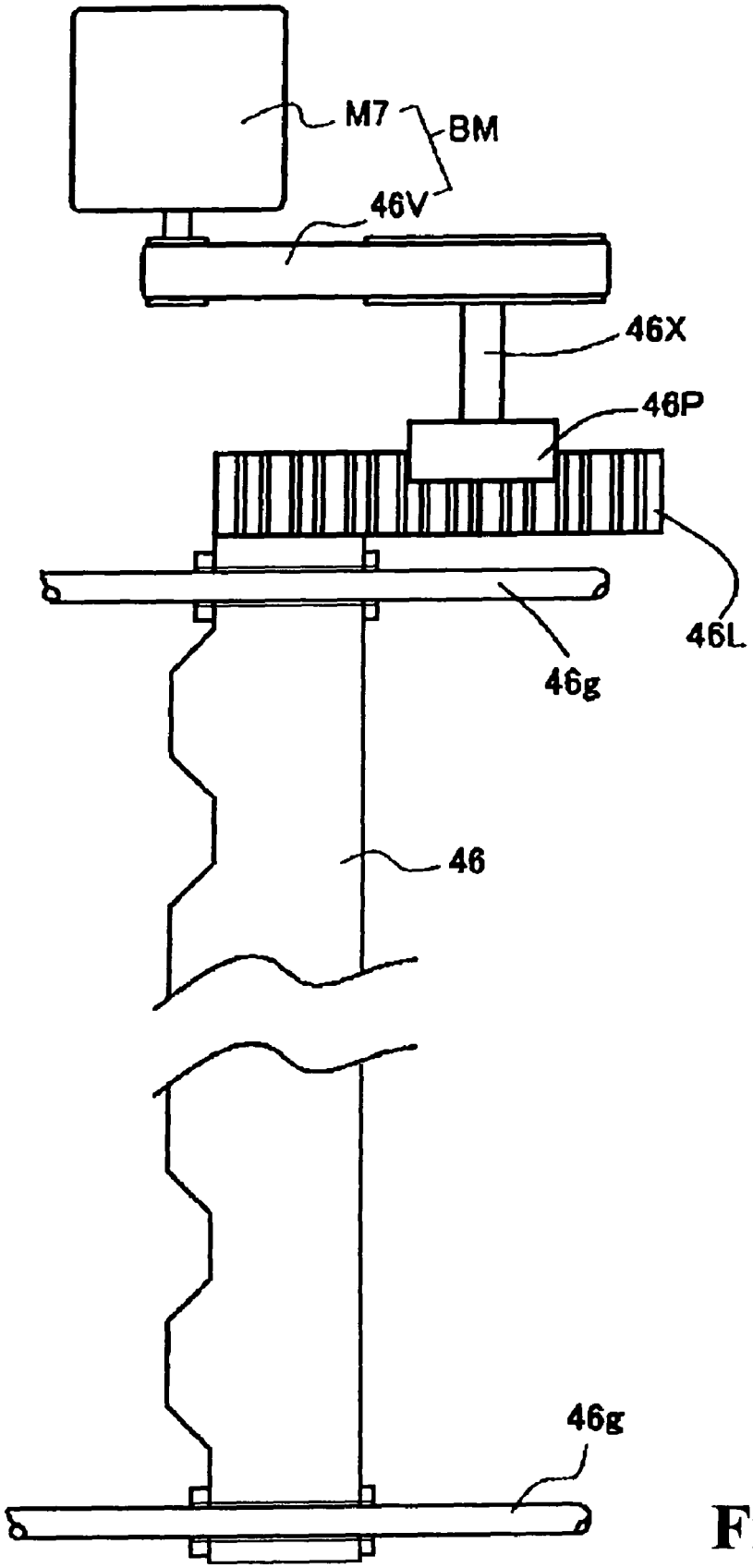
Figure 7C:
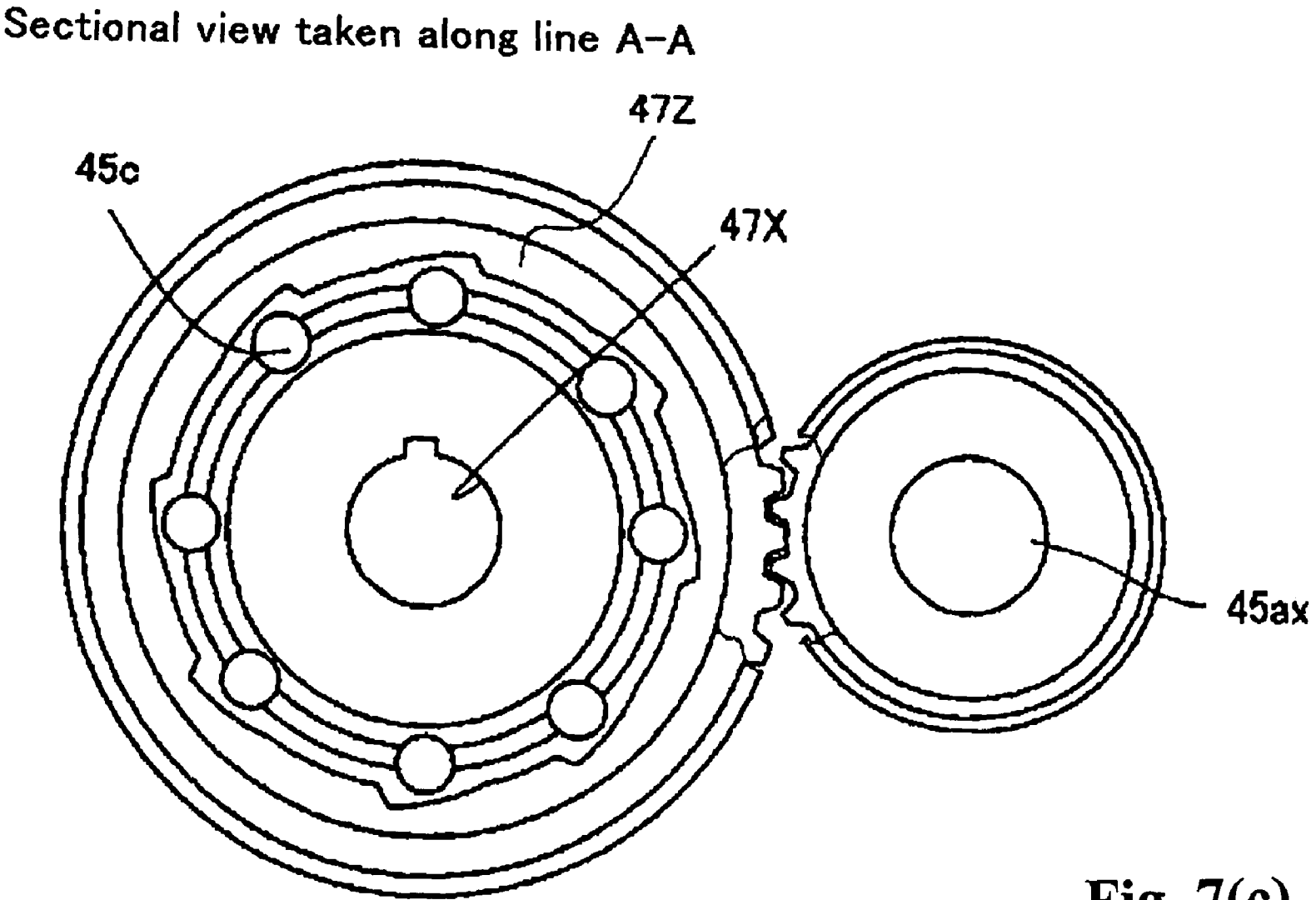
Figure 7D:
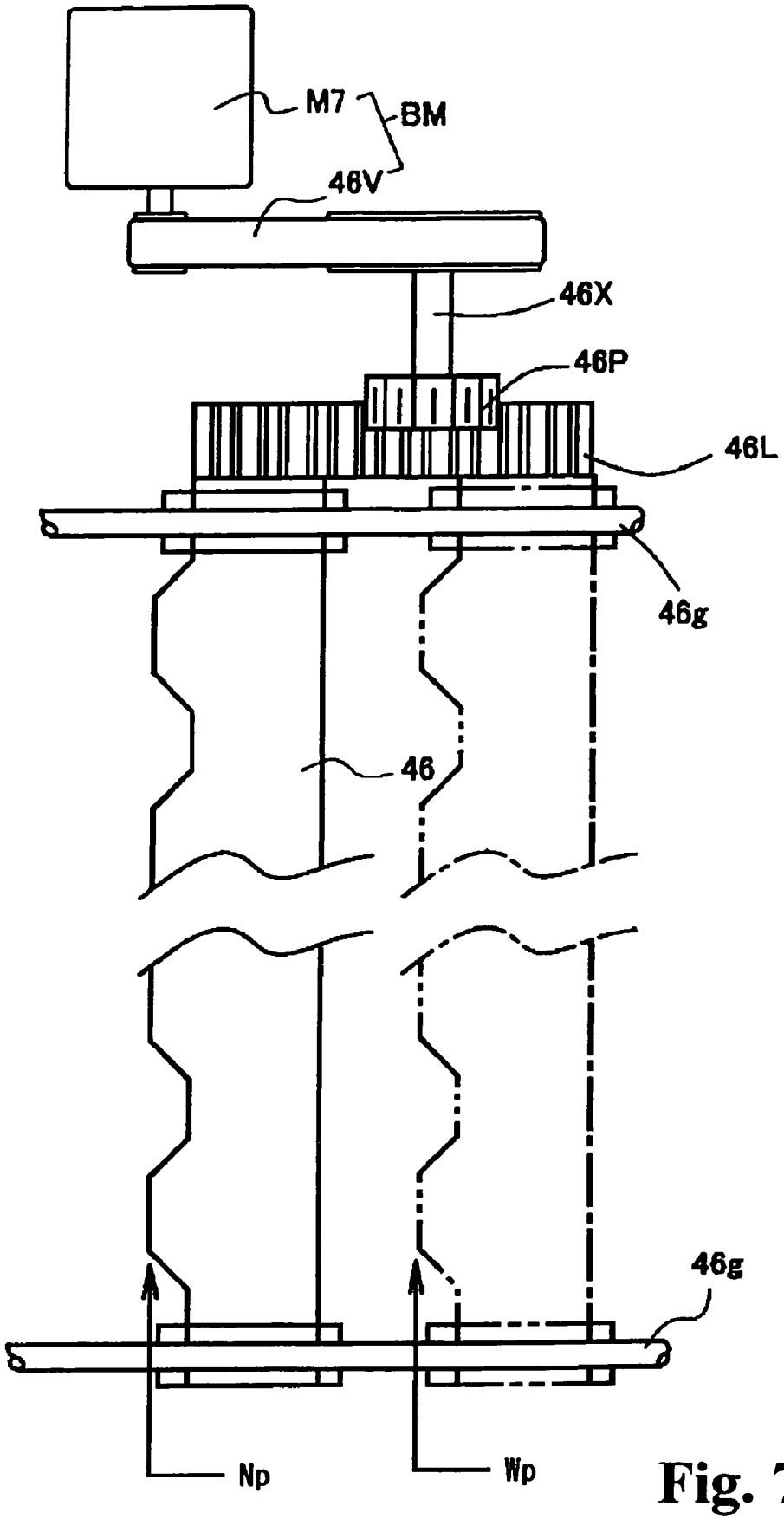
Figure 8A:
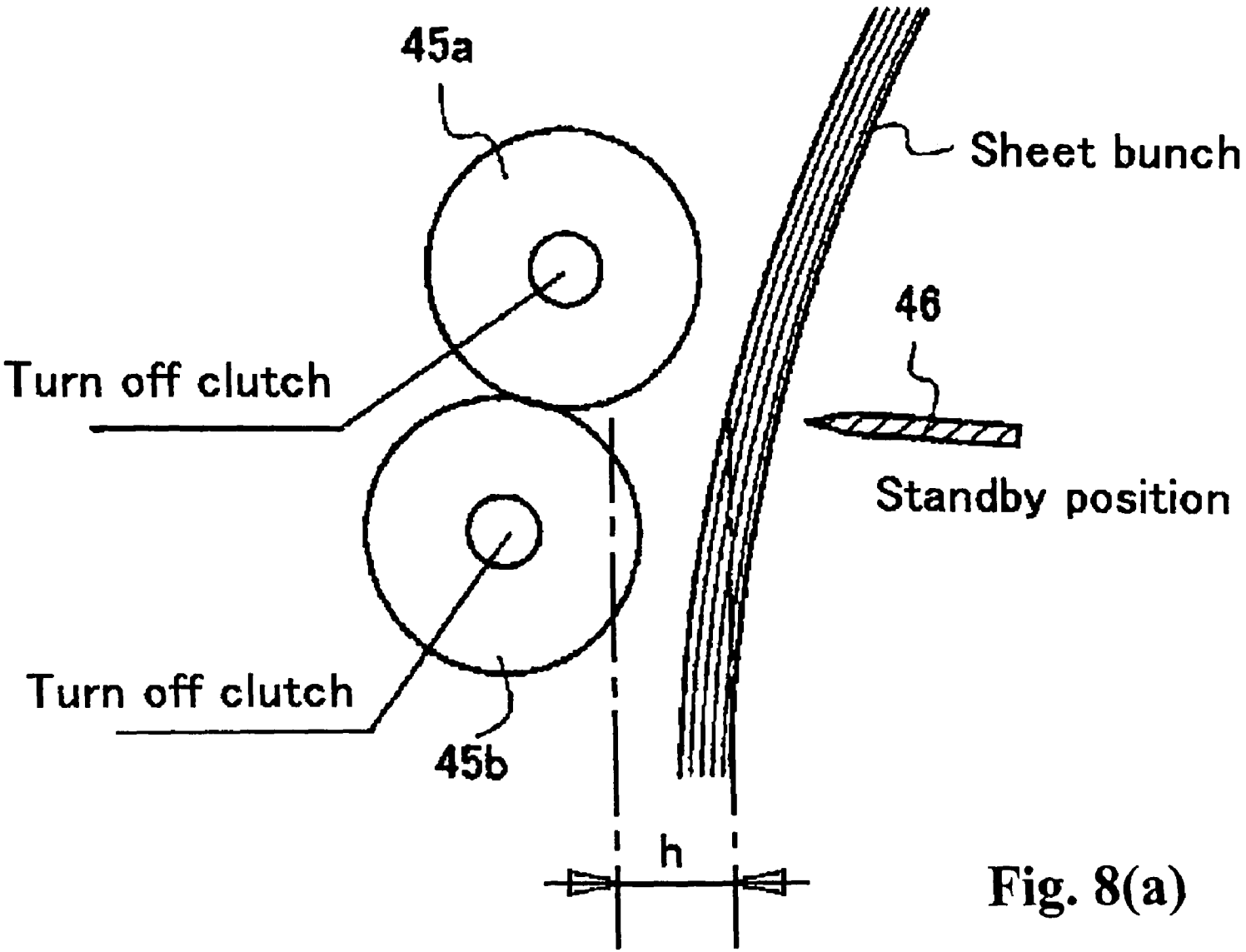
FIG. 8(*a*) is a diagram showing a state in which a sheet bunch is placed and set at a fold position, to describe a sheet bunch folding operation of the apparatus in FIG. 2.
Figure 8B:
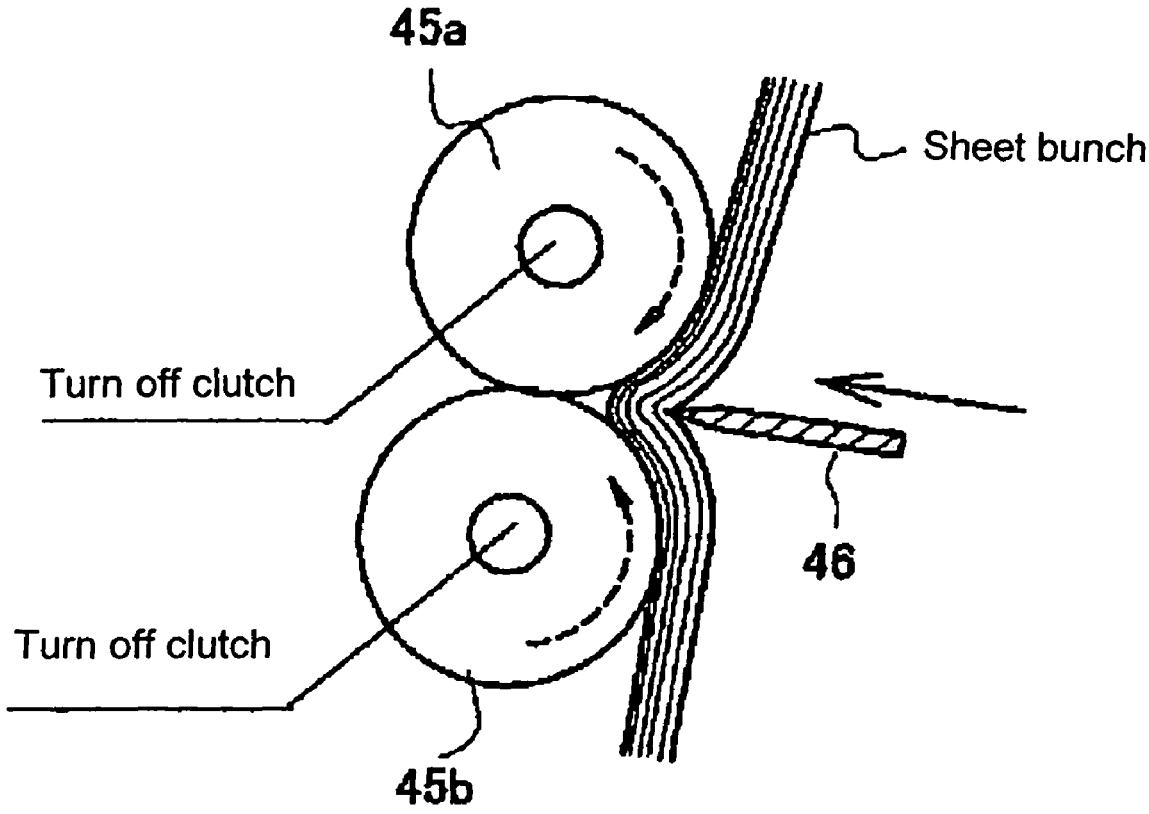
Figure 8C:
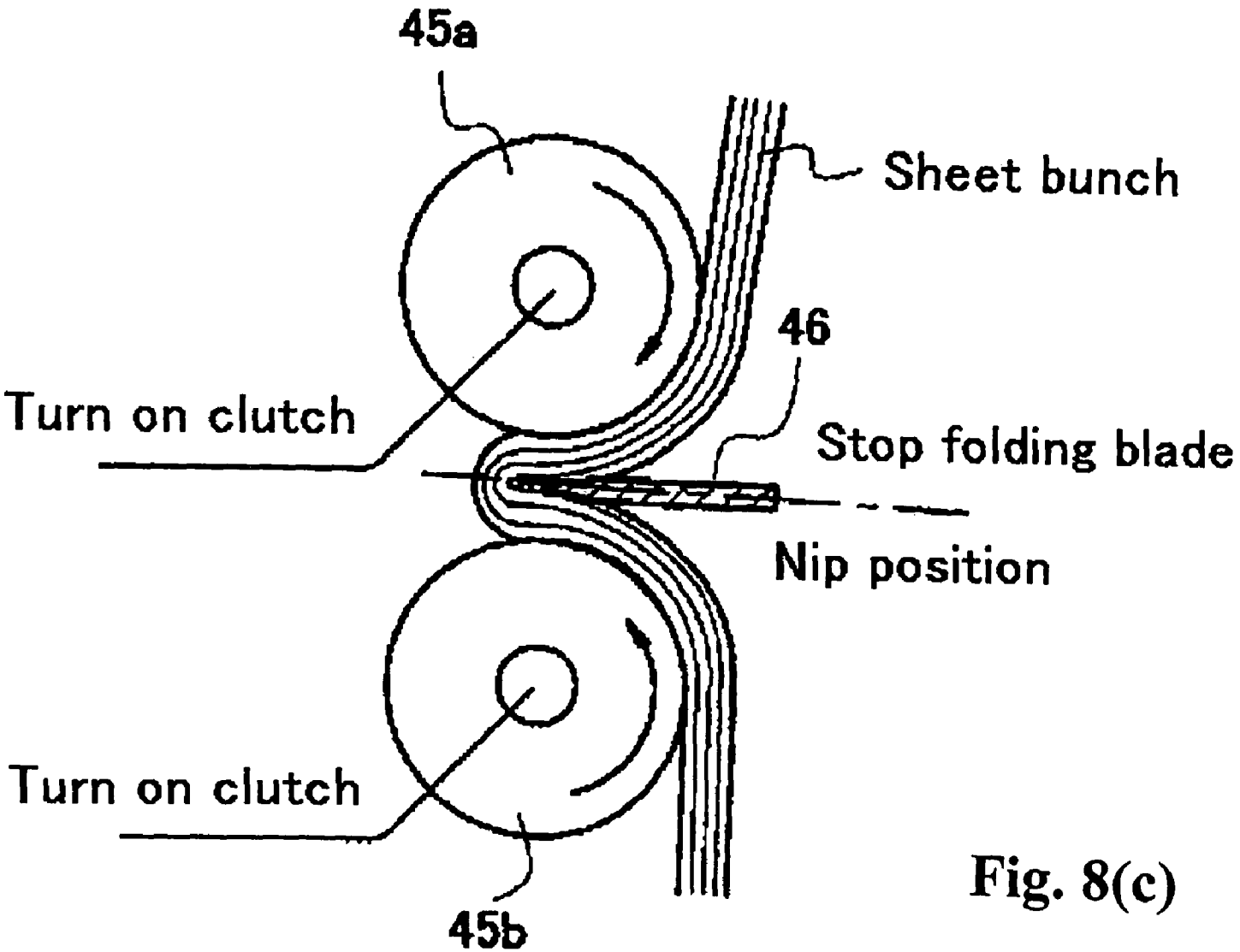
Figure 8D:
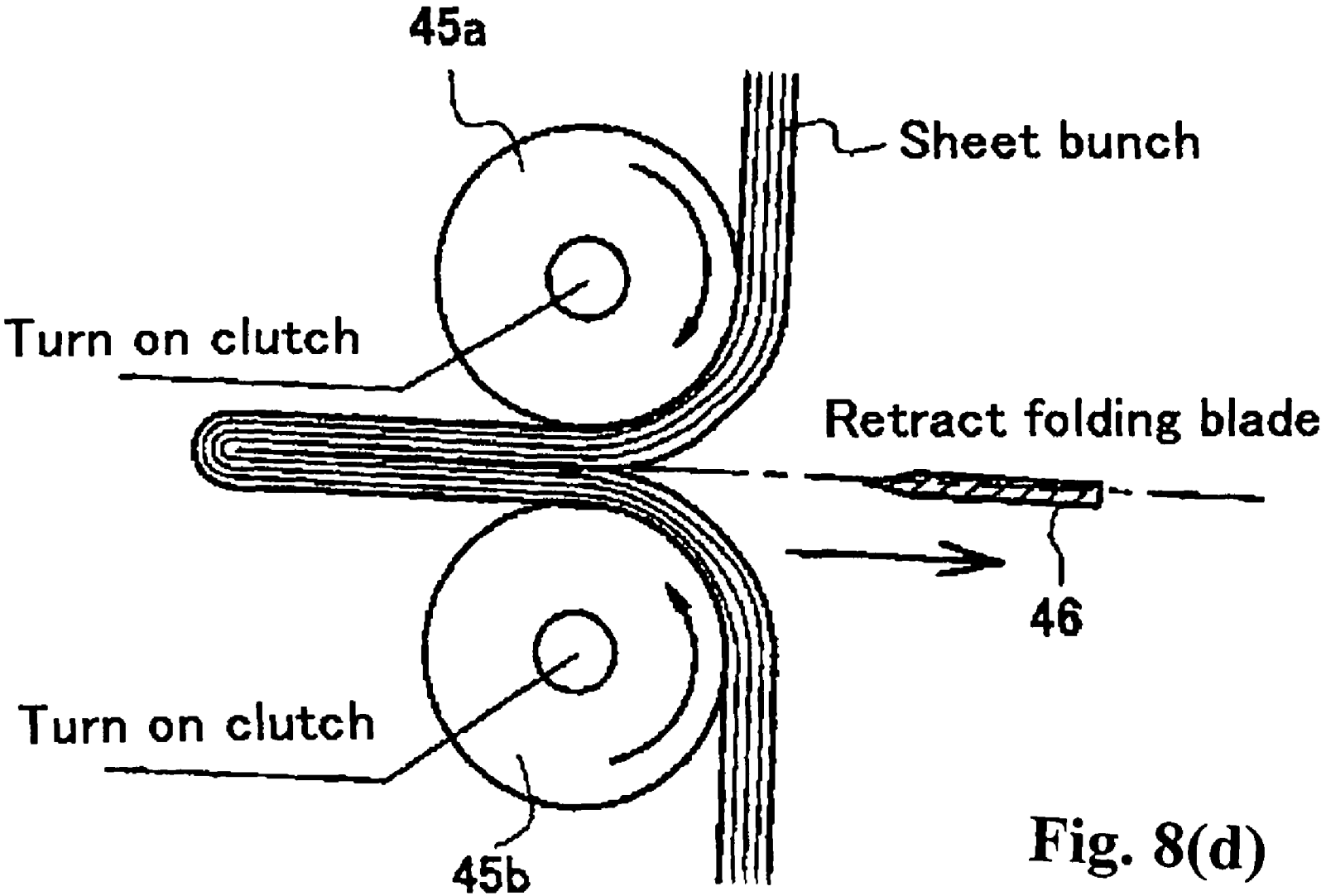

The folding roll means 45 and a folding blade 46 are provided at the fold position X, located on the downstream side of the staple means 40. The folding roll means folds the sheet bunch and the folding blade 46 inserts the sheet bunch into a nip position NP (shown in FIG. 6(*a*) on the folding roll means 45. As shown in FIGS. 6(*a*) and 6(*b*), the folding roll means 45 is composed of rolls 45*a* and 45*b* that are in pressure contact with each other and each of which is formed to have a width substantially equal to that of the maximum sized sheet. The paired rolls 45*a* and 45*b* have respective rotating shafts 45*ax* and 45*bx* fitted in long grooves in the apparatus frame so as to be in pressure contact with each other. The rolls 45*a* and 45*b* are biased in a pressure contact direction by compression springs 45*a*S and 45*b*S, respectively. Alternatively, the rolls may be supported via shafts so that at least one of the rolls 45*a* and 45*b* is movable in the pressure contact direction, with a bias spring engaged with this roll.

The pair of rolls 45*a* and 45*b* is preferably formed of a material such as rubber which has a relatively large coefficient of friction to fold the sheet being transferred in a rotating direction. The rolls 45*a* and 45*b* may be formed by lining a rubber like material. The folding roll means 45 is shaped to have recesses and protrusions and thus gaps 45*g* in the sheet width direction as shown in FIG. 6(*b*). The gaps 45*g* are arranged so as to coincide with recesses and protrusions on the folding blade 46, described below. A leading end of the folding blade thus advances easily between roll nips. The gaps 45*g* are also arranged at width-wise positions corresponding to staple positions at which the sheet bunch is stapled. That is, the pair of rolls 45*a* and 45*b*, which are in pressure contact with each other, is shaped to have the recesses and protrusions and thus the gaps 45*g* in the sheet width direction. The gaps coincide with the sheet staple positions and knife edges of the folding blade 46, which is similarly shaped to have recesses and protrusions, enter the gaps.

Each of the rolls 45*a* and 45*b* is coupled to the roll driving means RM. The illustrated roll driving means RM is composed of a roll drive motor M6 and a transmission mechanism (transmission means) 47V as shown in FIGS. 7(*a*) and 7(*c*). The illustrated transmission means 47V is composed of a transmission belt which reduces the rotation of the roll drive motor M6 so that the reduced rotation is transmitted to a transmission shaft 47X. Clutch means 45*c* is located between the transmission shaft 47X and the rotating shaft 45*ax* of the first roll 45*a*. Similarly, clutch means 45*c* is located between the transmission shaft 47X and the rotating shaft 45*bx* of the second roll 45*b*. The clutch means 45*c* is composed of an electromagnetic clutch, a one-way clutch (one-way clutch), a sliding friction clutch (spring clutch), or the like to make it possible to turn on and off the transmission of the driving rotation of the roll drive motor M6 to the first roll 45*a* and the second roll 45*b*.

The illustrated clutch means 45*c* is composed of a one-way clutch and located between the transmission shaft 47X and a transmission collar 47Z so as to transmit the rotation of the transmission shaft 47X to the transmission collar 47Z in only one direction. The first roll 45*a* is coupled to the transmission collar 47Z via a gear, and the second roll 45*b* is coupled to the transmission collar 47Z via a belt. The motor rotation in only one direction is transmitted to the first and second rolls 45*a* and 45*b*, thus coupled to the roll drive motor M6 via the clutch means 45*c*. The rolls are configured so as to be freely rotatable in a sheet delivery direction.

The rolls 45*a* and 45*b* are positioned in the area to which the collecting guide 35 is curved or bent to project. The rolls 45*a* and 45*b* is located at a distance h from the sheet bunch supported on the collecting guide 35 as shown in FIG. 8(*a*). That is, the rolls 45*a* and 45*b* is located at the distance h from the sheets (bunch) supported on the collecting guide 35 so as to prevent the roll surface from coming into contact with the sheets (bunch). The folding blade 46 with the knife edge is provided opposite the rolls 45*a* and 45*b* across the sheet bunch. The folding blade 46 is supported by the apparatus frame so as to be able to reciprocate between a standby position in FIG. 8(*a*) and a nip position in FIG. 8(*c*). Blade driving means BM (FIG. 7(*b*)) is coupled to the folding blade 46. The folding blade 46 is reciprocated, by a drive motor M7, between the standby position, where the folding blade is retracted from the sheet bunch supported on the collecting guide 35, and the nip position where the rolls of the folding roll means 45 are in pressure contact with each other. The folding blade 46 is formed of a material such as metal which has a relatively small coefficient of friction, and is shaped like a plate. The leading end of the folding blade 46 is shaped like a recessed and protruding surface as shown in FIG. 7(*b*). The blade leading end is shaped to enter the gaps 45*g* in the rolls 45*a* and 45*b* as described above.

In the illustrated apparatus, the relationship between the coefficient of friction ν1 between the rolls 45*a* and 45*b* and the sheets, the coefficient of friction ν2 between the sheets, and the coefficient of friction ν3 between the sheets and the folding blade 46 is set to be ν1>ν2>ν3. Consequently, when the sheet bunch shown in FIG. 8(*c*) is inserted between the first roll 45*a* and the second roll 45*b* by the folding blade 46, the pressure contact force acting on both rolls 45*a* and 45*b* also acts on the folding roll means 45, the sheet bunch, and the folding blade 46. In this case, since the coefficients of friction are set to have the above-described relationship, the sheet bunch is smoothly fed in the delivery direction (leftward in the figure).

Now, the configuration of the blade driving means BM of the folding blade 46 will be described. As shown in FIG. 7(*b*), the folding blade 46 is supported on the apparatus frame so as to be movable along the guide rail 46*g* in a sheet folding direction. The folding blade 46 is supported so as to be able to reciprocate between the standby position, where the folding blade 46 is retracted from the sheets supported on the collecting guide 35, and the nip position on the folding roll means 45. The blade driving means BM, which reciprocates the folding blade 46, includes a blade drive motor M7 and transmission means 46V for transmitting the rotation of the blade drive motor M7, in the figure, a transmission belt, to transmit the rotation to a transmission rotating shaft 46X. A transmission pinion 46P is provided on the transmission rotating shaft 46X and meshes with a rack gear 46L integrally mounted on the folding blade 46. Thus, rotating the blade drive motor M7 forward or backward reciprocates the folding blade 46 between the standby position and the nip position along the guide rail 46*g*. The folding blade 46 is composed of a plate-like member having the knife edge in the sheet width direction. The leading end of the folding blade 46 is shaped so as to have recesses and protrusions as shown in the figure.

Now, with reference to FIGS. 8(*a*) to 8(*d*), description will be given of how the folding roll means 45 and folding blade 46 are configured as described above to fold the sheets. First, the sheet bunch supported on the collecting guide 35 is locked by the leading end regulating member 38, shown in FIG. 4, as shown in FIG. 8(*a*). The sheet bunch stapled at a fold position is positioned at the fold position Y. Upon receiving a set end signal, driving control means (a sheet folding operation control section 64*d* shown in FIG. 9, this also applies to the description below) turns off the clutch means 45*c*, shown in FIG. 7(*c*). In the illustrated on-way clutch configuration, the roll drive motor M6 is stopped or rotated at a speed lower than the moving speed of the folding blade 46. This is to allow the rolls 45*a* and 45*b* to be rotated in conjunction with the sheet bunch inserted into the nip position by the folding blade 46 as described below.

The driving control means 64*d*, shown in FIG. 9, thus moves the folding blade 46 from the standby position to the nip position at a predetermined speed. For this moving speed VB, the rotating peripheral speed VR of the folding roll means 45 is set at zero or so that VB>VR. Thus, the sheet bunch is bent at the fold position and inserted between the rolls by the folding blade 46 as shown in FIG. 8(*b*). At this time, the first roll 45*a* and the second roll 45*b* are rotated in conjunction with the sheets moved by the folding blade 46. The driving control means 64*d* stops the blade drive motor M7 to cause the folding blade 46 to rest at the position shown in FIG. 8(*c*) until the sheet bunch is expected to reach the predetermined nip position. Simultaneously, the driving control means 64*d* turns on the clutch means 45*c* to drivingly rotate the rolls 45*a* and 45*b*. Then, the sheet bunch is fed in the delivery direction (leftward in the figure). Subsequently, in parallel with the delivery of the sheet bunch by the folding roll means 45, the driving control means 64*d* moves and returns the folding blade 46 lying at the nip position, to the standby position as shown in FIG. 8(*d*).

When the thus folded sheet bunch is caught between the paired rolls 45*a* and 45*b*, the sheet contacting the roll surface is prevented from being drawn in between the rotating rolls 45*a* and 45*b*. That is, the folding roll means 45 rotates in conjunction with the inserted (pushed-in) sheets, preventing only the sheet contacting the rolls from being caught in between the rolls before the remaining sheets are caught. Furthermore, the folding roll means 45 rotates in conjunction with the inserted sheets, preventing the roll surface from rubbing against the sheet contacting the roll surface thereby preventing image rubbing.

A control arrangement for the image forming system described above will be described with reference to the block diagram in FIG. 9. The image forming system shown in FIG. 1 comprises a control section (hereinafter referred to as a "body control section") 50 of the image forming apparatus A, and a control section (hereinafter referred to as a "post-processing control section") 60 of the post-processing apparatus B. The body control section 50 comprises an image forming control section 51, a sheet feeding control section 52, and an input section 53. The "image forming mode" or the "post-processing mode" is set via a control panel 18 provided in the input section 53. As described above, the following image forming conditions are set for the image forming mode: printout copy count, sheet size, color or black-and-white printing, enlarged or reduced printing, and double- or single-side printing. The body control section 50 controls the image forming control section and the sheet feeding control section in accordance with the set image forming conditions so that images are formed on predetermined sheets, which are then sequentially carried out through the body sheet discharging port 3.

Simultaneously with the settings for the image forming mode, the post-processing mode is set by input via the control panel 18. The post-processing mode is set to, for example, the "printout mode", a "stapling finish mode", or a "sheet bunch folding finish mode". The body control section 50 transfers information on a post-processing finish mode, a sheet count, and a document copy count, and stapling mode information (whether the sheets are to be stapled at one position or a plurality of positions) to a post-processing control section 60. Every time image formation is finished, the body control section transfers the job end signal to the post-processing control section 60.

The post-processing control section 60 comprises a control CPU 61 that operates the post-processing apparatus B in accordance with the specified finish mode, a ROM 62 in which operation programs are stored, and a RAM 63 in which control data is stored. The control CPU 61 comprises a sheet conveyance control section 64*a* that allows the sheet fed to the carry-in port 23 to be conveyed, a sheet collecting operation control section 64*b* that performs a sheet collecting operation, a sheet stapling operation control section 64*c* that executes a sheet stapling process, and a sheet folding operation control section 64*d* that performs a sheet bunch folding operation.

The sheet conveyance control section 64*a* is coupled to a control circuit for the drive motor M1 for the conveying roller 24 and sheet discharging roller 25 on the sheet carry-in path P1. The sheet conveyance control section 64*a* is configured to receive a sensing signal from the sheet sensor S1, located on the path P1. The sheet collecting operation control section 64*b* is connected to a driving circuit for the forward reverse motor M2 for forward reverse roller 30, which allows the sheets to be collected on the first collecting section (collecting tray), and for the sheet discharging motor M3 for the trailing end regulating member. Moreover, the sheet stapling operation control section 64*c* is connected to a driving circuit for drive motors MS1 and MS2 built in the end surface stapling means 33 of the first collecting section 29 and in the saddle stitching staple means 40 of the second collecting section (collecting guide) 35.

The sheet folding operation control section 64*d* is connected to a driving circuit for the roll drive motor R6, which drivingly rotates the first and second rolls 45*a* and 45*b*, and to a driving circuit for the clutch means 45*c*. The control section 64*d* is connected to a control circuit for the shift means MS for controllably moving the conveying rollers 36 and 37 on the second switchback conveying path SP2 and the leading end regulating means 38 of the collecting guide 35. The control section 64*d* thus receives sensing signals from sheet sensors arranged on the paths. The control section 64*d* is further connected to a driving circuit for the blade drive motor M7, which operates the folding blade 46.

The control section 64*d* configured as described above allows the post-processing apparatus to perform the following process operations.

Further, in the printout mode, the image forming apparatus A forms images on a series of documents starting with, for example, the first page. The image forming apparatus A sequentially carries out the sheets through the body sheet discharging port 3 in a face down posture. The post-processing apparatus B retracts the buffer guide 26 of the sheet carry-in path P1 upward in FIG. 3 to move the path switching piece 27 as shown by a solid line in FIG. 3. The sheet fed to the sheet carry-in path P1 is thus guided to the sheet discharging roller 25. The sheet leading end is then detected at the sheet discharging port 25*a*, and the corresponding signal is issued. At the time when the sheet leading end is expected, on the basis of the signal, to reach the forward reverse roller 30 on the collecting tray 29, the sheet conveyance control section 64*a* lowers the forward reverse roller 30 from the upper standby position onto the tray. The sheet conveyance control section 64*a* further rotates the forward reverse roller 30 clockwise in FIG. 4. Then, the sheet having reached the collecting tray 29 is carried out by the forward reverse roller 30 and housed on the first sheet discharging port 21. The succeeding sheets are thus sequentially carried out and collected and housed on the tray.

Thus, in the printout mode, the sheets with images formed thereon by the image forming apparatus are accommodated on the first sheet discharging tray 21 via the sheet carry-in path P1 in the post-processing apparatus B. For example, the sheets are sequentially laid on top of one another in a face down posture starting with the first page and ending with the nth page. In this mode, the sheets are not guided to the first switchback conveying path SP1 or the second switchback conveying path SP2, shown in FIG. 5.

In the stapling finish mode, as shown in FIG. 5, the image forming apparatus A sequentially forms images on a series of documents starting with the first page and ending with the nth page and carries out the resultant sheets through the sheet discharging port 3 in a face down posture, as in the case of the printout mode. The post-processing apparatus B retracts the buffer guide 26 of the sheet carry-in path P1 upward in FIG. 3 to move the path switching piece 27 as shown by the solid line in FIG. 3, as in the case of the printout mode. A sheet fed to the sheet carry-in path P1 is thus guided to the sheet discharging roller 25. The sheet leading end is then detected at the sheet discharging port 25*a*, and the corresponding signal is issued. At the time when the sheet leading end is expected, on the basis of the signal, to reach the forward reverse roller 30 on the collecting tray 29, the sheet conveyance control section 64*a* lowers the forward reverse roller 30 from the upper standby position onto the tray. The sheet conveyance control section 64*a* then rotates the forward reverse roller 30 clockwise in FIG. 3. Then, after the time when the sheet trailing end is expected to reach the collecting tray 29, the sheet conveyance control section 64*a* rotationally drives the forward reverse roller 30 counterclockwise in FIG. 3. The sheet having passed through the sheet discharging port 25*a* is switched back and conveyed along the first switch back conveying path SP1 onto the collecting tray 29. This sheet conveyance is repeated to collect the series of sheets on the collecting tray 29 into a bunch in a face down state.

Further, every time a sheet is accumulated on the collecting tray 29, the control CPU 61 operates the side aligning plate 34*b* to align the sheet with the side aligning plate 34*b* in the width direction. Then, in response to the job end signal from the image forming apparatus A, the control CPU 61 operates the end surface staple means 33 to staple the sheet bunch collected on the tray 29, at the trailing edge thereof. After the stapling operation, the control CPU 61 moves the trailing end regulating means 32, also serving as bunch carry-out means, from the position shown by the solid line in FIG. 3 to the position shown by a chain line in FIG. 3. The stapled sheet bunch is then carried out and housed on the first sheet discharging tray 21. The series of sheets with images formed thereon by the image forming apparatus A are stapled and housed on the first sheet discharging tray 21.

To continuously execute the stapling finish process, the control CPU 61 temporarily holds the succeeding sheet on the second switchback conveying path SP2. This sheet buffering operation will be described with reference to FIG. 10. As previously described, the conveying roller 36 is located at the carry-in port of the second switchback conveying path SP2 and is configured so as to be rotatable forward and backward. The control CPU 61, shown in FIG. 9, collects the sheets from the first switchback conveying path SP1 on the collecting tray 29. After the image forming job is finished, the control CPU 61 allows the end surface staple means 33 to execute the stapling process on the sheet bunch collected on the collecting tray. After the stapling process, the control CPU 61 moves the trailing end regulating member 32 to carry out the sheet bunch on the collecting tray 29 to the first sheet discharging tray 21.

Further, if the succeeding sheet is carried in by the image forming apparatus A while the stapling operation and/or the sheet bunch carry-out operation is being performed on the sheet bunch on the collecting tray 29, the CPU 61 uses the sheet sensor S1 to sense the succeeding sheet. At the time when the sheet trailing end is expected to pass through the path switching piece 27 on the sheet carry-in path P1, the control CPU 61 stops the sheet discharging roller 25. At the same time, the control CPU 61 moves the path switching piece 27 to the position shown in FIG. 10. The control CPU 61 subsequently reversely rotates the sheet discharging roller 25. The sheet on the sheet carry-in path P1 is then guided to the second switchback conveying path SP2, where the sheet is nipped by the conveying roller 36. At the time when the sheet trailing end is expected to reach the conveying roller 36, the control CPU 61 stops the conveying roller 36. The sheet on the sheet carry-in path P1 is then stopped and retained on the second switchback conveying path SP2.

While the sheet bunch on the collecting tray 29 is discharged to the first sheet discharging tray 21, the control CPU 61 rotates the conveying roller 36 clockwise as shown in FIG. 10. Simultaneously, the control CPU 61 rotationally drives the sheet discharging roller 21 in the sheet discharging direction. Then, the sheet held on the second switchback conveying path SP2 is guided to the first switchback conveying path SP1 and connected on the collecting tray 29. The control CPU 61 guides the sheet SA2 succeeding the standby sheet SA from the carry-in port 23 to the sheet discharging roller 25 and stacks the sheet SA2 on the collecting tray 29 as described above. In this case, as shown in FIG. 10, the sheet discharging roller 25 is composed of a pair of rollers that can freely come into pressure contact with each other and leave each other. To lay the succeeding sheet from the carry-in port 23 on top of the sheet standing by on the sheet discharging roller 25, the sheet discharging rollers 25 are preferably separated from each other by actuating means such an electromagnetic solenoid. This operation allows the post-processing apparatus B to continuously execute the stapling process without the need to stop the image forming apparatus.

The embodiment of the present invention is thus characterized as described below. The substantially linear sheet carry-in path P1 has the first switchback conveying path SP1 on the downstream side and the second switchback conveying path SP2 on the upstream side. The first processing section (the above-described collecting tray) 29 is located on the first switchback conveying path SP1, and the second processing section (the above-described collecting guide) 35 is located on the second switchback conveying path SP2. Thus, the succeeding sheet fed to the sheet carry-in path P1 while the post-processing operation such as stapling is being performed by the downstream first processing section 29 is temporarily held on the upstream second switchback conveying path SP2. After the processing operation of the first processing section 29 is finished, the succeeding sheet held on the second switchback conveying path SP2 is transferred to the first switchback conveying path SP1. The present invention is also characterized in that the succeeding sheet fed to the sheet carry-in path P1 while the second processing section 35 of the second switchback conveying path SP2 is performing the post-processing operation is temporarily held on the sheet carry-in path P1.

Figure 12A:
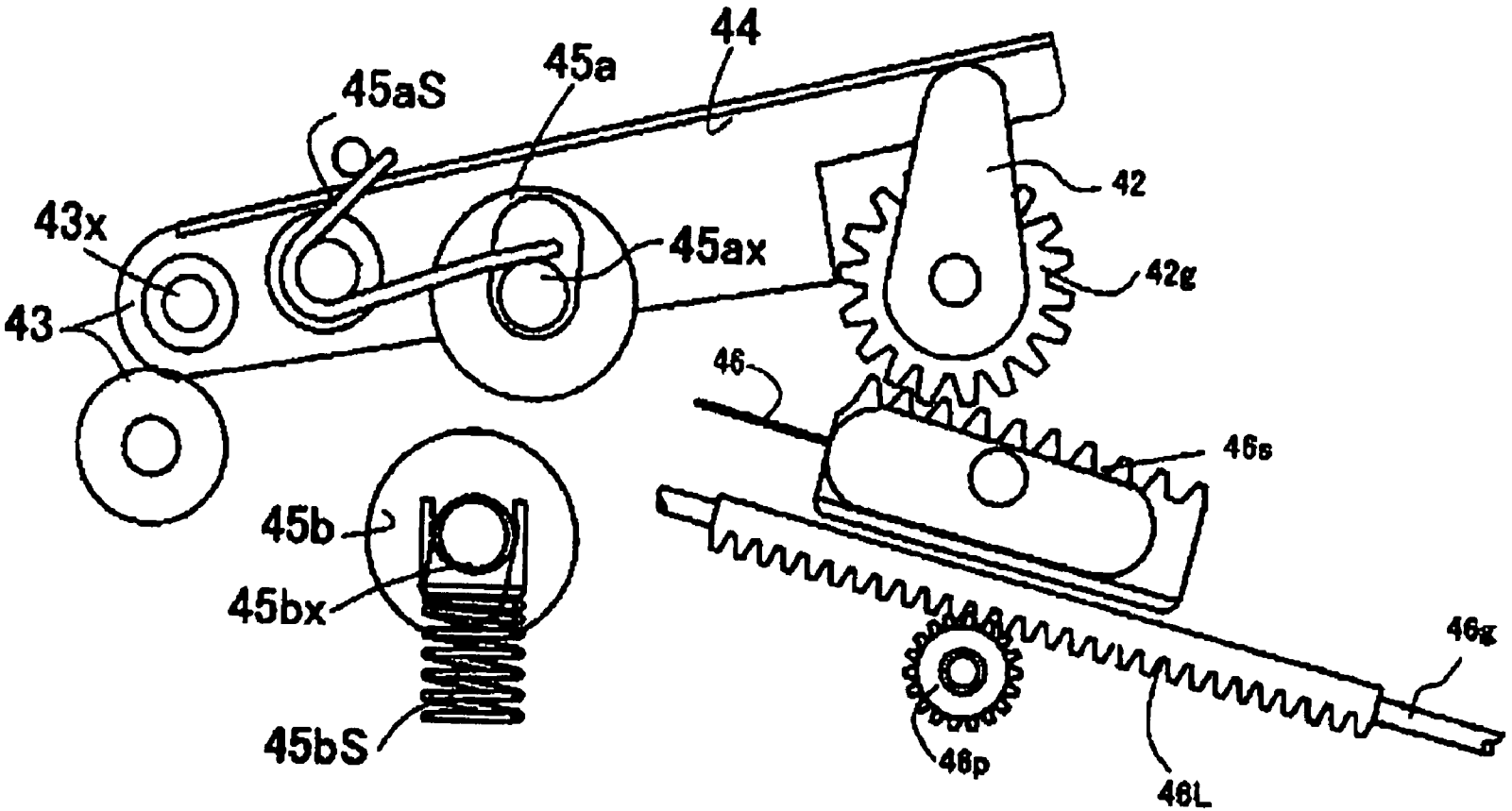
FIG. 12(*a*) is a diagram showing that the folding blade is at a standby position.
Figure 12B:
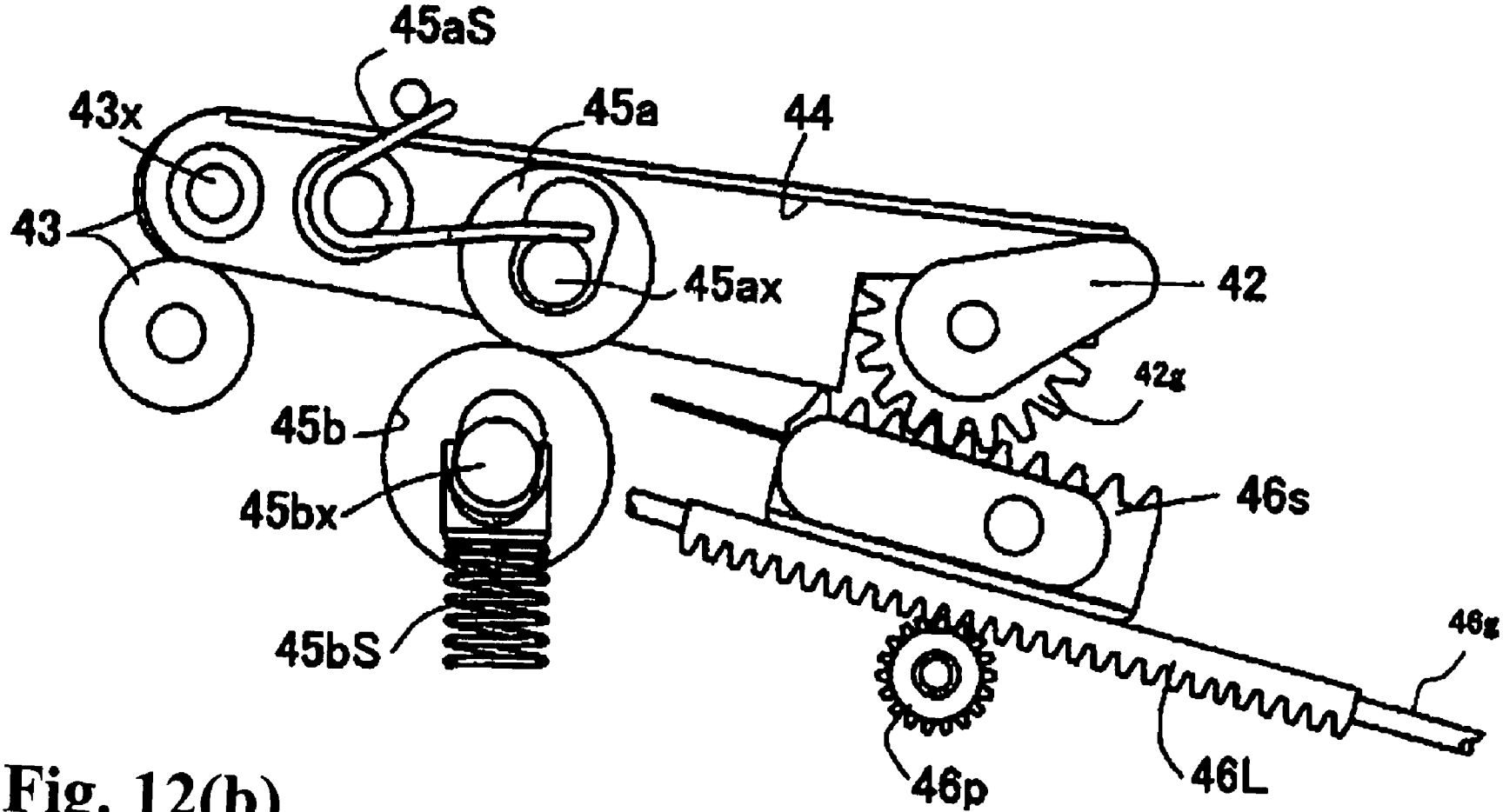
Figure 12C:
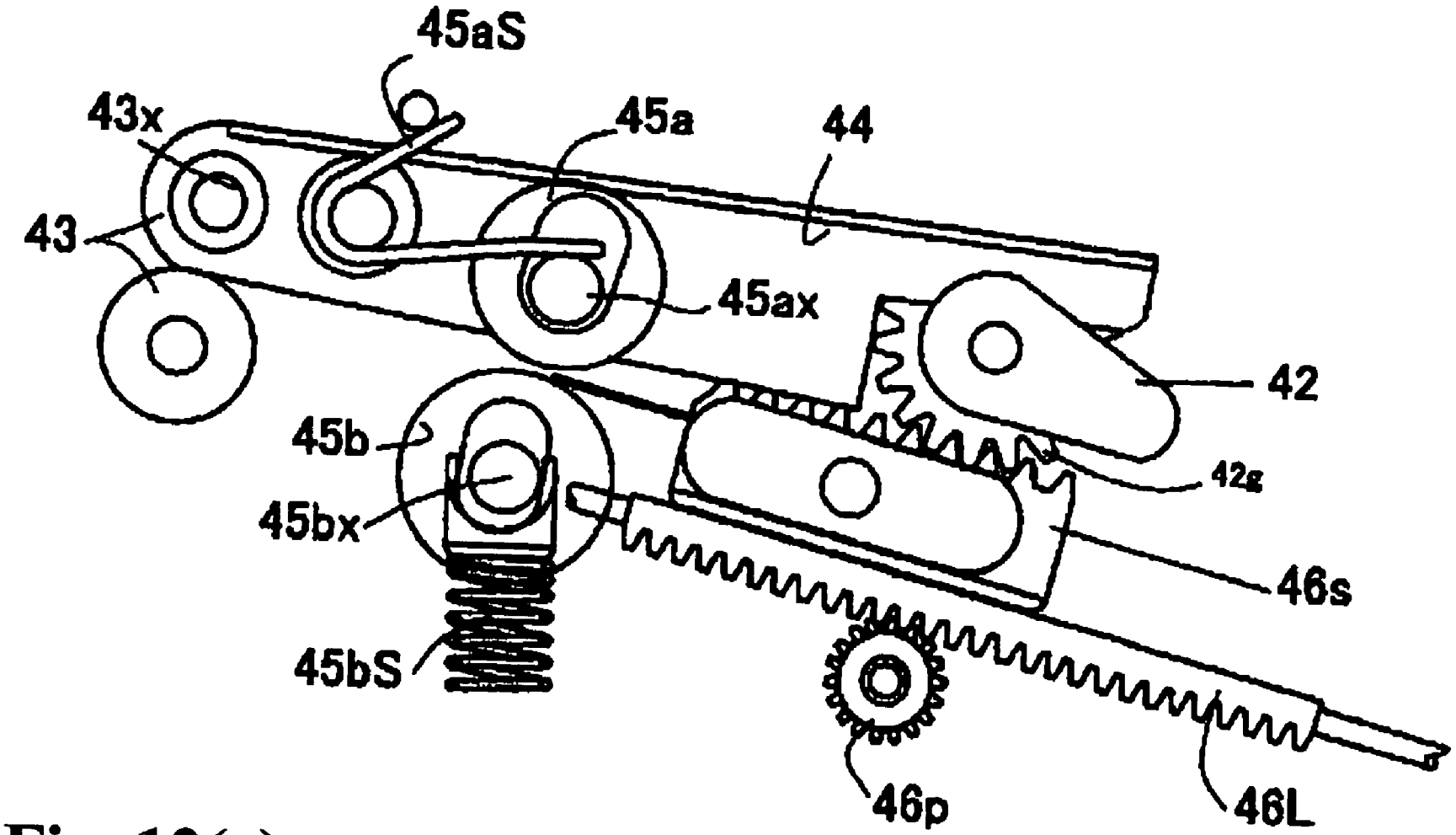

Further, conveyance control is performed as described below if the second succeeding sheet is carried into the sheet carry-in path P1 while the post-processing operation is being performed on the first switchback conveying path SP1. In this case, as shown in FIG. 10, the sheet discharging roller 25 is composed of a pair of rollers that can freely come into pressure contact with each other and leave each other. The paired rollers are configured to be separated from each other by actuating means (not shown) such as an electromagnetic solenoid. The conveyance control means 64*a* holds the first sheet (SA1 in FIG. 12(*a*)) held on the second switchback conveying path SP2 as described above. In this condition, when the second sheet (SA2 in FIG. 12(*a*)) is carried into the sheet carry-in path P1, the sheet sensor S1 detects the sheet leading end to issue the corresponding signal. The conveyance control means 64*a* then separates the sheet discharging rollers 25 from each other. The conveying roller 24 feeds the second sheet SA2 to the sheet discharging port 25*a*. The second sheet SA2 is then laid on top of the first sheet SA1 standing by on the second switchback conveying path SP2. This state is shown in FIG. 12(*a*). The first sheet SA1 and the second sheet SA2 overlap with the leading ends of the sheets offset from each other by an amount ho. That is, the succeeding first sheet SA1 and second sheet SA2 are offset from each other by the predetermined distance ho in the conveying direction. The conveyance control means 64*a* shifts and brings the sheet discharging rollers 25 into pressure contact with each other (as shown in FIG. 12(*a*)) and rotationally drives the rollers 25 in the sheet discharging direction. The two overlapping sheets are then transferred from the first switchback conveying path SP1 to the collecting tray 29.

Figure 11A:
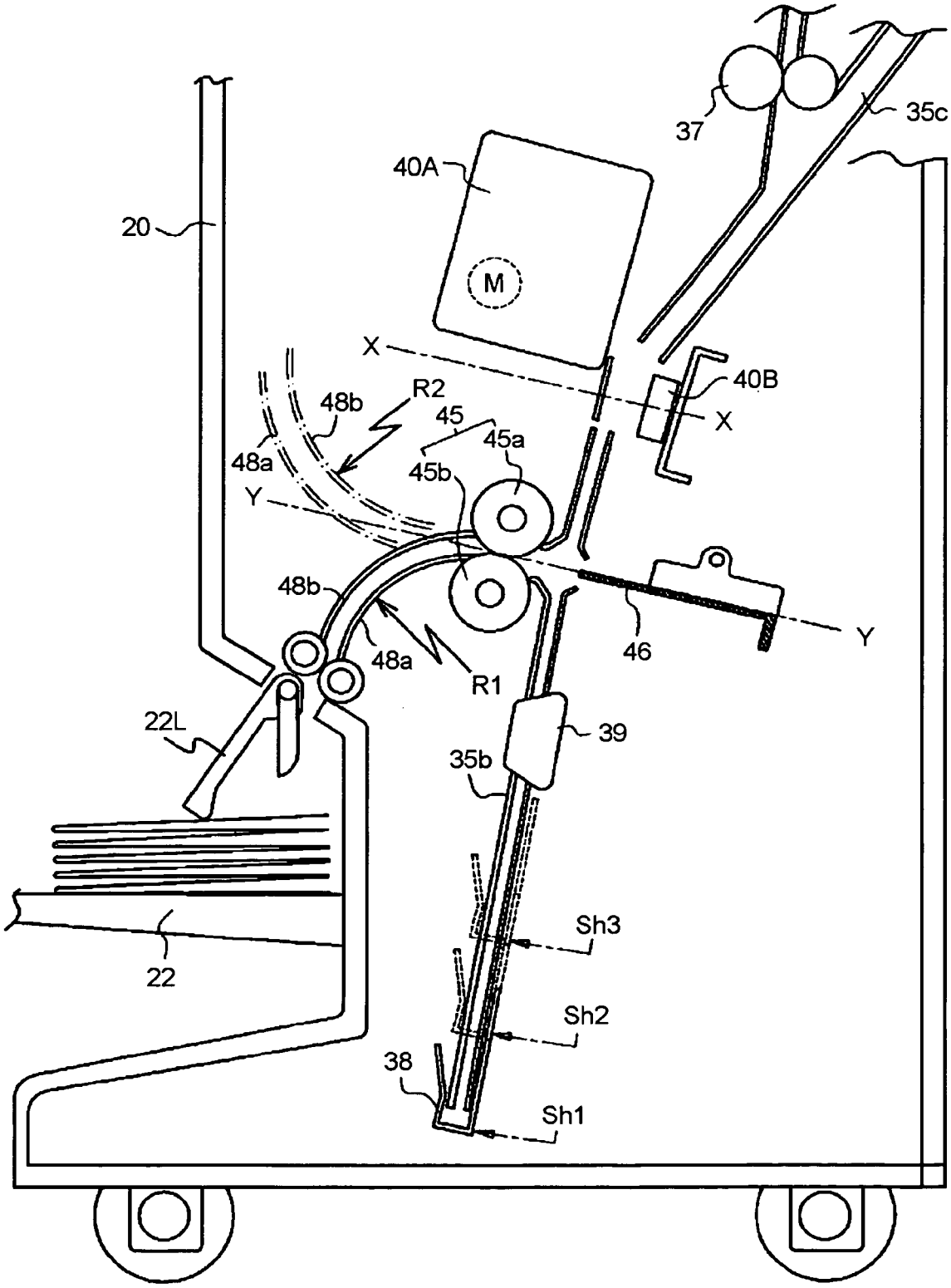
FIG. 11(*a*) is a diagram showing that a leading end of the sheet bunch is being carried out, to describe an operational state in which in the apparatus in FIG. 2, and the sheet bunch is carried out from the folding rolls to a carry-out guide.
Figure 11B:
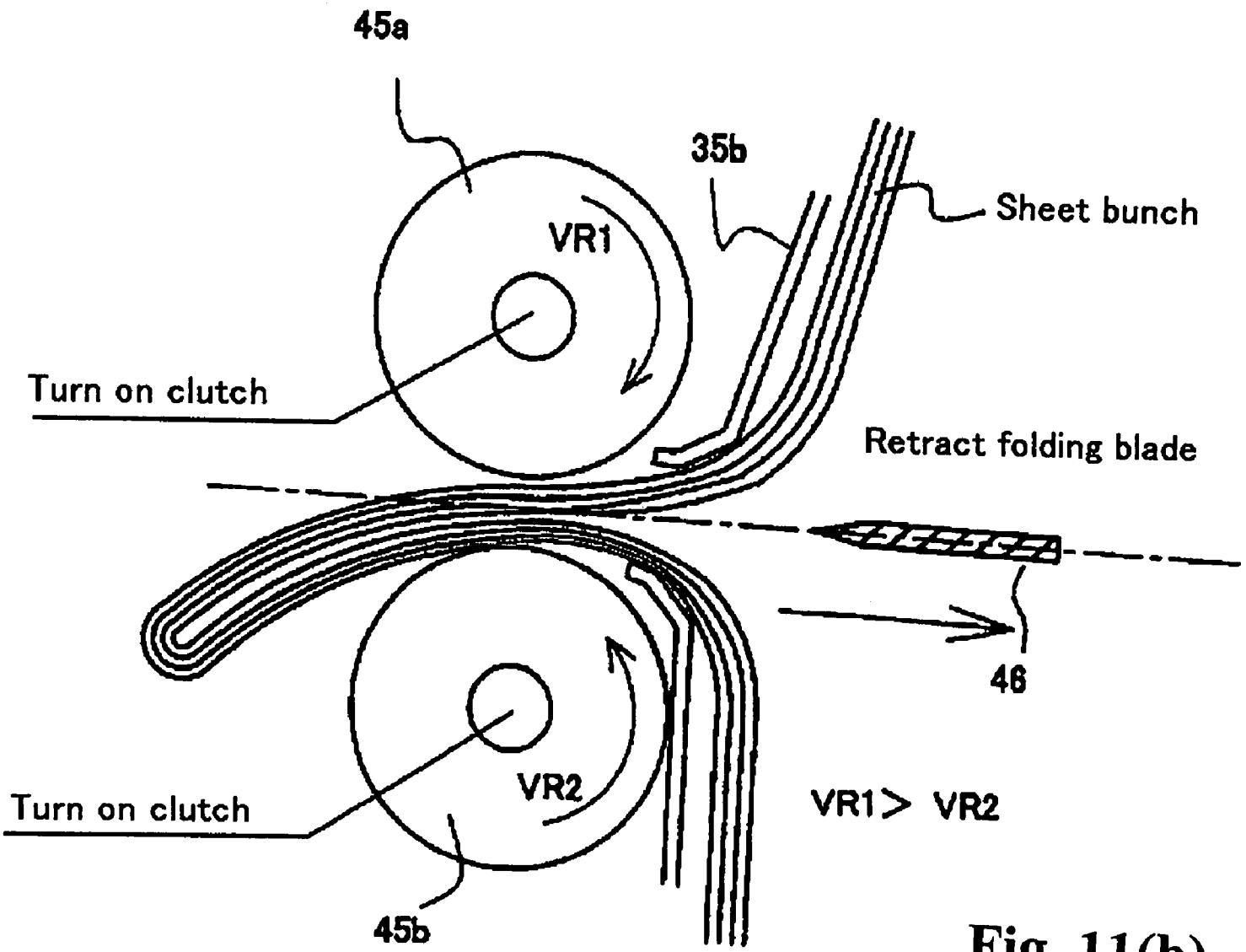
Figure 11C:
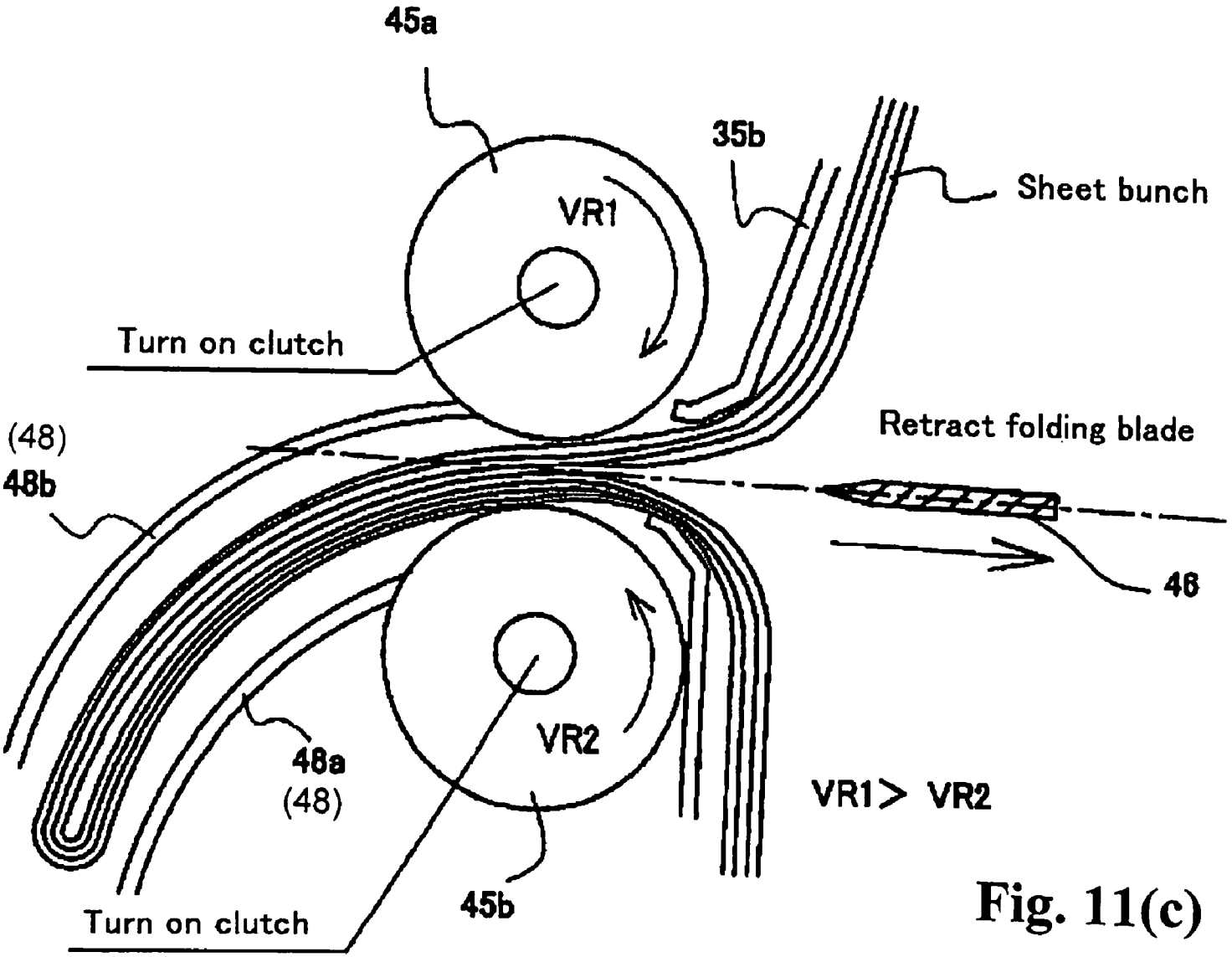

An embodiment of the present invention also allows at least two succeeding sheets to stand by temporarily on the switchback conveying path SP2. For example, if a trouble such as a jam occurs during the post-processing of the preceding sheet bunch on the collecting tray 29 and at least two succeeding sheets reside in the upstream image forming apparatus A or the like, at least two succeeding sheets need to stand by on the second switchback conveying path SP2. In this case, as described above, the conveyance control means 64*a* lays the second sheet SA2 on top of the first sheet SA1 with the sheet discharging rollers 25 separated from each other as shown in FIG. 11. The sheet discharging rollers 25 are then brought into pressure contact with each other with the sheets offset from each other by the predetermined amount ho. Then, the conveyance control means 64*a* moves the path switching piece 27 to the position shown in FIG. 11 and rotationally drives the sheet discharging roller 25 in a reverse direction (counterclockwise in FIG. 11). The first and second sheets SA1 and SA2 are then held on the conveying roller 36 on the second switchback conveying path SP2 so as to overlap like scales. Then, after the post-processing operation of the first processing section 29 is completed, the conveyance control means 64*a* drivingly rotates the conveying roller 36 and the sheet discharging roller 25 in the sheet discharging direction (clockwise in FIG. 11) to transfer the plurality of succeeding sheets standing by on the second switchback conveying path SP2, to the first switchback conveying path SP1. The sheets are then loaded and housed on the collecting tray 29.

As described above, the first sheet SA1 standing by on the second switchback conveying path SP2 is offset from the second sheet SA2 fed through the sheet carry-in path P1, by the predetermined amount ho, or the plurality of sheets, the first and second sheets SA1 and SA2, are arranged on the second switchback conveying path SP2 offset from each other like scales by the predetermined amount ho. This is because to allow the sheets to abut against the trailing end regulating member 32, located on the collecting tray 29, for alignment, the aligning means (the above-described caterpillar belt) 31 allow the sheets to sequentially abut against the trailing end regulating member 32 for alignment starting with the lowermost sheet. Thus, as shown in FIG. 12, the offset amount ho for the succeeding sheet is set to be greater than the distance z between the trailing end regulating member 32 and the contact point at which the caterpillar belt (aligning means) 31 contacts the sheets (ho>z). This operation allows the post-processing apparatus B to continuously execute the stapling process without the need to stop the image forming apparatus A.

In the sheet bunch folding finish mode, the image forming apparatus A forms images on sheets, for example, in the order described with reference to FIG. 5. The post-processing apparatus B finally forms the sheets into a booklet. The post-processing apparatus B then retracts the buffer guide 26 of the sheet carry-in path P1 upward as shown in FIG. 3 to move the path switching piece 27 as depicted by the solid line in FIG. 3. The sheet fed to the sheet carry-in path P1 is thus guided to the sheet discharging roller 25. The sheet sensor S1 detects the sheet trailing end and issues the corresponding signal. Then, on the basis of the signal, the control CPU 61, shown in FIG. 9, stops the sheet discharging roller 25 at the timing when the sheet trailing end passes through the path switching piece 27. Simultaneously, the control CPU 61 moves the path switching piece 27 to a position shown by a dashed line in FIG. 3. The sheet discharging roller 25 then reversely rotates the sheet discharging roller 25 (counterclockwise in FIG. 3). Then, the sheet having entered the sheet carry-in path P1 has the conveying direction thereof reversed and is guided to the second switchback conveying path SP2 via the path switching piece 27. The sheet is then guided to the collecting guide 35 by the conveying rollers 36 and 37, arranged on the second switchback conveying path SP2.

At the timing when the sheet is carried into the collecting guide 35 through the second switchback conveying path SP2, the control CPU 61 moves the leading end regulating member 38 to the lowermost Sh1 position. The whole sheets are then supported by the collecting guide 35. In this condition, the control CPU 61 operates the sheet side edge aligning member 39 to align the sheets (the alignment need not be performed for the first sheet or for every arrival of the sheet).

The control CPU 61 then moves the leading end regulating member 38, shown in FIG. 4, to the position Sh3, at which the sheet trailing end enters the switchback approaching path 35*a*, described above. The sheet trailing end supported on the collecting guide 35 moves backward to the switchback approaching path 35*a*. In this condition, the succeeding sheet is fed to the collecting guide 35 through the second switchback conveying path SP2 and stacked on the preceding sheet. When the succeeding sheet is carried in, the leading end regulating member 38 is moved from the position Sh3 to the position Sh1.

As previously described, the sheet side edge aligning member 39 is operated to align the carried-in sheet with the sheet supported on the collecting guide. This operation is repeated to allow the sheets with images formed thereon by the image forming apparatus A to be set on the collecting guide 35 via the second switchback conveying path SP2. Upon receiving the job end signal, the control CPU 61 moves the leading end regulating member 38 to the position Sh2 to align the sheet center with the staple position X for setting.

The control CPU 61 then operates the saddle stitching staple means 40 to staple the sheets at one position or a plurality of positions in the center thereof. In response to a completion signal for this operation, the control CPU 61 moves the leading end regulating member 38 to the position Sh1 and aligns the sheet center with the fold position Y for setting. The control CPU 61 then executes the folding process on the sheet bunch in accordance with the sequence shown in FIGS. 8(*a*) to 8(*d*), and further carries out the resultant sheet bunch to the sheet discharging tray 22.

Further, to continuously execute the sheet bunch folding finish process described above, the control CPU 61, shown in FIG. 9, temporarily holds the succeeding sheet on the sheet carry-in path P1. This sheet buffering operation will be described with reference to FIG. 11. As previously described, the sheet carry-in path P1 has the buffer guide 26, composed of a locking member that locks the sheet trailing end in a sheet standby section (area) formed above the sheet carry-in path P1 as shown in FIG. 11.

To continuously execute the sheet bunch folding process described above, the control CPU 61 temporarily holds the succeeding sheet fed to the sheet carry-in path P1, on the buffer guide 26. As previously described, the sheets are collected on the collecting guide 35 through the second switchback conveying path SP2, shown in FIG. 4. After the image forming job is finished, the saddle stitching staple means 40 executes the stapling process on the sheet bunch collected on the guide. After the stapling process, the folding blade 46 and the folding roll means 45 are actuated to fold the sheet bunch on the collecting guide 35 into a booklet, which is then carried out to the second sheet discharging tray 22.

If the succeeding sheet is carried in by the image forming apparatus A while the stapling operation and/or the sheet bunch folding operation is being performed on the sheet bunch on the collecting guide 35, the control CPU 61 uses the sheet sensor S1 to sense the succeeding sheet. At the time when the sheet trailing end is expected to pass through the buffer guide 26 of the sheet carry-in path P1, the control CPU 61 stops the sheet discharging roller 25. Simultaneously, the control CPU 61 moves the buffer guide 26 to the position shown in FIG. 11. The control CPU 61 subsequently reversely rotates the sheet discharging roller 25. The trailing end of the sheet on the sheet carry-in path P1 is then guided to the buffer guide 26. At the time when the sheet trailing end is expected to reach the buffer guide 26, the control CPU 61 stops the sheet discharging roller 35. The sheet on the sheet carry-in path P1 is then stopped with the trailing end thereof locked by the buffer guide 26.

After the sheet bunch on the collecting guide 35 is discharged to the second sheet discharging tray 22, the succeeding sheet is carried in by the image forming apparatus A and laid on top of the residing (standby) sheet. At this timing, the control CPU 61 rotates the sheet discharging roller 25 clockwise in FIG. 11 and simultaneously moves the buffer guide 26 to a position shown by a dashed line in the figure. The sheets overlapping in the vertical direction are fed downstream by the sheet discharging roller 25. The sheet discharging roller 25 is then reversely rotated to guide the sheets to the second switchback conveying path SP2. The sheets overlapping in the vertical direction are then guided to the collecting guide 35 and aligned with each other in order and in the vertical direction. Sheets succeeding the sheets overlapping in the vertical direction are sequentially loaded and housed on the collecting guide 35 via the sheet carry-in path P1 and the second switchback conveying path SP2. This operation allows the post-processing apparatus B to continuously execute the sheet bunch folding process without the need to stop the image forming apparatus A. Preferably, for the sheet overlapping, as shown in FIG. 11, the sheet discharging roller 25 is composed of a pair of rollers that can freely come into pressure contact with each other and leave each other. To lay the succeeding sheet from the carry-in port 23 on top of the sheet standing by on the sheet discharging roller 25, the sheet discharging rollers 25 are preferably separated from each other by the actuating means such as an electromagnetic solenoid.

According to an embodiment of the present invention, as described above, the first and second switchback conveying paths SP1 and SP2 are arranged on the sheet carry-in path P1 so as to lie at a distance from each other in the vertical direction. The collecting tray 29 is located on the first switchback conveying path SP1 so that the stapling process can be executed on the collecting tray 29. The collecting guide 35 is located on the second switchback conveying path SP2 so that the bunch folding process can be executed on the sheets on the collecting guide 35. Thus, if the stapling finish operation and the bunch folding finish operation are to be consecutively performed, the succeeding post-processing can be executed without the need to wait for the preceding post-process to be finished. Furthermore, even if a trouble such as a jam occurs during the execution of the preceding post-processing, the sheet residing in the system for the succeeding post-processing can be conveyed to the position of the succeeding post-processing.

Further, the saddle stitching staple means 40 is located at the staple position X on the collecting guide 35. However, the sheet processing path may extend through the collecting guide, the staple position, and the fold position respectively, and the collecting guide means may be followed by the staple device, with the sheet folding means located downstream of the staple device. Moreover, the sheet bunch may be folded and then carried out onto the second sheet discharging tray 22 without being stapled by the staple means.

Alternatively, a third sheet discharging tray 21*b* may be provided as shown in FIG. 1 so that the sheet carried into the sheet carry-in path P1 can be carried out onto the third sheet discharging tray 21*b*. This configuration allows the sheet to be carried out to a position different from those of the first and second switchback paths, for example, to the exterior of the apparatus.

In the above-described embodiment, the end surface staple means 33 for stapling the sheets at the edge and saddle stitching staple means 40 are arranged in the vertical direction in the space surrounded by the sheet carry-in path P1, the first switchback conveying path SP1, and the second switchback conveying path SP2. Therefore the apparatus is compact.

Now, with reference to FIGS. 10(*a*) to 10(*e*), description will be given of how the sheets are folded by the folding roll means 45 and the folding blade 46. The sheet bunch supported on a curved guide section 35*b* as shown in FIG. 10(*a*) is locked by the sheet leading end regulating means 38, the sheet bunch stapled at the fold line position thereof is placed at the fold position Y. At this time, the sheet bunch is supported so as to roll back and project toward the folding roll. The folding blade 46 is at a standby position Wp (home position). The first roll 45*a* is at a retract position located away from the second folding roll 45*b* (as shown in FIG. 12(*a*)).

The driving control means (which corresponds to a sheet folding operation control section described below; this also applies to the description below) 64*d* obtains a sheet bunch set end signal to actuate the blade driving motor M7. The folding blade 46 then moves from the standby position Wp to a nip position Np corresponding to a state shown in FIG. 12(*b*). The movement of the folding blade 46 separates a cam member 42 from a bracket 44 and brings the first roll 45*a* into pressure contact with the second roll 45*b* (as shown in FIG. 10(*b*)). Simultaneously with the actuation of the blade driving motor M7, the driving control means 64*d* turns off the clutch means 45*c*. With the configuration of the one-way clutch described above, the roll driving motor M6 is stopped or rotated at a speed lower than the moving speed of the folding blade 46. This is because the sheet bunch inserted to the nip position by the folding blade 46 sets conditions for rotating the first and second rolls 45*a* and 45*b* in conjunction with the sheet bunch.

The driving control means 64*d* moves the folding blade 46 from the standby position toward the nip position at a predetermined speed. The rotating peripheral speed VR of the rolls 45*a* and 45*b* is set at zero or lower than the moving speed VB (VB>VR). Thus, as shown in FIG. 10(*b*), the sheet bunch is bent at the fold line position. The bent sheet bunch is then inserted between the rolls. When the sheet bunch is inserted to the position NP between the roll nips as shown in FIG. 10(*c*), the first roll 45*a* and the second roll 45*b* rotate in conjunction with the sheets moved by the folding blade 46. At the time when the sheet bunch is expected to reach the predetermined nip position, the driving control means 64*d* stops the blade driving motor M7 to bring the folding blade 46 to rest at a position shown in FIG. 10(*d*).

The driving control means 64*d* then switches on the clutch means 45*c* to drivingly rotate the rolls 45*a* and 45*b*. The sheet bunch is then fed in the delivery direction (leftward in FIG. 10). The driving control means 64*d* subsequently delivers the sheets to a sheet discharging roller 43 while the sheet bunch is being delivered by the folding rolls 45*a* and 45*b*, as shown in FIG. 10(*e*). The driving control means 64*d* then returns the folding blade 46 from the nip position NP to the standby position Wp.

When the folding blade 46 returns to the standby position Wp, cam shift means (rack gear) 46S rotates a fan-shaped gear 42*g* in conjunction with the cam shift means 46S to allow the cam member 42 to swing the bracket 44 upward. The movement of the bracket 44 to the retract position allows the roll 45*a*, attached to the bracket 44, separates from the second roll 45*b* (as shown in FIG. 8(*e*)). The sheet bunch is thus carried out to the second sheet discharging tray 22 by the sheet discharging roller 43, located downstream of the folding roll means 45. At this time, the trailing end of the sheets (bunch) is prevented from being subjected to rucking or image rubbing by the rolls 45*a* and 45*b*.

Figure 13:
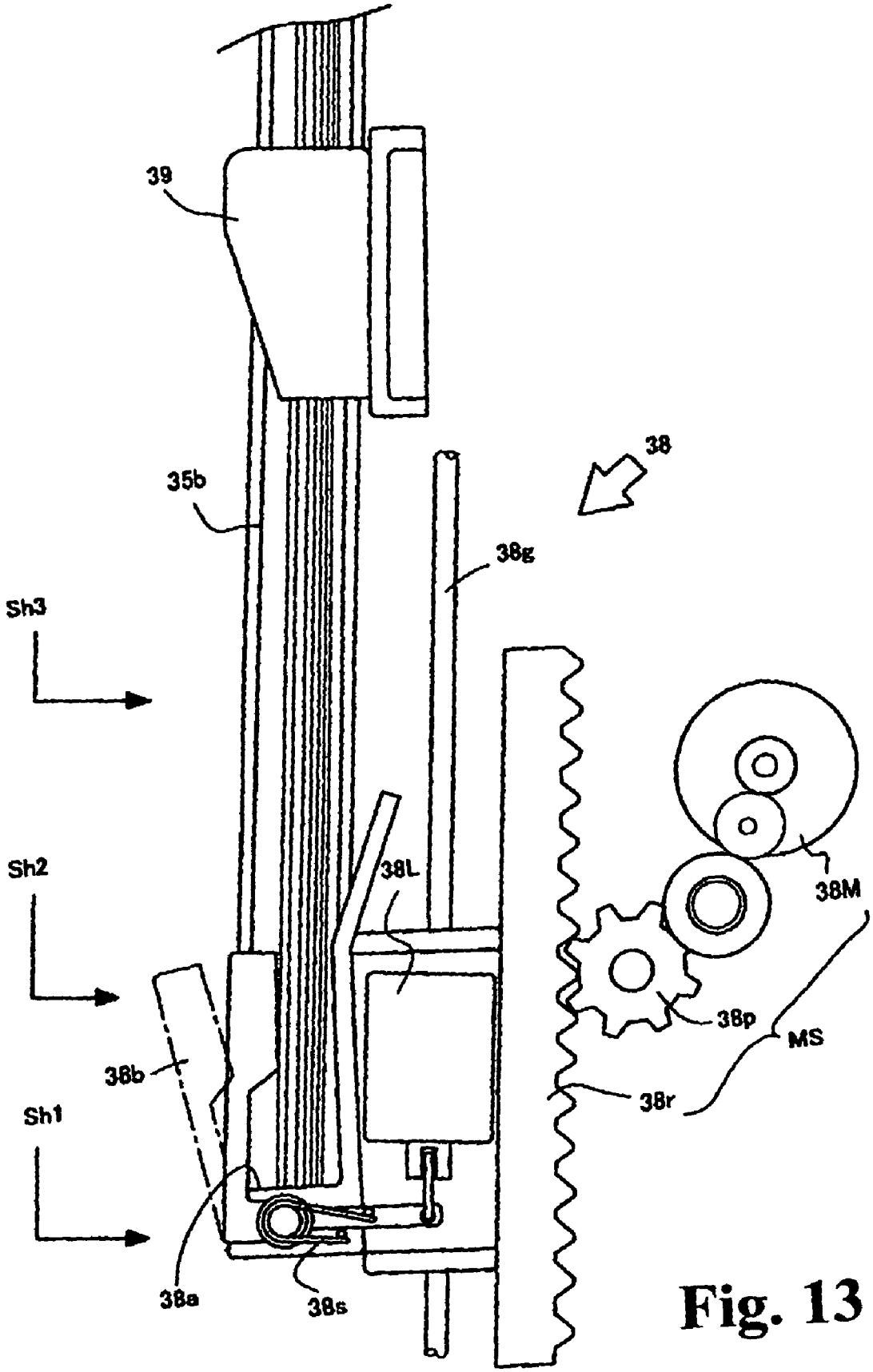
FIG. 13 is a diagram illustrating the configuration of sheet leading end regulating means of the device in FIG. 4.
Figure 14A:
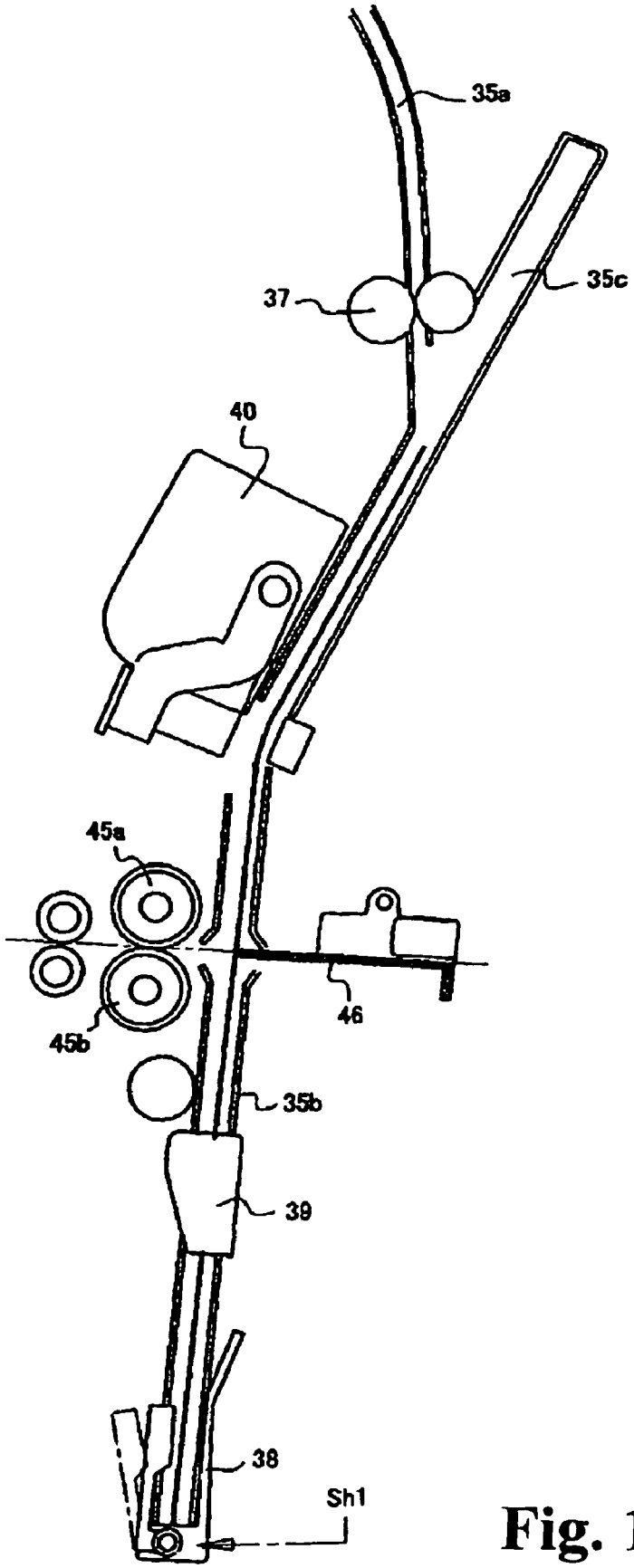
FIG. 14(*a*) is a diagram illustrating an operating state of the sheet leading end regulating means in the device in FIG. 4 and showing that the first sheet reaches a collecting guide.
Figure 14B:
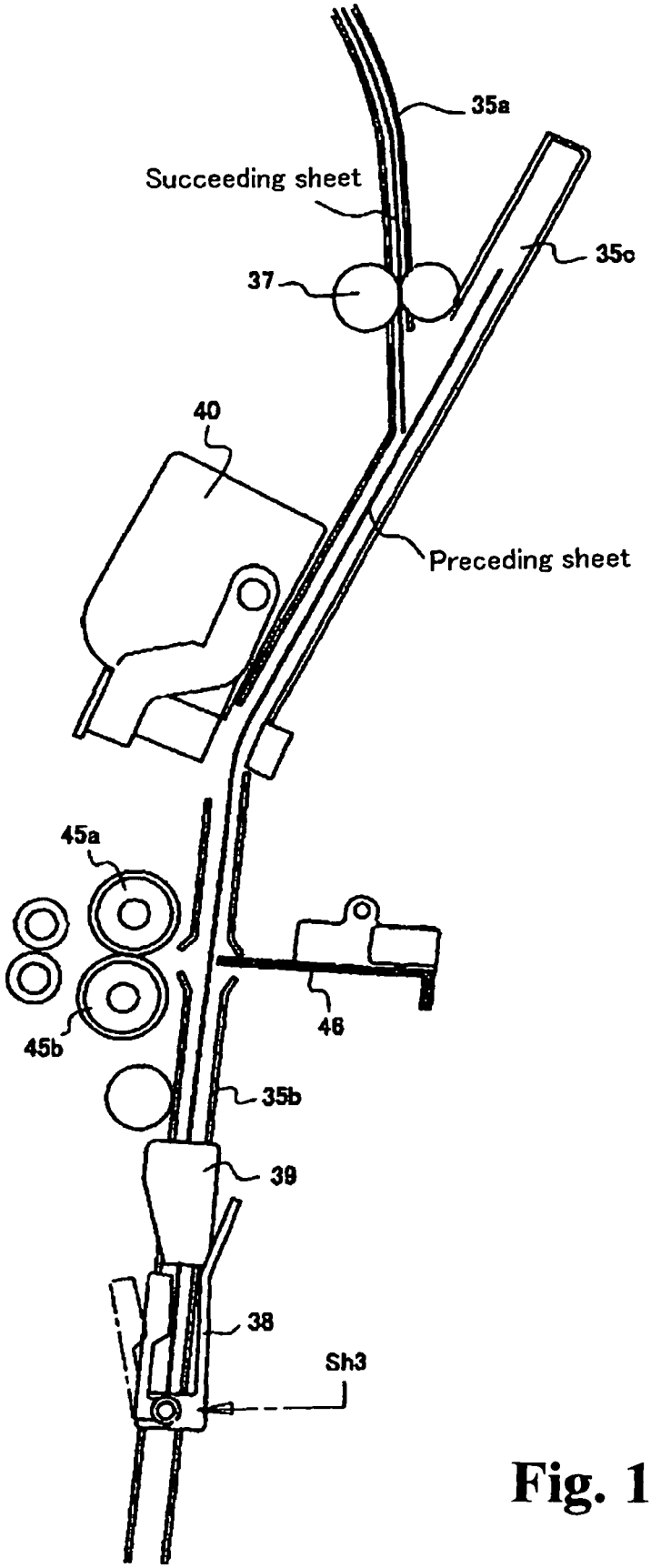
Figure 14C:
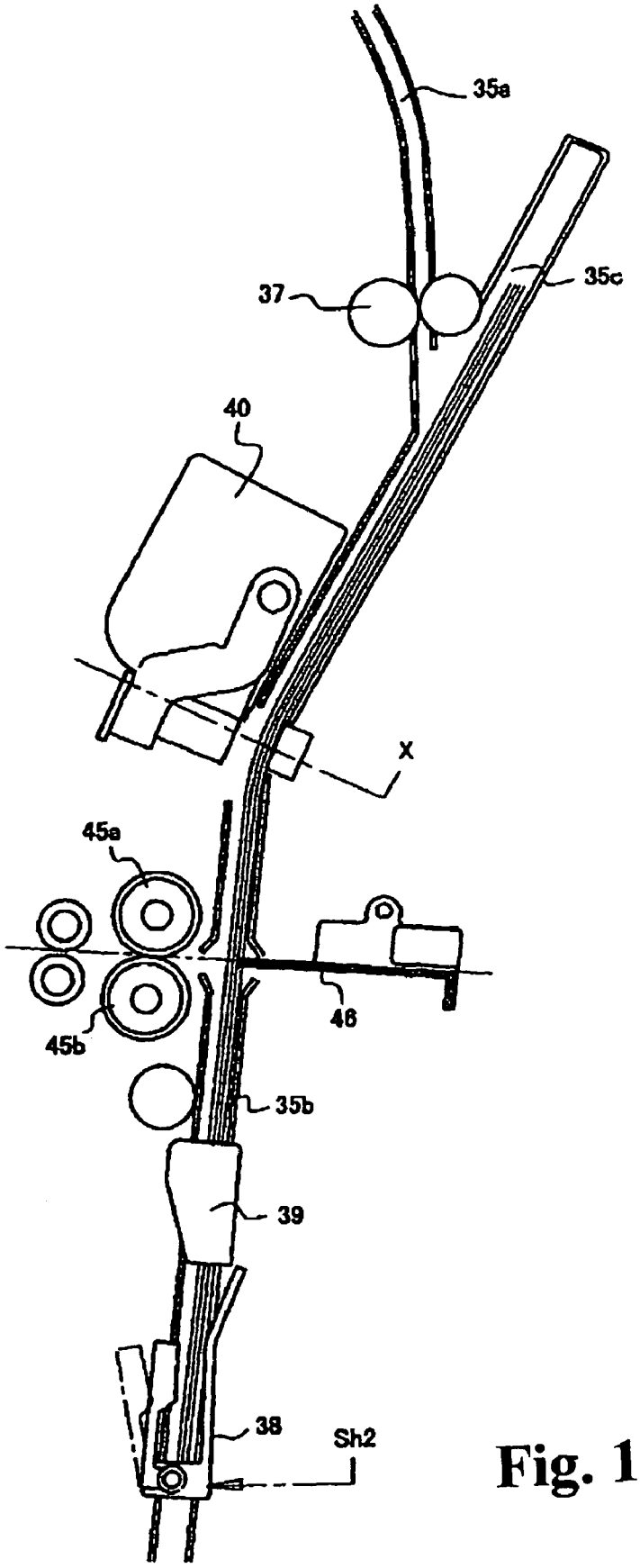
Figure 14D:
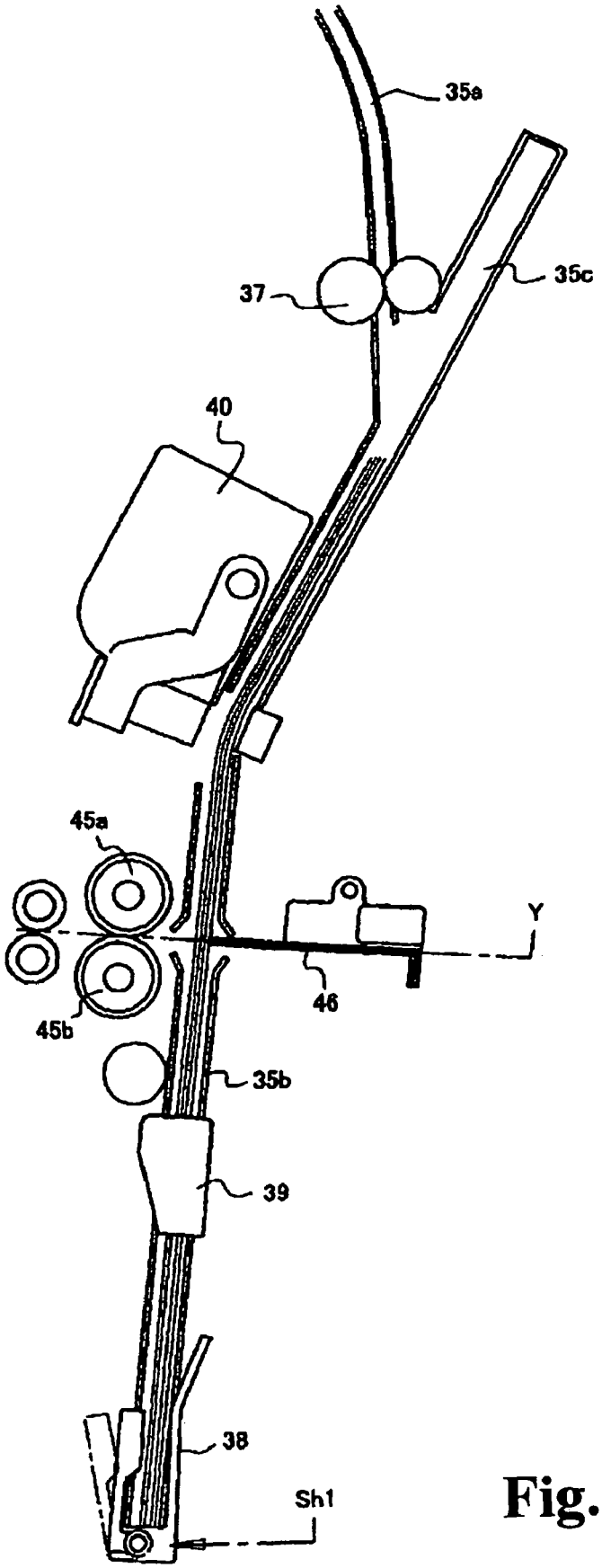

Now, the sheet leading end regulating means 38 will be described with reference to FIG. 13. As shown in FIG. 13, the sheet leading end regulating means 38 is composed of a locking member 38*a* that locks the leading end of the sheets carried in along the curved guide section 35*b* and a grip member 38*b* that grips the sheet bunch loaded and supported on the locking member 38*a*. The sheet leading end regulating means 38 is supported on a guide rail 38*g* so as to be movable along the curved guide section 35*b*. The grip member 38*b* is supported on the locking member 38*a* via a shaft to nip the sheets supported on the locking member 38*a*. A bias spring 38*s* and an actuating solenoid 38L are coupled to the grip member 38*b*. The bias spring 38*s* always acts in a sheets ungripping direction. The grip member 38*b* grips the sheets when the actuating solenoid 38L is energized.

The sheet leading end regulating means 38 configured as described above is configured so that the position of the sheet leading end regulating means 38 can be moved between Sh1 and Sh2 and Sh3. Shift means MS is composed a stepping motor 38M, a pinion 38*p* coupled to the motor 38M, and a rack gear 38*r* formed integrally with the sheet leading end regulating means 38. The shift means MS is configured to rotationally drive the stepping motor 38M by a predetermined amount in response to a sensing signal from the home position sensor to move the sheet leading end regulating means 38 between Sh1 and Sh2 and Sh3. The grip member 38*b* turns on and off the actuating solenoid 38L to grip the sheet bunch collected on the curved guide section 35*b*. In this case, to move the sheet leading end regulating means 38 from upstream side to downstream side (Sh3→Sh1 or the like), control is performed such that the actuating solenoid 38L is turned on to grip the sheet bunch. As shown in the figure, the locking member 38*a*, which supports the sheet leading end, is integrated with the grip member 38*b*, which grips the sheet bunch supported on the locking member 38*a*. However, the locking member 38*a* and the grip member 38*b* may be separately and individually mounted on the apparatus frame.

The shift means MS moves the position of the sheet leading end regulating means 38 at least between the illustrated positions Sh1 and Sh2 and Sh3. When the sheets are to enter the curved guide section 35*b* through the sheet approaching path 35*a*, the sheet leading end regulating means 38 is moved to the illustrated position Sh3 so as to move the sheet trailing end back to the switchback approaching path 35*c*. When the sheets are to be stapled by the saddle stitching staple device 40, the sheet leading end regulating means 38 is moved to the illustrated position Sh2 so as to place the sheets supported on the collecting guide 35, at the staple position X. When the sheets are to be folded together by the folding roll means, the sheet leading end regulating means 38 is moved to the illustrated position Sh1 so as to place the sheets supported on the collecting guide 35, at the fold position Y.

That is, when the sheet leading end regulating means 38 is placed at the illustrated position Sh3, then as shown in FIG. 14(*b*), the trailing end of the sheets (bunch) supported on the collecting guide 35 reaches the switchback approaching path 35*c*. In this condition, the succeeding sheet fed through the sheet approaching path 35*a* is reliably stacked on the collected sheets. When the sheet leading end regulating means 38 is placed at the illustrated position Sh2, then as shown in FIG. 14(*c*), the center of the sheets (bunch) supported on the collecting guide 35 is placed at the staple position X on the saddle stitching staple device 40. Similarly, when the sheet leading end regulating means 38 is placed at the illustrated position Sh1, then as shown in FIG. 14(*d*), the center of the sheets (bunch) supported on the collecting guide 35 is placed at the fold position Y on the folding roll means 45. Accordingly, the illustrated positions Sh1, Sh2, and Sh3 are set at the optimum positions depending on the sheet size (the length in the conveying direction). These positions are prestored in a memory table or the like.

The curved guide portion 35*b* has the sheet side edge aligning means 39 located downstream in the sheet conveying direction. The sheet side edge aligning means 39 aligns, with a reference, the widthwise position of the sheets carried into the curved guide section 35*b* and supported on the sheet leading end regulating means 38. That is, with the sheet leading end regulating means 38 placed at the position Sh3 and the whole sheets supported on the collecting guide 35, the side edges of the sheets are aligned with the pair of aligning plates (sheet side edge aligning means) 39. Since the illustrated device aligns the sheets using the center thereof as a reference, the sheet side edge aligning member 39 is composed of the lateral pair of aligning plates, the aligning plates are arranged at an equal distance from the sheet center as a reference to align the sheet bunch supported on the collecting guide 35. Thus, the sheet side edge aligning member 39 is coupled to the aligning motor M5 (not shown).

That is, the sheet side edge aligning means 39 is composed of the pair of aligning plates engaging the sheet side edges and the actuating means (aligning motor M5, described above) for allowing the aligning plates to approach and leave each other. The aligning motor M5 allows the paired aligning plates to approach and leave each other so as to align the sheets, while the sheet leading end regulating means 38 is regulating the position of the sheets supported on the collecting guide 35, to the sheet staple position X or the fold position Y.

Now, the configuration of blade driving means BM of the folding blade 46 will be described with reference to FIG. 7(*d*). As shown in FIG. 7(*d*), the folding blade 46 is supported on the apparatus frame so as to be movable along the guide rail 46*g* in the sheet folding direction. The folding blade 46 is supported so as to be able to reciprocate between the standby position Wp, where the folding blade 46 retracts from the sheets supported on the curved guide section 35*b*, and the nip position Np on the rolls 45*a* and 45*b*. The blade driving means BM, which reciprocates the folding blade 46, is composed of the blade driving motor M7 and the transmission means 46V, which transmits the rotation of the blade driving motor M7. The illustrated blade driving means BM transmits the rotation to the transmission rotating shaft 46X via a transmission belt. The transmission rotating shaft 46X has a transmission pinion 46*p* that meshes with the rack gear 46L, attached integrally to the folding blade 46.

Consequently, rotating the blade driving motor M7 forward and backward allows the folding blade 46 to reciprocate between the standby position Wp and the nip position Np along the guide rail 46*g*. The folding blade 46 is composed of a plate-like member having a knife edge in the sheet width direction. The leading end of the folding blade 46 is shaped so as to have recesses and protrusions as shown in the figure. As described above, the cam shift means (rack gear) 46S is integrally attached to the folding blade 46, which reciprocates between the standby position Wp and the nip position Np.

Now, with reference to FIGS. 12(*a*) to 12(*c*), description will be given of the interlocking between the first folding roll 45*a* and the folding blade 46, which are interlocked via the cam member 42 and the cam shift means 46S. FIG. 12(*a*) shows that the folding blade 46 is at the standby position Wp. FIG. 12(*b*) shows an initial operation of inserting the sheet bunch between the rolls. FIG. 12(*c*) shows that the folding blade means is at the nip position. When the folding blade 46 is at the standby position Wp, the cam shaft means 46S moves the cam member 42 to the illustrated position. The bracket 44 is at an elevated position, and the first roll 45*a*, attached to the bracket 44, is shifted away from the second roll 45*b*. In this condition, as described below, the first roll 45*a* retracts from the sheet bunch sandwiched between the rolls as described below. When the folding blade 46 moves from the standby position Wp toward the nip position Np, the cam member 42 is rotated clockwise in FIG. 12 via the fan-shaped gear 42*g* to lower the bracket 44.

This brings the first roll 45*a* into pressure contact with the second roll 45*b* by the force of the bias spring 45*a*S. Moreover, when the folding blade 46 moves to the nip position Np, the cam member 42 rotates clockwise at a position located away from the bracket 44. The first roll 45*a* is kept in pressure contact with the second roll 45*b*. Consequently, when the folding blade means inserts the sheets between the nips of the paired folding rolls, the sheets are brought into pressure contact with one another by a predetermined pressure contact force to form a fold line. When the sheets with the fold line formed thereon are carried out from the folding roller, the pressure contact force is reduced or released to carry out the sheets downward after the sheets have been delivered to the sheet discharging roller 43.

Now, with reference to FIGS. 11(*a*) and 11(*c*), description will be given of how the rolls 45*a* and 45*b* discharge the sheets in conformity to the curvature of a carry-out guide 48. As shown in FIGS. 11(*a*) and 11(*c*), if the carry-out guide 48 is curved, then to set different feeding amounts for the first and second rolls 45*a* and 45*b* to allow the sheets to be discharged in conformity to the curvature of the carry-out guide 48, at least two methods are set forth, in that, (1) the peripheral speed of the folding roll inside the curvature is set lower than that of the folding roll outside the curvature as previously described or (2) the rotation speed of the folding roll inside the curvature is set lower than that of the folding roll outside the curvature.

The method (1) will be described. The rolls 45*a* and 45*b* are rotationally driven so that the peripheral speed of the roll 45*a* or 45*b* positioned inside the carry-out guide 48 in the curving direction is lower than that of the roll 45*a* or 45*b* positioned outside the carry-out guide 48 in the curving direction. That is, in the first embodiment (shown by a solid line in FIG. 11(*a*)), rotational control is performed such that in FIG. 4, the peripheral speed of the second roll 45*b* positioned inside in the curving direction is lower than that of the first roll 45*a* positioned outside in the curving direction. Likewise, in the second embodiment (shown by a chain line in FIG. 11(*a*)), rotational control is performed such that in FIG. 4, the peripheral speed of the first roll 45*a* positioned inside in the curving direction is lower than that of the second folding roll 45*b* positioned outside in the curving direction.

Now, the method (2) will be described. To carry out the folded sheets, the driving control means, described below, intermittently rotationally drives the folding roll positioned inside in the curving direction, while continuously rotationally driving the folding roll positioned outside in the curving direction. Alternatively, the driving control means intermittently rotationally drives the first and second rolls 45*a* and 45*b* with intermittent driving length (time) set shorter for the inside roll than for the outside roll.

As shown in FIGS. 10(*b*) and 10(*c*), the above-described control naturally curves the layered sheet bunch fed from between the paired rolls 45*a* and 45*b*, as a result of the difference in feeding amount between the inside roll and the outside roll (the difference in speed or conveying amount). Settings are made such that the curvature of the sheet bunch resulting from the difference in feeding amount (the difference in speed or conveying amount) conforms to the curvature of the carry-out guide 48. This enables a significant reduction in the conveying load of the sheet bunch carried out along the carry-out guide 48.

A supplementary description will be given of the configuration of the sheet carry-in guide 37 with reference to FIG. 15. As described above, the sheet carry-in guide 37' is provided at a sheet discharging port 36*a* of the second switchback conveying path P2 in order to stack the sheet carried out of the sheet discharging port 36*a* on the sheets supported on the collecting guide 35. The carry-in guide 37' guides the sheet leading end onto the sheets collected on the collecting guide 35. After the carry-in guide 37' guides the sheet leading end onto the collecting guide 35 and the sheet is carried in, the carry-in guide 37' pivots above the collecting guide 35 in order to move to above the carried-in sheet to provide for the carry-in of the succeeding sheet. Description will be given below of embodiments of the carry-in guide 37', which guides the leading end of the sheet from the sheet discharging port 36*a* to above the collecting guide 35 and which, after the sheet is carried in, returns to above the carried-in sheet.

Figure 15A:
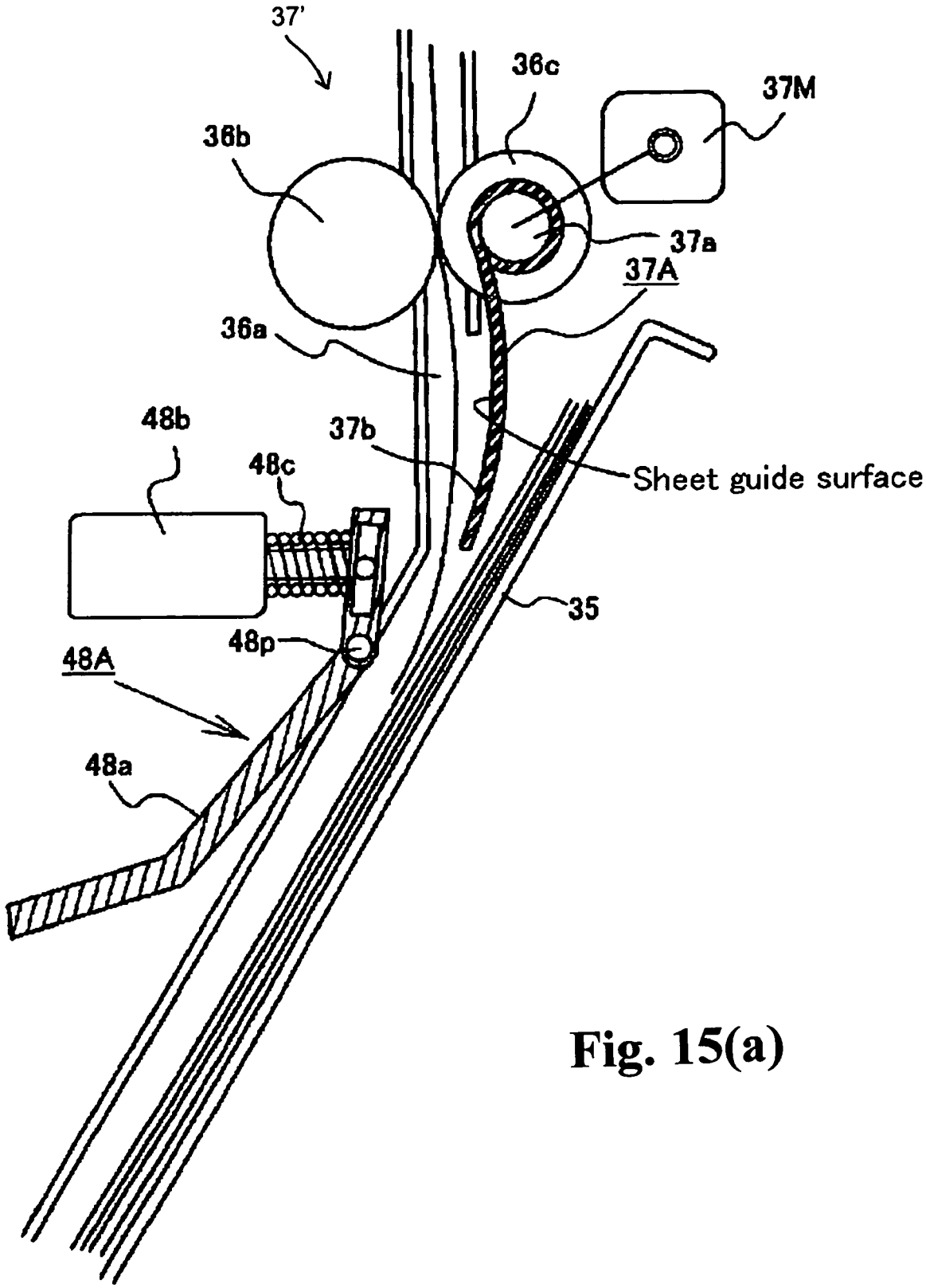
FIG. 15(*a*) is a diagram illustrating the configuration of a sheet carry-in guide and pressurizing means in the apparatus in FIG. 2 and showing an initial state.
Figure 15B:
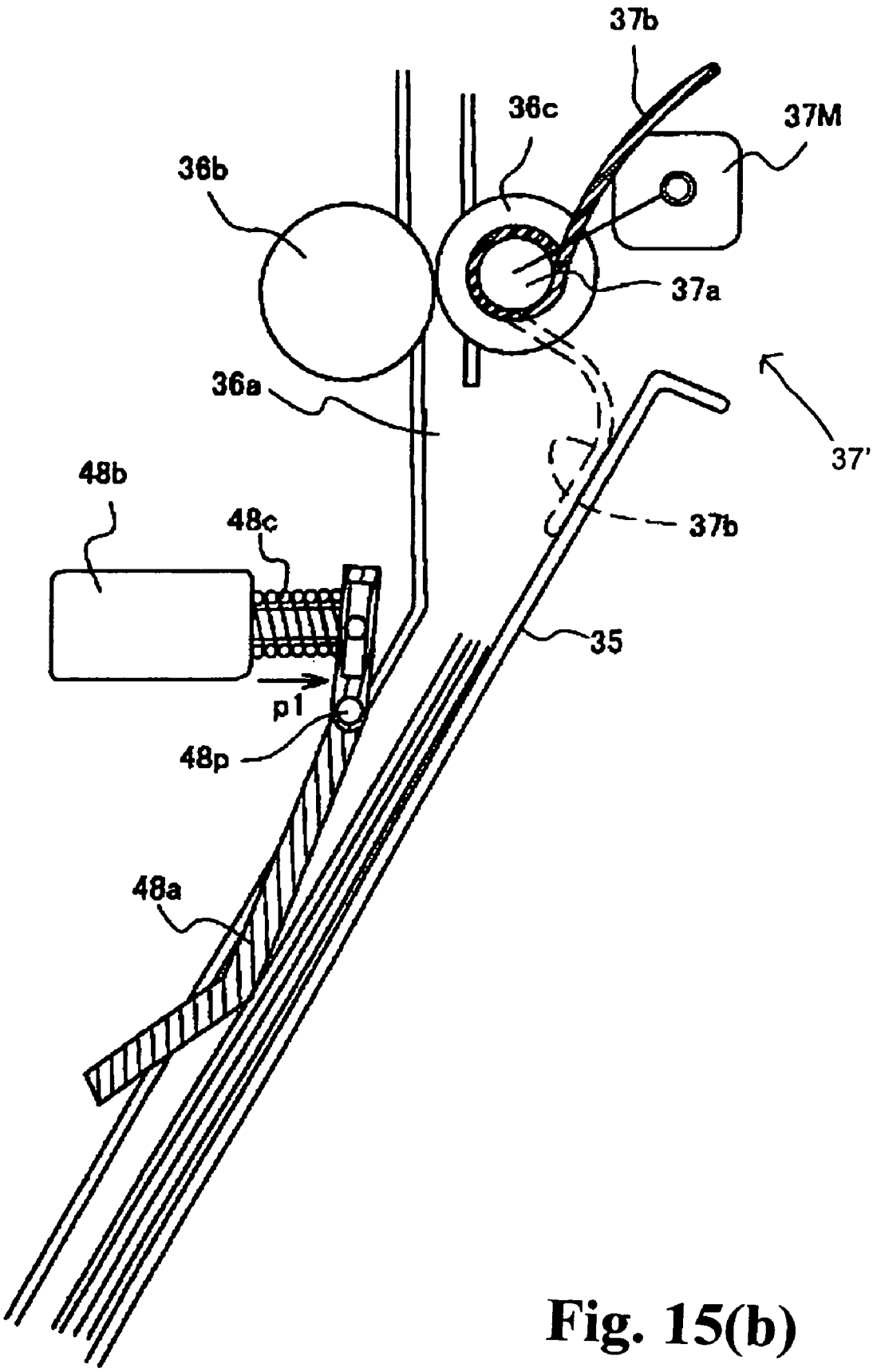

FIGS. 15(*a*) and 15(*b*) show a first embodiment of the carry-in guide 37'. The illustrated carry-in guide 37' is composed of an elastically deformable elastic guide piece 37A (hereinafter referred to as a "paddle piece"). The elastic guide piece 37A is composed of a flexible material such as a synthetic resin or rubber. A base end 37*a* is pivotably supported via a shaft in the vicinity of the sheet discharging port 36*a*. A leading end 37*b* is configured like a tongue hanging from the sheet discharging port 36*a* onto the collecting guide 35. The base end 37*a* of the elastic guide piece 37A is coupled to the driving motor 37M (driving means). The elastic guide piece 37A is thus configured to lie above the uppermost sheet on the collecting guide 35 to guide the sheet from the sheet discharging port 36*a* as shown in FIG. 15(*a*) and to be elastically deformed to pass over the collecting guide 35 and return onto the uppermost sheet on the collecting guide 35 as shown in FIG. 15(*b*).

Figure 16A:
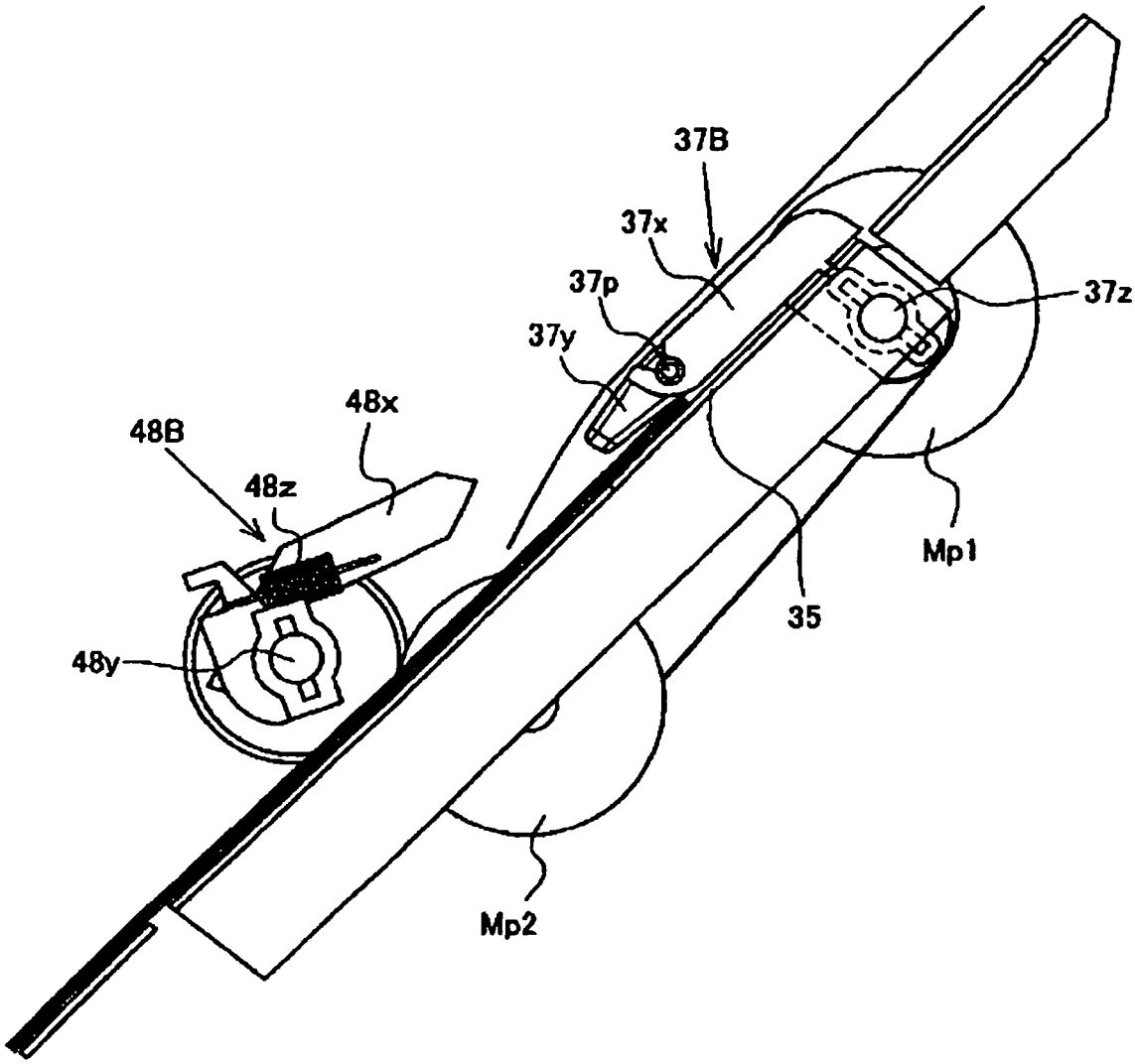
FIG. 16(*a*) is a diagram illustrating the configuration of a sheet carry-in guide and pressurizing means having forms different from those in FIG. 15.
Figure 16B:
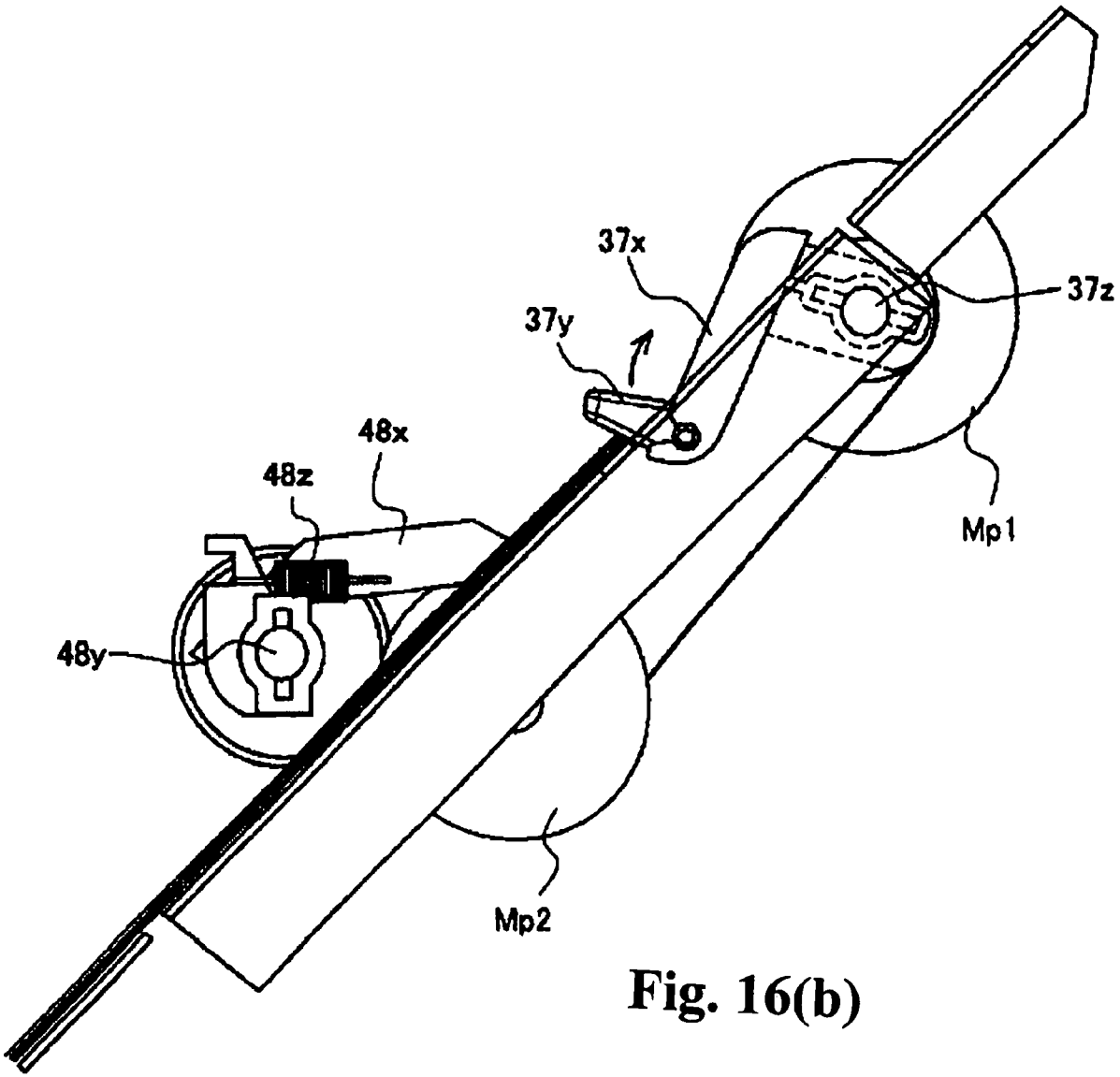
Figure 17:
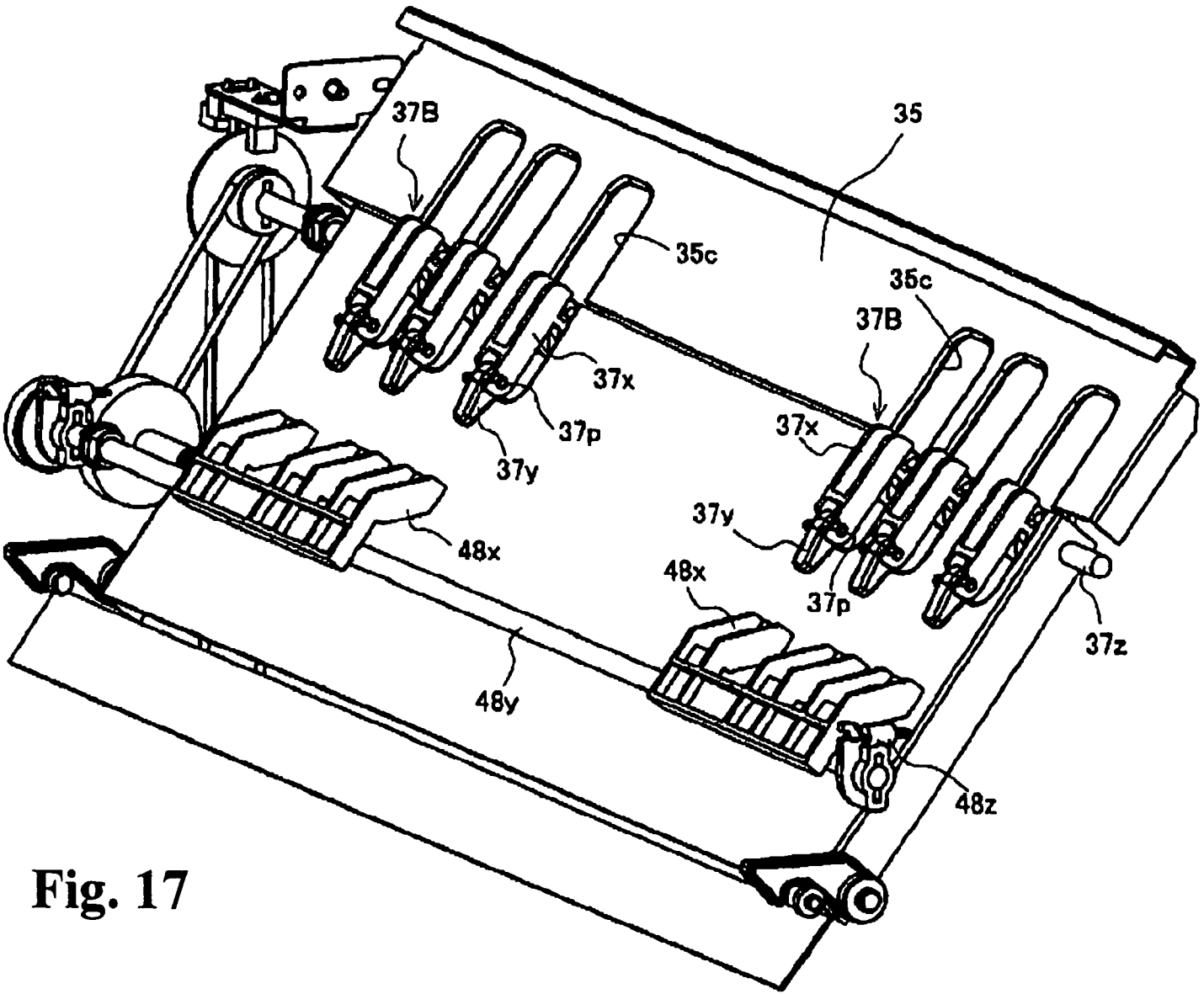
FIG. 17 is a perspective view illustrating the sheet carry-in guide and the pressurizing means in FIG. 16.
Figure 18A:
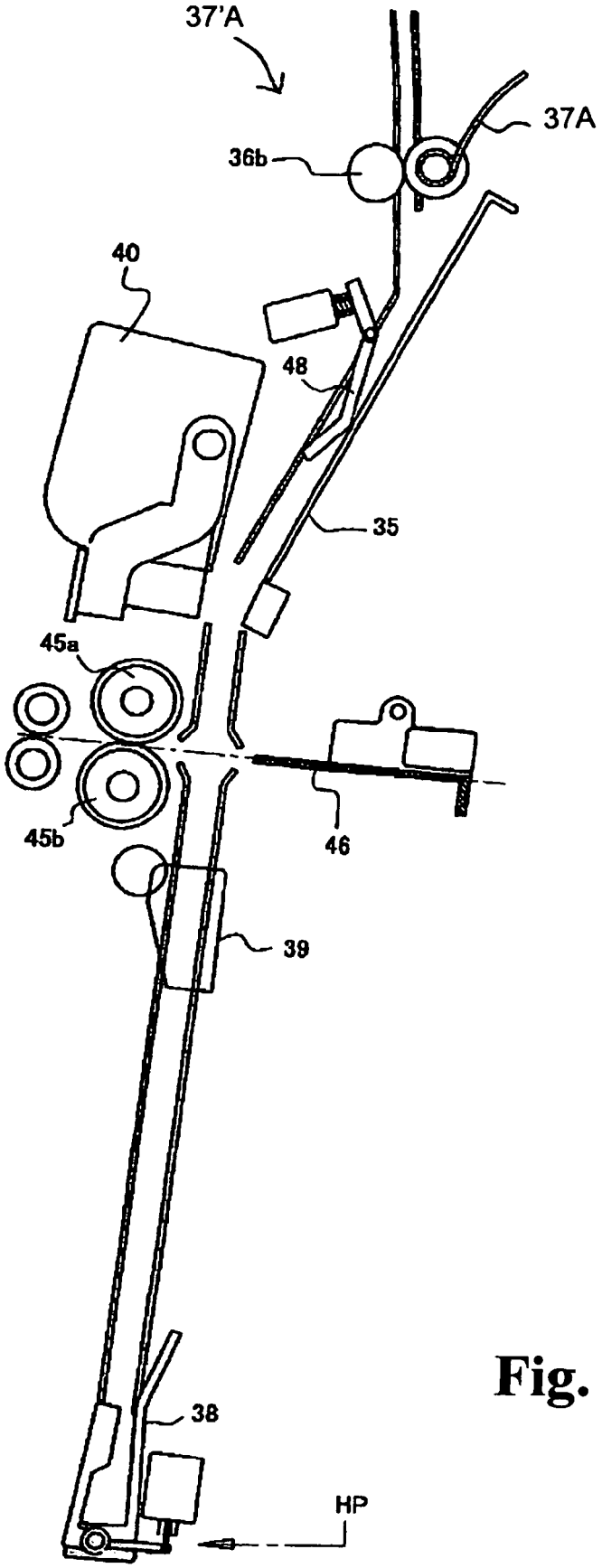
FIG. 18(*a*) is a diagram illustrating a sheet post-processing operation performed by the apparatus in FIG. 2 and showing an initial state.
Figure 18B:
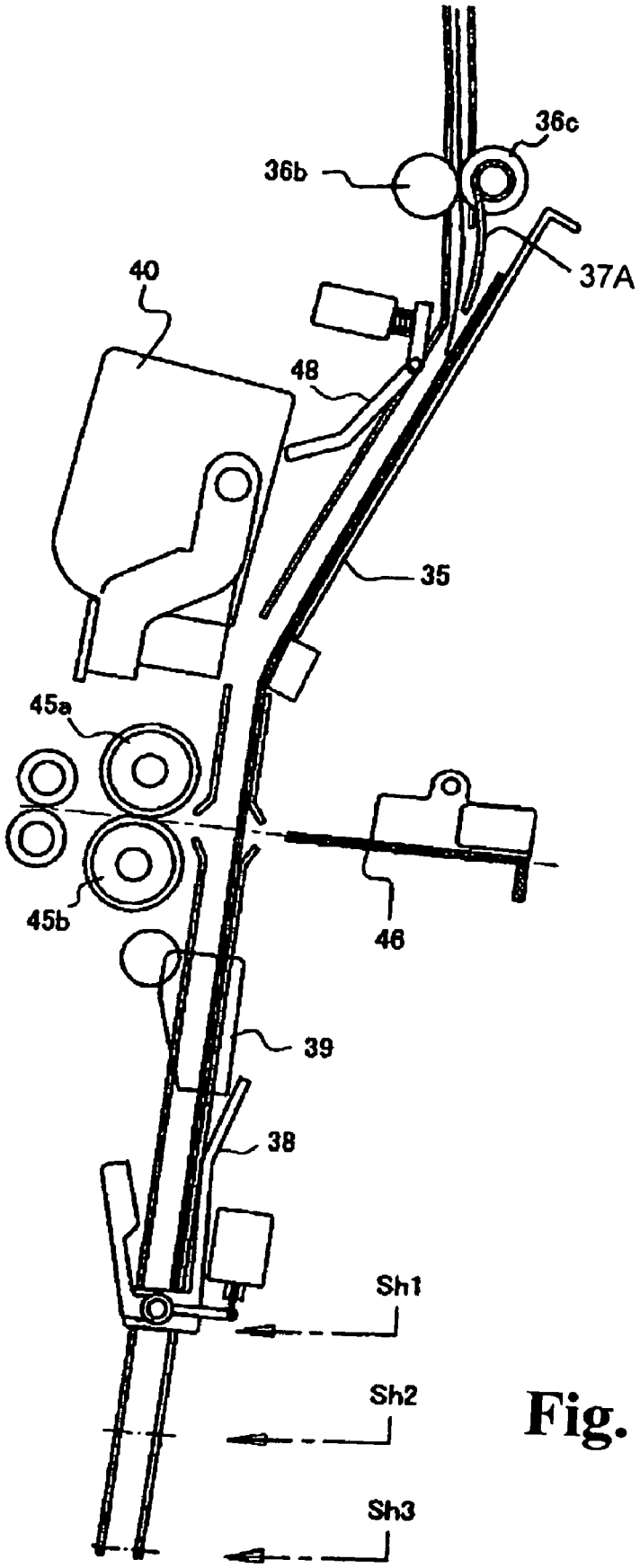
Figure 18C:
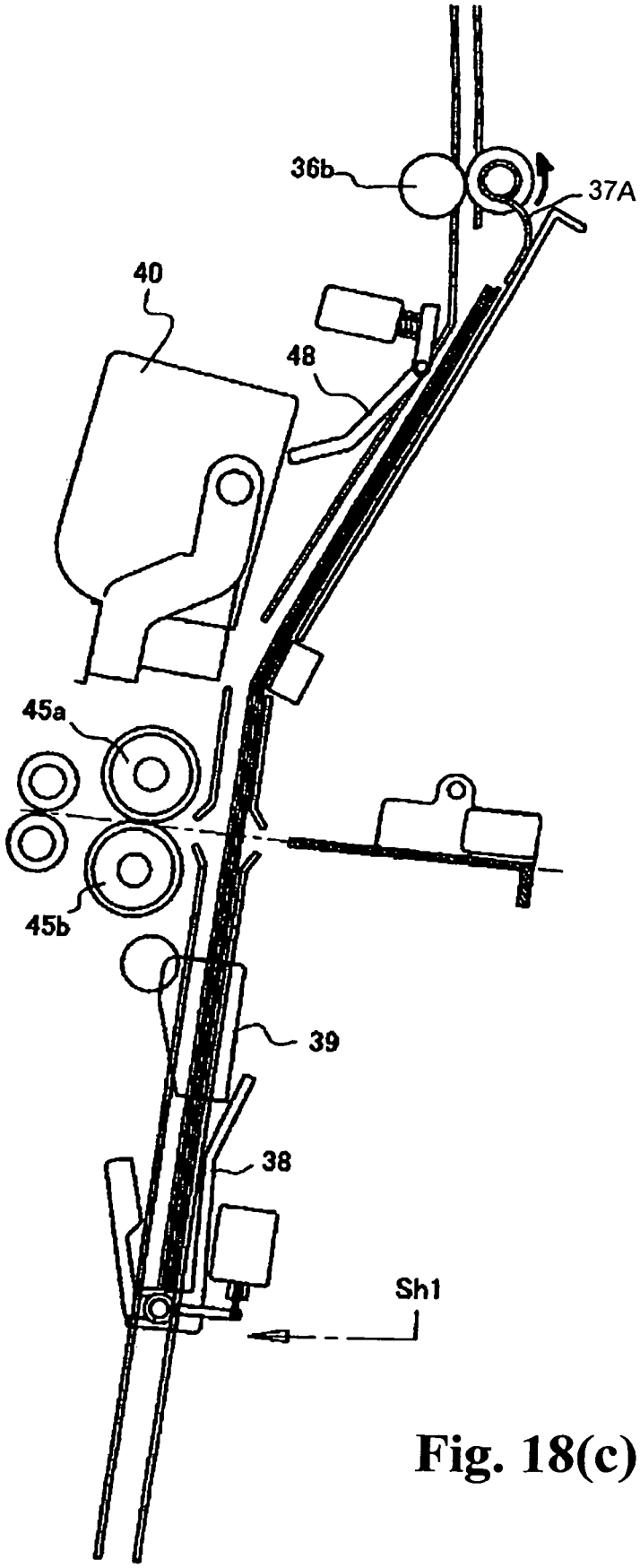
Figure 18D:
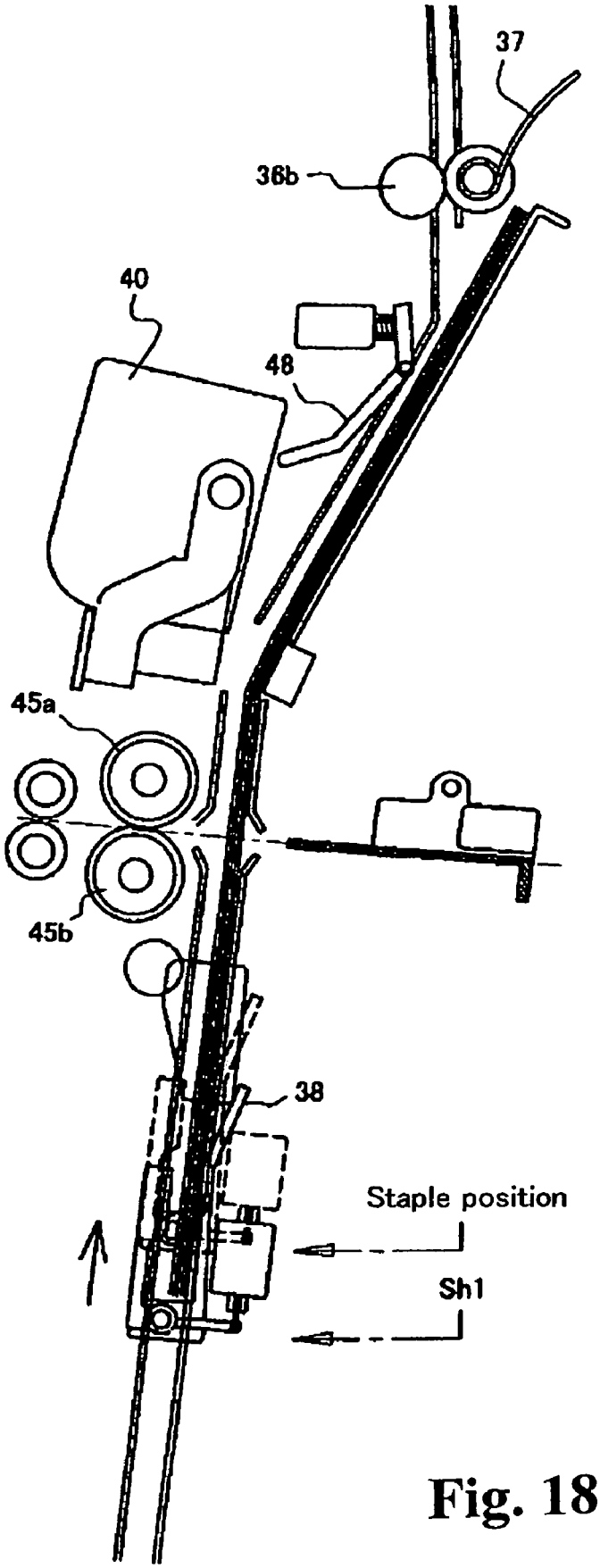
Figure 18E:
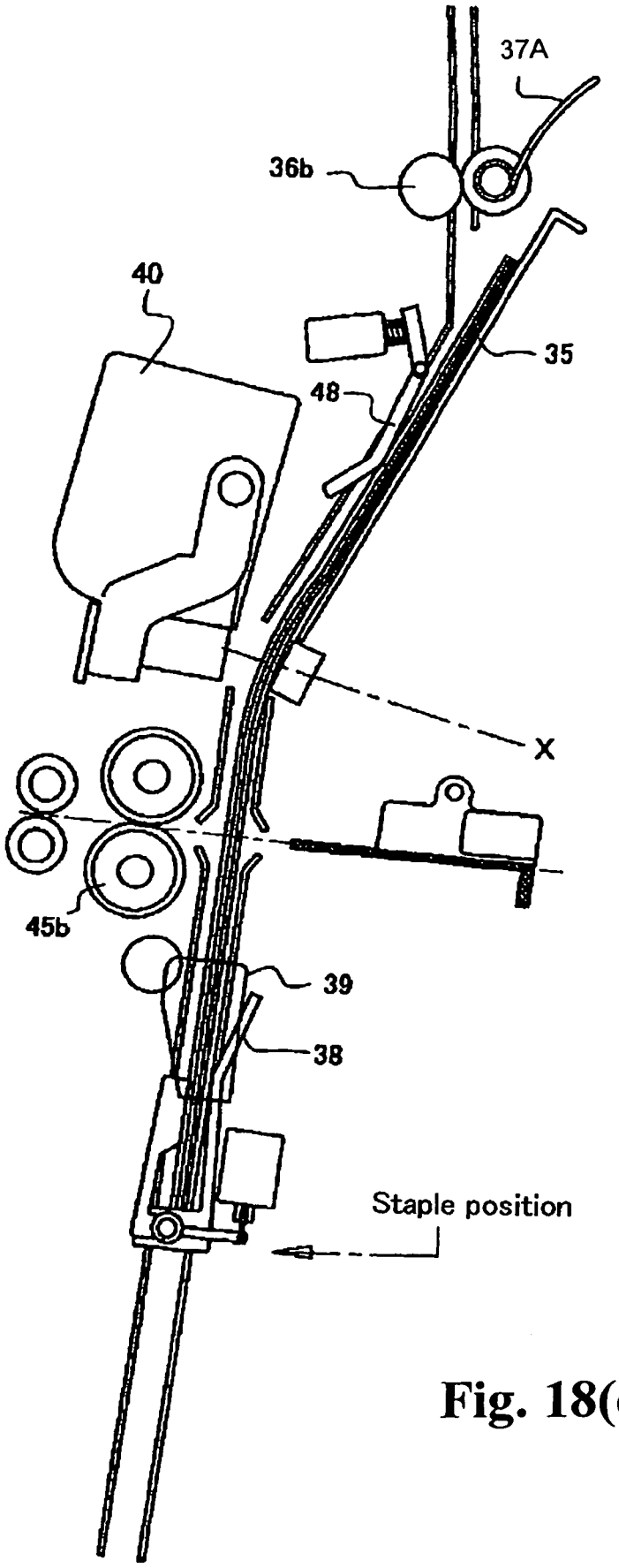
Figure 18F:
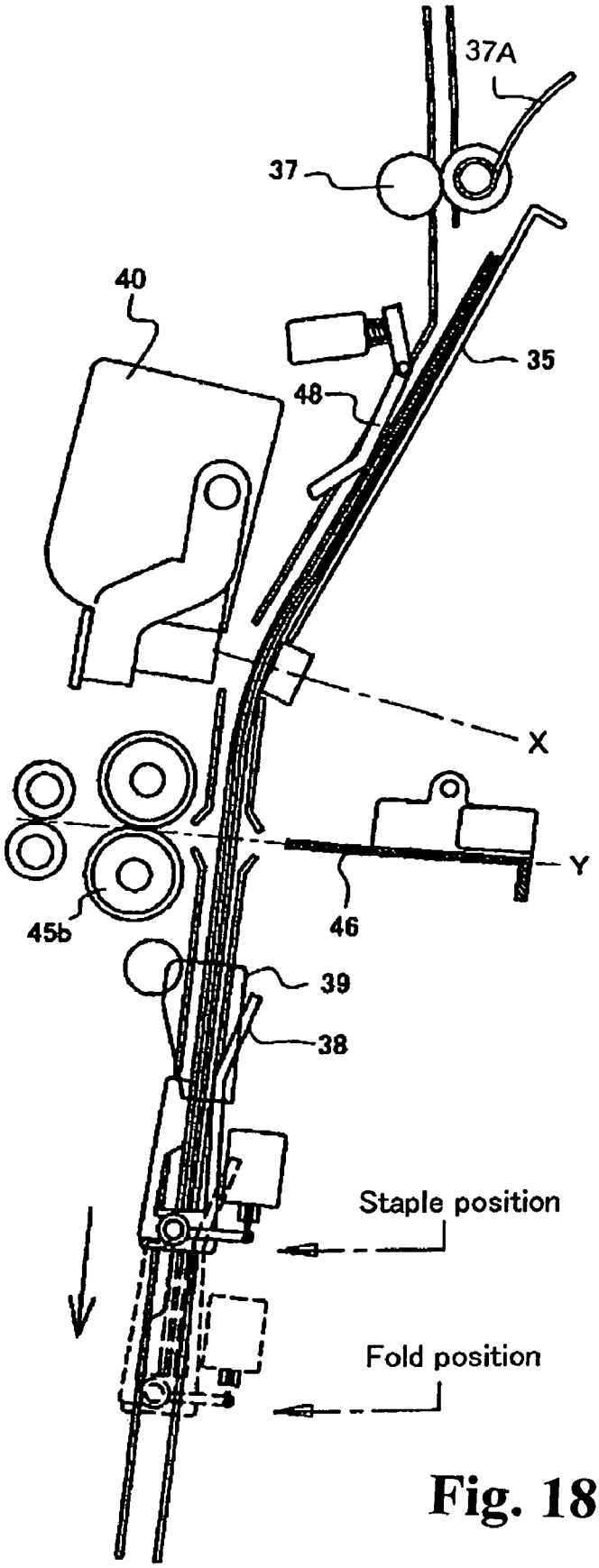
Figure 18G:
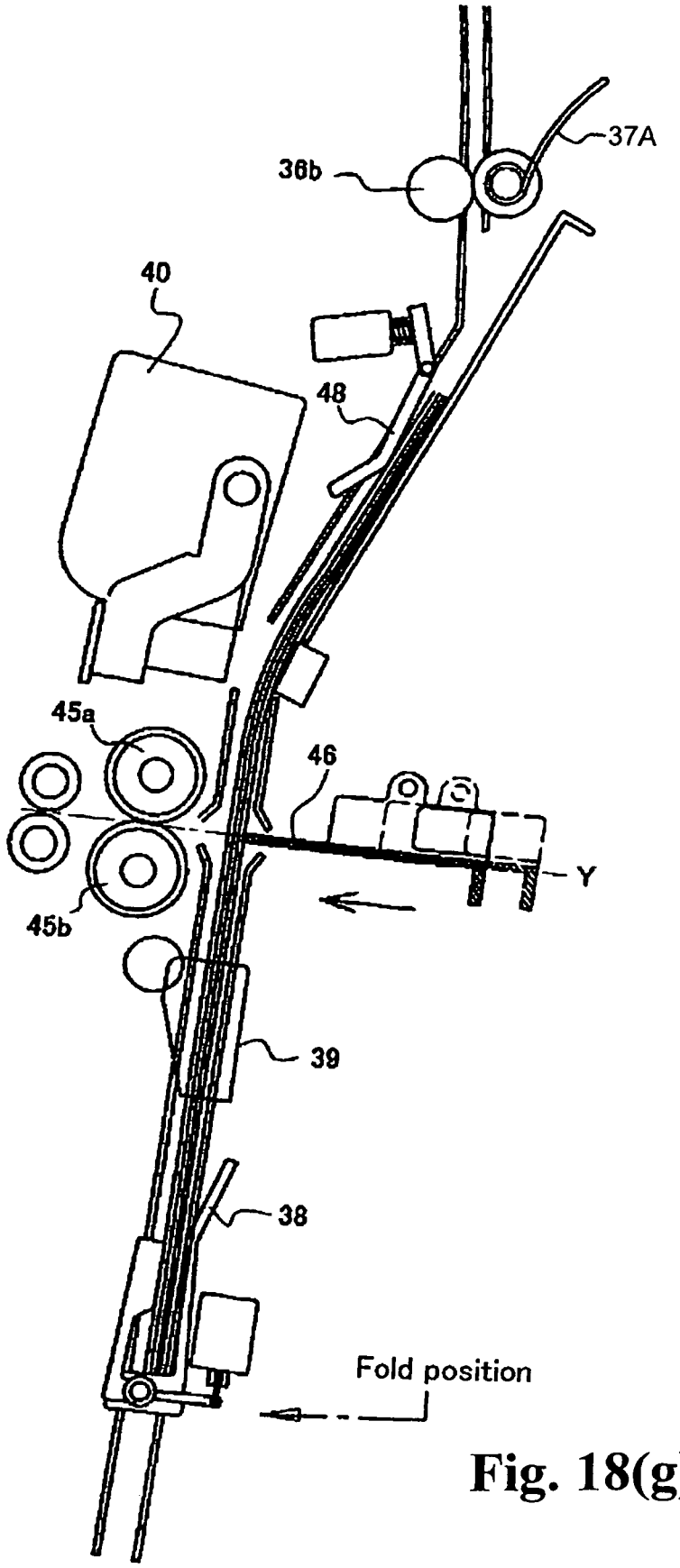
Figure 18H:
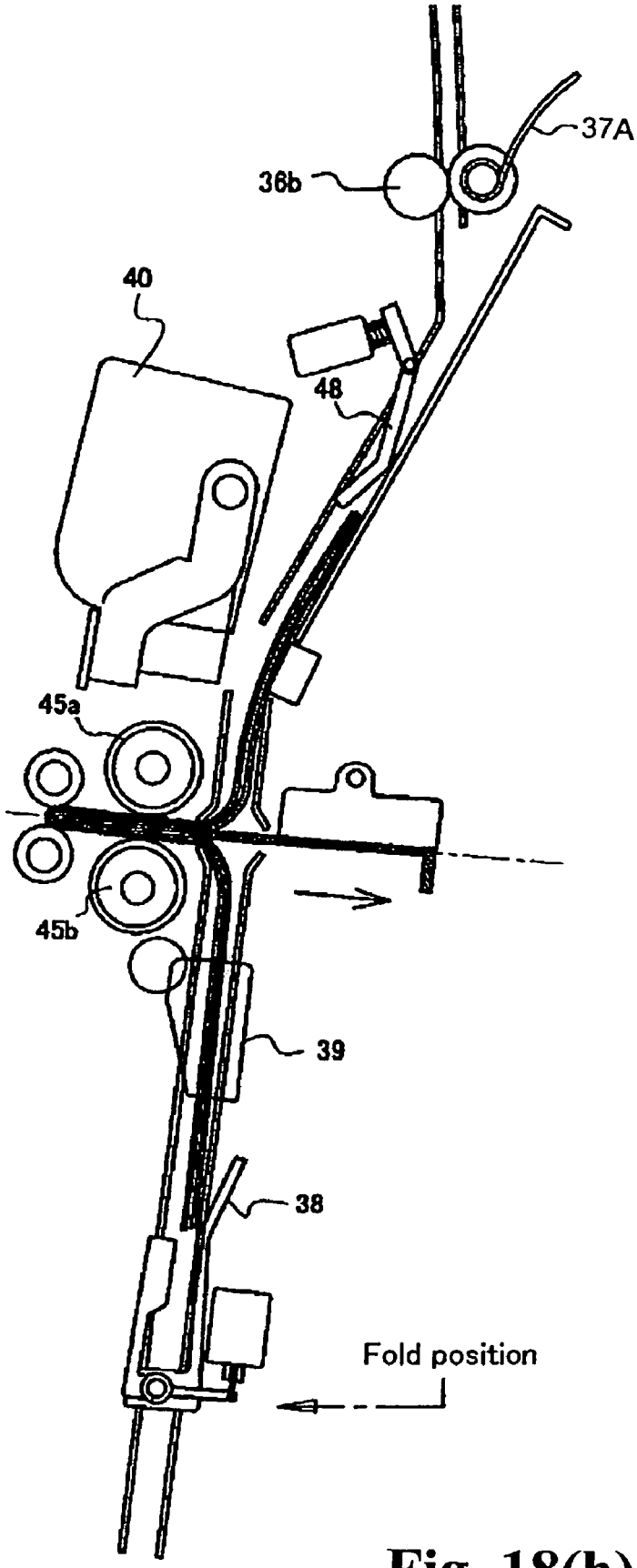

FIGS. 16(*a*), 16(*b*), and 17 show a different embodiment of the carry-in guide. In the first embodiment, the elastic guide piece 37A is elastically deformed every time the sheet is carried in. Thus, the repeated use of the guide piece may distort and deform a leading end thereof. To solve this durability problem, the second embodiment is configured as described below.

The sheet carry-in guide 37B, shown in FIGS. 16(*a*) and 16(*b*), is composed of a pivotal guide member 37*x* and a leading end guide member 37*y* attached to the pivotal guide member 37*x* via a shaft. The pivotal guide member 37*x* is pivotably supported by a rotating shaft 37*z* at a trailing end of the collecting guide 35. The pivotal guide member 37*x* is adapted to turn across an opening 35*c* formed in the collecting guide 35. A leading end guide member 37*y* is pivotably supported at a leading end of the pivotal guide member 37*x* via a shaft pin 37*p*. On the carry-in guide 37B configured as described above, a control motor Mp1 is coupled to the rotating shaft 37*z*. The control motor Mp1 rotates to turn the pivotal guide member 37*x* above the collecting guide 35. The leading end guide member 37*y* is located to engage the trailing end of the sheets on the collecting guide 35. The leading guide member 37*y* is configured to swing in the direction of an arrow around the shaft pin 37*p* as the pivotal guide member 37*x*, located at the base end thereof.

Thus, when the pivotal guide member 37*x* is positioned as shown in FIG. 16(*a*), the sheet from the sheet discharging port 36*a* is guided along a top surface of the pivotal guide member 37*x* and then a top surface of the leading end guide member 37*y* onto the uppermost sheet on the collecting guide 35. After the sheet is carried onto the collecting guide 35, the control motor Mp1 is rotated to rotate the pivotal guide member 37*x* counterclockwise in FIG. 16(*a*). The pivotal guide member 37*x* returns from the state in FIG. 16(*a*) to the state in FIG. 16(*b*). At this time, the leading end guide member 37*y* is obstructed by the sheets on the collecting guide 35 and thus swung so as to be folded around the center of the shaft pin 37*p*. The leading end guide member 37*y* thus returns to the state shown in FIG. 16(*a*).

The pressurizing means 48 is provided above the collecting guide 35 to urge the trailing end of the collected sheets together with the carry-in guide means 37. The pressurizing means 48 urges the trailing end of the sheets when the sheets are stapled at the staple position X, described below, and/or when the sheets are folded together at the fold position Y, described below. The pressurizing means is configured as described below in a first embodiment and a second embodiment.

FIGS. 15(*a*) and 15(*b*) show a first embodiment of the pressurizing means. Illustrated pressurizing means 48A is composed of a paper urging piece 48*a* located at the trailing end of the collecting guide 35 to urge the sheet trailing end. The paper urging piece 48*a* is supported by a swing pin 48*p* so as to be pivotable above the collecting guide 35. The paper urging piece 48*a* is configured to be swingable between an urge position where the paper urging piece 48*a* pivots around the swing pin 48*p* to engage the uppermost sheet on the collecting guide 35 and the retract position where the paper urging piece 48*a* lies away from the uppermost sheet. An electromagnetic solenoid (driving means) 48*b* and a bias spring 48*c* are coupled to the paper urging piece 48*a*. The bias spring 48*c* always urges the uppermost sheet on the collecting guide 35 by a predetermined pressurizing force p1. The electromagnetic solenoid 48*b* separates the paper urging piece 48*a* from the uppermost sheet against the force of the bias spring 48*c*.

The pressuring force p1 is set to balance with a gripping force p2 exerted on the sheet leading end by the grip member 38*b*. The spring forces of the bias spring 48*c* and the bias spring 38S, acting on the grip member 38*b*, described above, are adjusted so as to exert substantially equal pressurizing forces on the sheet bunch on the collecting guide 35. Thus, when the folding blade means 46, described below, inserts the sheet bunch toward the folding roll means 45, the gripping force (pressure p2) of the grip member 38*b*, acting on the sheet bunch leading end, balances with the urging force (pressure p1) of the paper urging piece 48*a*, acting on the sheet bunch trailing end. Consequently, the spring pressures are preferably set so that the relationship between the pressure p2 of the sheet leading end and the pressure p1 of the sheet trailing end and the weight Sp of the average sheet bunch is [p1+Sp=p2].

A different embodiment of the pressurizing means will be described below.

FIGS. 16(*a*) and 16(*b*) show the configuration of the pressurizing means 48B for urging the sheet bunch on the collecting guide 35 in conjunction with the carry-in guide 37B. The paper urging piece 48*x*, which urges the sheet trailing end, is located above the collecting guide 35 so as to be swingable around a shaft 48*y*. The paper urging piece 48*x* is configured to pivot around the shaft 48*y* to move in the vertical direction between the urge position where the paper urging piece 48*x* urges the uppermost sheet on the collecting guide 35 and the retract position where the paper urging piece 48*x* lies away from the uppermost sheet. A bias spring 48*z* is provided on the paper urging piece 48*x* in a direction in which the bias spring 48*z* always urges the uppermost sheet. The shaft 48*y* has a cam member (not shown) that shifts the paper urging piece to the retract position away from the uppermost sheet against the force of the bias spring 48*z*. Thus, when a control motor Mp2 coupled to the shaft 48*y* is rotated to position the carry-in guide 37B above the uppermost sheet on the collecting guide 35, the pressurizing means 48B is synchronously placed at the standby position (located away from the uppermost sheet). When the carry-in guide 37B is positioned away from the collecting guide 35, the pressurizing means 48B is synchronously placed at the position where the pressurizing means 48B urges the uppermost sheet. The spring pressure of the bias spring 48*z* is set so that in this case, the pressure p1, exerted on the sheet trailing end by the paper urging piece 48*x*, balances with the pressurizing force p2 of the grip member 38*b*, which grips the sheet leading end.

Now, with reference to FIGS. 11(*a*) to 11(*h*), description will be given of the sheet collecting (setting) operation and post-processing operation, performed by the post-processing apparatus, in connection with another embodiment. The present embodiment differs from the process operation described with reference to FIGS. 14(*a*) to 14(*d*) in that the former involves the operation of the paper urging piece 48*a*, which urges the sheet trailing end, and of an elastic guide piece 37A.

[See Initial State Diagram 18(*a*)]

FIG. 18(*a*) shows an initial state immediately before the carry-out of the sheets from the image forming apparatus A to the post-processing apparatus B. In this case, the carry-in guide 37'A (the carry-in guide 37B is the same as the carry-in guide 37'A, this also applies to the description below) is located at a home position (shown in FIG. 18(*a*)) different from the guide position on the collecting guide. The pressurizing means 48A (the pressurizing means 48B is the same as the pressurizing means 48A; this also applies to the description below) is located at the urge position (home position; illustrated position) on the collecting guide 35. The grip means 38*b* is located at the grip position (home position; illustrated position).

Control means provided in the post-processing apparatus B and composed of, for example, a CPU (not shown), receives sheet discharging instruction signal and sheet size information from the image forming apparatus A. On the basis of the sheet size information, the control means moves the sheet end regulating means 38 from the home position to a position corresponding to the sheet length (Sh1, Sh2, or Sh3 in FIG. 18(*b*)). The position Sh is preset so as to align the trailing end of the sheet fed by the image forming apparatus A with a predetermined position Z on the collecting guide 35.

The control means receives the sheet fed by the image forming apparatus A on the sheet carry-in path P1 and feeds the sheet to the downstream sheet discharging roller 25 via the conveying roller 24. The control means uses the sheet sensor S1 on the sheet conveying path P1 to detect the sheet trailing end. At the time when the sheet trailing end is expected to pass through the path switching piece 27, the control means actuates the path switching piece 27. At this time, the control means moves the path switching piece 27 so as to move the sheet to the second switchback conveying path SP2. The control means subsequently reverses the sheet discharging roller 25 to carry the sheet trailing end into the second switchback conveying path SP2.

Simultaneously with the above-described operation, the control means moves the carry-in guide 37'A, the pressurizing means 48A, and the grip member 38*b* to the sheet guide position, the retract position, and the retract position, respectively, as shown in FIG. 18(*b*). The carry-in guide 37'A rotates the driving motor 37M (not shown) through a predetermined angle on the basis of a home position sensor 37*hs* (not shown) to move the elastic guide piece 37A to the guide position. The sheet is thus guided onto the collecting guide 35 through the sheet discharging port 36*a*. The pressurizing means 48A supplies power to the electromagnetic solenoid 48*b* to move to the retract position where the paper urging piece 48*a* lies away from the uppermost sheet on the collecting guide 35. The grip member 38*b* turns on the actuating solenoid 38L to move to an inoperative position (release position) where the grip member 38*b* is retracted from the sheets. In this condition, the control means actuates sheet discharging rollers 36*b* and 36*c* to feed the sheet (carried-in sheet) guided onto the second switchback conveying path SP2, onto the collecting guide 35.

At the time when the carried-in sheet reaches the collecting guide 35 on the basis of a sheet end sensing signal from the sheet sensor S2, located at the sheet discharging port 36*a*, the control means rotationally drives the driving motor 37M for the carry-in guide 37'A. The elastic guide piece 37A then turns around the base end 37*a* thereof above the collecting guide 35. At this time, the leading end 37*b* engaging the sheets on the collecting guide 35 is elastically deformed and turns along the collecting guide 35. The elastic guide piece 37A rotates through 360° and the leading end thereof returns onto the carried-in sheet. In this condition, when the succeeding sheet is carried in through the sheet discharging port 36*a*, the carried-in sheet is guided onto the uppermost sheet on the collecting guide 35 as described above. The repetition of this operation allows the sheets fed to the sheet discharging port 36*a* to be sequentially stacked on the collecting guide 35.

Once the series of sheets are collected on the collecting guide 35, the control means executes the post-processing on the sheet bunch on the collecting tray 29 in response to the "job end signal" from the image forming apparatus A. The illustrated apparatus is configured to execute the stapling process and then the folding process on the sheet bunch collected on the collecting guide 35. Thus, upon receiving the job end signal, the control means turns on the actuating solenoid 38L of the grip means 38*b* to grip the leading edge of the sheet bunch. At this time, the carry-in guide 37'A moves to retract position (home position; illustrated position) where the carry-in guide 37'A is retracted from the collecting guide 35. The pressurizing means 48A is held at the standby position (the electromagnetic solenoid 48*b* is on).

The control means uses the shift means MS to move the position of the leading end regulating unit (leading end locking member 38*a* and gripping member 38*b*). This position movement is such that the predetermined position (for example, the sheet center) of the sheet bunch positioned by the leading end locking member 38*a* and gripped by the grip member 38*b* is moved to the staple position X.

Then, the control means moves the sheet bunch on the collecting guide 35 to the staple position X and then moves the processing means 48A to the urge position. In this operation, the electromagnetic solenoid 48*b* is switched from standby position (ON state) to the urge position (OFF state) to shift the paper urging piece 48*a* from the retract position to the urge position. Then, the leading end of the sheet bunch position placed at the staple position X is gripped by the grip member 38*b*, whereas the trailing end thereof is urged and held by the paper urging piece 48*a* of the pressurizing means 48A. In this condition, the control means actuates the staple device 40 to execute the stapling operation on the sheet bunch. The stapling operation of the staple device 40 is as described above.

After the stapling operation is finished, the control means moves the staled sheet bunch to the downstream fold position Y. When the sheet bunch is moved to the downstream fold position Y, the paper urging piece 48*a* of the pressurizing means 48A is held at the position where the paper urging pierce 48*a* urges the trailing end of the sheet bunch. Furthermore, the grip member 38*b* grips the leading end of the sheet bunch. Subsequently, with the opposite ends of the sheet bunch held by the pressurizing means 48A and the grip member 38*b*, the control means allows the shift means MS to move the leading end regulating unit to move the sheet bunch to the fold position Y. The opposite ends of the sheet bunch are held to appropriately stretch the sheet bunch which improves the folding accuracy.

Once the sheet bunch moves to the predetermined fold position, the control means shifts the paper urging piece 48*a* of the pressurizing means 48A to the urge position. In this shifting operation, the electromagnetic solenoid 48*b* is turned off to allow the bias spring 48*c* to urge and bias the paper urging piece 48*a* toward the collecting guide 35. The leading end of the sheet bunch on the collecting guide 35 is held by the grip member 38*b*, while the trailing end thereof is urged and held by the paper urging piece 48*a*, as shown in FIG. 18(*g*). The control means folds the sheet bunch in accordance with a procedure described below. As shown in FIG. 18(*h*), the sheet bunch with the leading and trailing ends thereof pressurized by the grip member 38*b* and the paper urging piece 48*a*, respectively, has the center thereof bent by the folding blade and folded by the folding rolls. FIG. 18(*g*) shows that the bending operation is started, and FIG. 18(*h*) shows that the sheet bunch has left the grip member and the paper urging piece.

The releasable clutch means is provided between the paired first and second rolls, which are in pressure contact with each other, and the driving means is provided. When the folding blade inserts the sheet bunch between the roll nips, the first and second folding rolls rotate in conjunction with the sheets. Thus, when the folding blade inserts the sheet bunch to the nip position, the sheets are prevented from being caught between the drivingly rotating rolls. This allows the folding blade to advance the sheet bunch to the nip position with the correct fold line position maintained. Therefore, when the folding blade inserts the sheet bunch to the nip position, the plurality of sheets can be folded together at the correct fold line position with leading sheets prevented from being caught between the folding rolls.

Furthermore, the sheet bunch is folded between the pair of folding rolls rotating at the moving speed of the folding blade. This prevents the sheet bunch from being rucked or damaged, and particularly prevents the stapled sheet bunch from being damaged. Therefore, the folding process can be achieved so as to provide high finish quality.

Furthermore, when the folding blade folds the sheet bunch between the first and second folding rolls, the driving means for the folding rolls is stopped or rotated at a speed lower than that of the folding blade. This prevents the roll driving means from interfering with the folding of the sheet bunch and enables the sheet bunch to be reliably folded at the correct fold line position. The present invention thus exerts significant effects.

Additionally, according to the present invention, the sheet guide holding the sheet bunch at the fold position is provided and the folding roll means is located offset and away from the sheet guide. The folding blade means bends and inserts the sheet bunch between the roll nips. In this configuration, the sheet guide is curved so as to roll back the sheet bunch toward the folding roll means, to tightly support the sheet bunch with no void created between the sheets. In this condition, the sheet bunch is angularly bent and inserted between the roll nips by the blade means. This prevents the leading ends (fore edges) of the sheets folded by the folding rolls from being significantly misaligned in the inserting direction. Therefore, a folding device with high folding quality can be provided.

Additionally, when supported on the sheet guide, curled sheets, particularly sheets curled in the direction opposite to that in which the sheet bunch is bent by the blade means are straightened in the bending direction. All the sheets thus conform to the same curved shape. Therefore, when the folding blade pushes the sheet bunch out of the narrow outlet guide portion of the sheet guide, the front layer sheet and the other sheets are prevented from being rucked.

Furthermore, the sheet guide is formed to roll back the sheets fed out from the image forming apparatus, in the sheet curving direction, that is, so that the sheet surfaces with images previously formed thereon are located inside. This prevents, for example, sheets curled by heat fixing from being forcibly curved in the opposite direction. The present invention thus exerts a significant effect of, for example, preventing the sheets from being rucked.

Furthermore, in the configuration according to the present invention in which the folding blade inserts and folds the sheet bunch between the paired folding rolls, which are in pressure contact with each other, at least one of the folding rolls has the shift means for reducing or releasing the pressure contact force. The shift means is configured to move in conjunction with the folding blade means, which moves from the standby position to the nip position, to adjust the pressure contact force of the folding rolls. Thus, when the folding blade means inserts the sheets to the nip position, the sheets are sandwiched by the predetermined pressure contact force. When the sheets are carried out from the rolls, the pressure contact force is reduced or released. Consequently, the present invention exerts the following effects.

When the rolls form a fold line on the sheets fed by the folding blade means, the sheets are sandwiched and folded by the predetermined pressure. When the sheets are carried out, the pressure contact force is reduced or released. The sheets can thus be reliably folded without being rucked. The pressurization of the rolls are controlled so that the sheets transferred by the folding blade are sandwiched at the fold line position in conjunction with the transfer timing regardless of the thickness of each of the sheets to be folded or of the sheet bunch to be folded. This prevents the fold line position on the sheets and the position of the rolls sandwiching the sheets therebetween from being misaligned in the transferring direction. Thus, the sheets can be always folded accurately at the correct fold line position. After the fold line position on the sheets passes through the rolls, the pressurization of the sheets by the rolls is released or reduced. The sheets are thus prevented from being rucked.

Furthermore, in this case, the required structure is such that one of the rolls is configured so that the position thereof can be moved so as to reduce or release the pressure contact force and such that the shift means for moving the position of the rolls operates in conjunction with the folding blade means. Consequently, the embodiment of the present invention can provide a small, inexpensive device having the simple structure without the need for any special driving means.

Moreover, the timing when the pressurizing force of the rolls is reduced is associated with the operation of leaving and retracting the folding blade means from the sheets. This prevents the sheets from being rucked during the pullout operation of retracting the blade means from the folded sheets.

Furthermore, according to the embodiment of the present invention, the carry-out guide means, located downstream of the first and second rolls, which are in pressure contact with each other, is curved upward or downward in the device. The first and second rolls feed the sheets by different amounts (speeds) so that the sheet bunch conforms to the shape of the curved path. The sheet bunch fed out from the folding rolls is naturally curved along the path guide. This enables a reduction in conveying loads, allowing the sheets to be smoothly carried out. Thus, the sheet bunch folded into a booklet is prevented from being jammed in the downstream curved path and significantly reduces the driving load required for the carry-out operation. A small, compact device can thus be provided.

That is, in the conventional art, for example, the sheet bunch is nipped between cylindrical rolls over the entire width of the sheets during the carry-out operation, and is delivered in a posture orthogonal to the roll pressure contact direction. Thus, upon abutting against the curved guide and being curved, the sheet bunch may be, for example, rucked or jammed. In contrast, according to the embodiments of the present invention, the sheet bunch is delivered in the curving direction along the guide, reducing the likelihood of rucking or jamming as well as the driving load.

Additionally, the required structure in this case is such that the rolls, which are in pressure contact with each other, operate at different peripheral speeds. This makes it possible to provide a device having the simple structure and enabling a reduction in the likelihood of rucking and carry-out jamming.

Moreover, according to the embodiments of the present invention, the sheet end regulating means for placing and holding the sheets at the fold position on the sheet guide is composed of the grip means for gripping the sheet edge and the shift means for moving the position of the grip means. Thus, the sheet bunch collected on the sheet guide can be accurately placed and set at the fold position on the basis of the length size of the sheets. In particular, even if the edge of the sheets collected in a bunch is curled, the position of the sheets is moved with the curled edge gripped, preventing the plurality of sheets from being misaligned when placed at the fold or staple position.

Furthermore, the sheet guide is curved or bent so that the sheet bunch projects toward the rolls at the fold position. The sheets are thus prevented from being rucked or subjected to the misalignment of the fold line position, at the fold position. When the sheet bunch is thus supported so as to roll back, the sheet bunch is gripped by the grip means to move the position thereof. This prevents the leading ends of the plurality of sheets from being misaligned.

Furthermore, the pressurizing means for urging the sheets is provided at one edge of the sheets the other edge of which is gripped by the grip means. Thus, when the folding blade means inserts the fold line on the sheet bunch between the rolls, the load imposed on the sheet bunch by the grip means balances with the load imposed on the sheet bunch by the pressurizing means. This prevents the fold line position from being misaligned. The present invention thus exerts the significant effects described above.

The present application claims the priorities to Japanese Patent Application No. 2007-022037, Japanese Patent Application No. 2007-089280, Japanese Patent Application No. 2007-089284, Japanese Patent Application No. 2007-089283, and Japanese Patent Application No. 2007-144037.

What is claimed is:

1. A sheet folding device comprising:

a guide device for holding a sheet bunch at a predetermined fold position;

a folding roll device having a first folding roll and a second folding roll arranged at the fold position in pressure contact with each other;

a folding blade inserting the sheet bunch supported on the guide device to a nip position between the first and second folding rolls;

a roll driving device for rotationally driving the first and second folding rolls;

a blade driving device for moving the folding blade from a standby position to the nip position on the folding rolls;

a clutch device for releasably coupling the first and second folding rolls and the roll driving device; and a driving control device for controlling the roll driving device and the blade driving device, the driving control device controlling the clutch device so that when the folding blade inserts the sheet bunch to the nip position on the first and second folding rolls, the first and second folding rolls rotate following the inserted sheets, wherein at least one of the first and second folding rolls has a shift device for reducing or releasing a pressure contact force of the folding rolls, the shift device is configured to adjust the pressure contact force of the first and second folding rolls in conjunction with the folding blade moving from the standby position to the nip position, and the shift device and the folding blade are interconnected so that when the folding blade inserts the sheets between nips of the first and second folding rolls, the sheets are brought into pressure contact with the folding rolls by a predetermined pressure contact force to form a fold line, and when carrying out the sheets with the fold line formed thereon from the paired folding rolls, the pressure contact force is reduced to carry out the sheets downstream.

2. The sheet folding device according to claim 1, wherein the first and second folding rolls are in pressure contact with each other under a predetermined pressure such that a coefficient of friction between the first and second folding rolls and the sheets is greater than that of friction between the sheets, and a coefficient of friction between the folding blade and the sheets is smaller than that of friction between the sheets.

3. The sheet folding device according to claim 1, wherein said roll driving device comprises a driving motor and a one-way rotation clutch transmitting a rotating force of the driving motor to the first and second folding rolls, the driving control device stopping the driving motor when the folding blade is moved from the standby position to the nip position.

4. The sheet folding device according to claim 1, wherein the roll driving device comprises a roll driving motor and a transmission device having a one-way rotation clutch transmitting a rotating force of the roll driving motor to the first and second folding rolls, the blade driving device comprises a blade driving motor and a transmission device for transforming a rotating force of the blade driving motor into a reciprocating linear motion and then transmitting the reciprocating linear motion to the folding blade, and the driving control device controls the roll driving motor and the blade driving motor so that when the folding blade is moved from the standby position to the nip position, the roll driving motor is rotated so as to rotate the first and second folding rolls at a peripheral speed slower than a moving speed of the folding blade and so that the first and second folding rolls rotate following the sheet bunch moved by the folding blade on a basis of a difference between the moving speed of the folding blade and the peripheral speed of the folding rolls, and then, the folding blade stops and the folding rolls rotate to transfer the sheet bunch in the folding direction.

5. The sheet folding device according to claim 1, wherein at least one of the first and second folding rolls forms a movable roll which can be moved away from the other folding roll, the folding blade has a cam shift device moving following movement from the standby position to the nip position, and the movable roll is configured to reduce the pressure contact force following a sheet inserting operation of the folding blade using the cam shift device.

6. The sheet folding device according to claim 5, further comprising a carry-out roller provided downstream of the first and second folding rolls to carry out the folded sheets, and a bracket located so as to be swingable around a rotating shaft of the carry-out roller and supporting the movable roll, the bracket being swingable by the cam shift device to reduce the pressure contact force of the movable roll.

7. The sheet folding device according to claim 6, wherein the driving control device controls the clutch device so as to drivingly rotate the first and second folding rolls in a folding direction with the folding blade resting at the nip position after rotating, the first and second folding rolls rotate following the sheets inserted by the folding blade.

8. The sheet folding device according to claim 1, further comprising a stack device for accommodating the sheet bunch from the folding rolls, located above or below the folding blade in a sheet bunch transferring direction; and a carry-out guide device for guiding the sheet bunch from the folding rolls to the stack device, the carry-out guide device constituting a path curved upward or downward so as to guide the sheet bunch from the folding roll device to the stack device, wherein the driving control device operates so that when the sheet bunch folded by the folding rolls is carried out to the carry-out guide device, the first and second folding rolls constituting the folding rolls feed the sheets by different amounts.

9. The sheet folding device according to claim 8, wherein the driving control device rotationally drives the folding roll located inside in a curving direction of the carry-out guide device, at a lower peripheral speed than the folding roll located outside in the curving direction.

10. The sheet folding device according to claim 1, further comprising a sheet end regulating device for regulating leading ends of the sheets supported on the sheet guide; the sheet end regulating device comprising a grip device for gripping first edges of the sheets supported on the sheet guide, and a shift device for moving a position of the grip device along the sheet guide.

11. The sheet folding device according to claim 10, further comprising a pressurizing device, located in the sheet guide, for urging second edges of the sheets with the first edge gripped by the grip device, the pressurizing device imposing a load on the second edge of the sheets to balance with a load imposed on the first edge of the sheets by the grip device when the folding blade device inserts the sheets into the folding rolls.

12. A post-processing apparatus for setting sheets carried out from an image forming apparatus and executing post-processing on the sheets, the post-processing apparatus comprising:

a sheet collecting device for setting the sheet sequentially fed into a bunch; and the sheet folding device according to claim 1, for folding the sheet bunch collected by the sheet collecting device at a fold position set on or downstream of the sheet collecting device.

13. The post-processing apparatus according to claim 12, further comprising a staple device for stapling the sheet bunch before the sheet bunch reaches the fold position located on or downstream of the sheet collecting device.

14. The post-processing apparatus according to claim 12, further comprising:

a sheet carry-in path along which the sheet from a carry-in port is conveyed downstream;

a switchback conveying path branching from the sheet carry-in path and along which the sheet is conveyed to the sheet collecting device;

a second sheet collecting device located at a position different from that of the sheet collecting device, for setting sequentially fed sheets into a bunch;

a saddle switching staple device located on or downstream of the sheet collecting device, for stapling the sheet bunch at a center thereof before the sheet bunch reaches the fold position; and an end staple device for stapling the sheet bunch collected on the second sheet collecting device, at an edge thereof.

15. An image forming system comprising:

an image forming apparatus sequentially forming images on sheets; and a post-processing apparatus executing post-processing on the sheets from the image forming apparatus, the post-processing apparatus comprising:

a sheet carry-in path along which the sheet from a carry-in port is conveyed downstream;

a switchback conveying path branching from the sheet carry-in path and along which the sheet is switched back and conveyed;

a sheet collecting device for setting the sheets sequentially fed along the switchback conveying path, into a bunch; and the sheet folding device according to claim 1, the sheet folding device folding the sheet bunch collected by the sheet collecting device at a fold position on or downstream of the sheet collection device.

* * * * *